US007123247B2

(12) United States Patent
Morita

(10) Patent No.: US 7,123,247 B2
(45) Date of Patent: Oct. 17, 2006

(54) DISPLAY CONTROL CIRCUIT, ELECTRO-OPTICAL DEVICE, DISPLAY DEVICE AND DISPLAY CONTROL METHOD

(75) Inventor: Akira Morita, Suwa (JP)

(73) Assignee: Seiko Epson Corporation, (JP)

( * ) Notice: Subject to any disclaimer, the term of this patent is extended or adjusted under 35 U.S.C. 154(b) by 482 days.

(21) Appl. No.: 10/158,565

(22) Filed: May 30, 2002

(65) Prior Publication Data

US 2002/0196243 A1 Dec. 26, 2002

(30) Foreign Application Priority Data

Jun. 4, 2001 (JP) ..... 2001-168517
Sep. 13, 2001 (JP) ..... 2001-278735

(51) Int. Cl.
*G09G 5/00* (2006.01)

(52) U.S. Cl. ..... 345/204; 345/98

(58) Field of Classification Search ..... 345/87–100, 345/204, 205

See application file for complete search history.

(56) References Cited

U.S. PATENT DOCUMENTS

| | | | | |
|---|---|---|---|---|
| 5,900,856 | A * | 5/1999 | Iino et al. | 345/100 |
| 6,731,266 | B1 | 5/2004 | Jung | 345/103 |
| 2001/0033278 | A1* | 10/2001 | Ohta et al. | 345/204 |
| 2002/0135556 | A1* | 9/2002 | Nakajima et al. | 345/98 |
| 2002/0154109 | A1* | 10/2002 | Ikeda | 345/211 |

FOREIGN PATENT DOCUMENTS

| | | | |
|---|---|---|---|
| CN | 1246698 | A | 3/2000 |
| JP | A-07-175435 | | 7/1995 |
| JP | A-09-55909 | | 2/1997 |
| JP | A-10-240195 | | 9/1998 |
| JP | A-11-184434 | | 7/1999 |
| JP | 11-311981 | | 11/1999 |
| JP | A-2000-10520 | | 1/2000 |
| JP | A-2000-181414 | | 6/2000 |
| JP | A-2001-34244 | | 2/2001 |
| JP | 2003-058130 | | 2/2003 |

OTHER PUBLICATIONS

Communication from China re: counterpart application.
Communication from Japan Patent Office regarding corresponding Japanese Patent Application No. 2001-278735.
Communication from Japanese Patent Office re: related application.

* cited by examiner

*Primary Examiner*—Richard Hjerpe
*Assistant Examiner*—Jean Lesperance
(74) *Attorney, Agent, or Firm*—Harness, Dickey & Pierce, P.L.C.

(57) ABSTRACT

A display control circuit, an electro-optical device, a display device and a display control method, which can make a high image quality and a low power consumption compatible and which are suited for an active matrix type liquid crystal panel. An LCD controller comprises a control circuit, a RAM, a host I/O and an LCD I/O. The control circuit includes a command sequencer, a command setting register and a control signal generation circuit. The command setting register includes a signal driver setting register, a scan driver setting register and a control register. On the basis of the command setting register set by a host, the command sequencer sets a display area (or a non-display area) at a line block unit for a signal driver and a scan driver. The LCD controller supplies the image data corresponding to the set display area and controls the display timing for those drivers and a power circuit.

41 Claims, 45 Drawing Sheets

BLOCK OUTPUT SELECT REGISTER

PARTIAL DISPLAY SELECT REGISTER

SIGNAL DRIVER (BLOCK UNIT)

DISPLAY CONTROL CIRCUIT, ELECTRO-OPTICAL DEVICE, DISPLAY DEVICE AND DISPLAY CONTROL METHOD

Japanese Patent Application No. 2001-278735, filed on Sep. 13, 2001, and Japanese Patent Application No. 2001-168517, filed on Jun. 4, 2001 are herein incorporated by reference in their entirety.

TECHNICAL FIELD

The present invention relates to a display control circuit and an electro-optical device, a display device and a display control method using the display control circuit.

BACKGROUND

In a display unit of an electronic device such as a mobile telephone, there is used a liquid crystal panel for lowering the power consumption and for reducing the size and weight of the electronic device. For this liquid crystal panel, there has been demanded a higher image quality, as a high-information still or moving image is distributed according to the wide spreading of the mobile telephone in the recent years.

As the liquid crystal panel for realizing the high image quality of the display unit of the electronic device, there is known the active matrix type liquid crystal panel using a thin film transistor (as will be abbreviated into the "TFT") liquid crystal.

SUMMARY

According to one aspect of the present invention, there is provided a display control circuit which controls display of an electro-optical device having pixels specified by 1st to N-th scan lines (N is a natural number) and 1st to M-th signal lines (M is a natural number) intersecting each other, the display control circuit comprising:

an area-block-display control data storing section which stores area-block-display control data used to set a display area or a non-display area in units of area blocks each of which includes a plurality of the signal lines and a plurality of the scan lines;

a scan drive circuit setting section which sets the display area or the non-display area in units of the area blocks on the basis of the area-block-display control data, for a scan drive circuit which sequentially performs scan-driving of at least part of the 1st to N-th scan lines corresponding to the display area; and a signal drive circuit setting section which sets the display area or the non-display area in units of the area blocks on the basis of the area-block-display control data, for a signal drive circuit which drives at least part of the 1st to M-th signal lines corresponding to the display area.

According to another aspect of the present invention, there is provided a display control circuit which controls display of an electro-optical device having pixels specified by 1st to N-th scan lines (N is a natural number) and 1st to M-th signal lines (M is a natural number) intersecting each other, the display control circuit further comprising:

a band-partial-display control data holding section which holds band-partial-display control data used to set a display area or a non-display area in units of line blocks each of which includes a plurality of the scan lines; and a scan drive circuit setting section which sets the display area or the non-display area in units of the line blocks on the basis of the band-partial-display control data, for a scan drive circuit which performs scan-driving of the 1st to N-th scan lines.

According to still another aspect of the present invention, there is provided a display control circuit which controls display of an electro-optical device having pixels specified by 1st to N-th scan lines (N is a natural number) and 1st to M-th signal lines (M is a natural number) intersecting each other, the display control circuit comprising:

a setting section which sets a display area or a non-display area for a scan drive circuit which performs scan-driving of the 1st to N-th scan lines; and a control section which controls the scan drive circuit such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a given reference frame.

DETAILED DESCRIPTION

Figure 1:
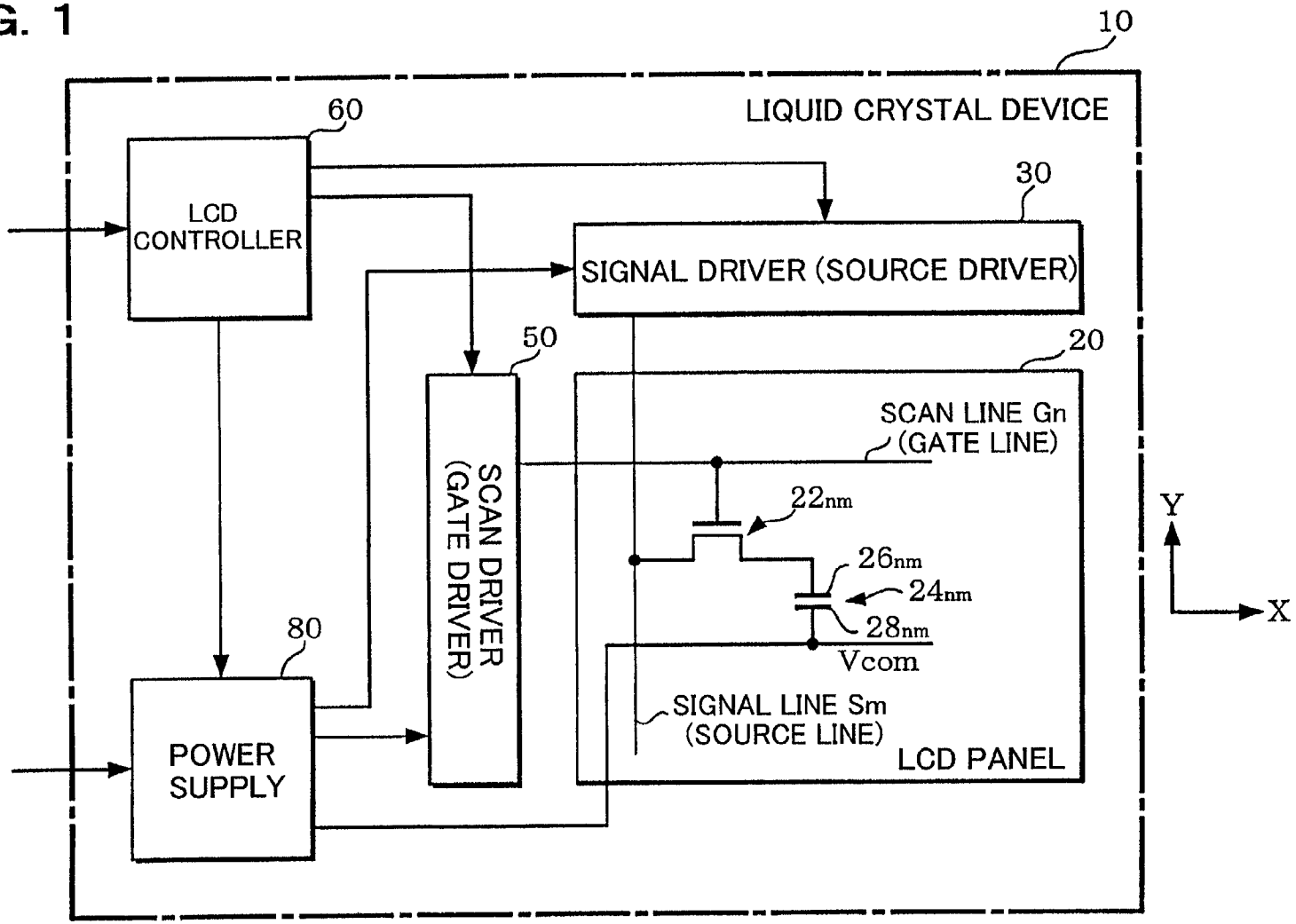
FIG. 1 is a block diagram schematically showing the configuration of a display device to which a display control circuit (or an LCD controller) according to one embodiment of the present invention is applied.

Embodiments of the present invention will be described below.

Note that the embodiments described below do not in any way limit the scope of the invention defined by the claims laid out herein. Similarly, all the elements of the embodiments described below should not be taken as essential requirements of the present invention.

Here, the active matrix type liquid crystal panel using the TFT liquid crystal is better suitable for realizing a high-speed response and a high contrast and for displaying moving images than the simple matrix type liquid crystal panel using the STN (Super Twisted Nematic) liquid crystal by the dynamic drive.

However, it has been difficult to adopt an active matrix type liquid crystal panel using the TFT liquid crystal as the display unit of a battery-driven mobile type electronic device such as a mobile telephone having a high power consumption. Therefore, it would be remarkably useful, if a low power consumption could be realized in the active matrix type liquid crystal panel. Then, it is desirable to minimize the degradation of the image quality of the active matrix type liquid crystal panel.

The following embodiments have been made in view of the technical problem thus far described, and can make a high image quality and a low power consumption compatible to provide a display control circuit suitable for the active matrix type liquid crystal panel, and an electro-optical device, a display device and a display control method using the display control circuit.

According to one embodiment of the present invention, there is provided a display control circuit which controls display of an electro-optical device having pixels specified by 1st to N-th scan lines (N is a natural number) and 1st to M-th signal lines (M is a natural number) intersecting each other, the display control circuit comprising:

an area-block-display control data storing section which stores area-block-display control data used to set a display area or a non-display area in units of area blocks each of which includes a plurality of the signal lines and a plurality of the scan lines;

a scan drive circuit setting section which sets the display area or the non-display area in units of the area blocks on the basis of the area-block-display control data, for a scan drive circuit which sequentially performs scan-driving of at least part of the 1st to N-th scan lines corresponding to the display area; and a signal drive circuit setting section which sets the display area or the non-display area in units of the area blocks on the basis of the area-block-display control data, for a signal drive circuit which drives at least part of the 1st to M-th signal lines corresponding to the display area.

Here, the electro-optical device may also be constructed to include: a plurality of scan lines and a plurality of signal lines crossing each other; switching circuits connected with the scan lines and the signal lines; and pixel electrodes connected with the switching circuits.

Moreover, the area block is the block which is specified by the line blocks including a plurality of scan lines and the line blocks including a plurality of signal lines. The scan lines to be divided in units of the line blocks may be a plurality of scan lines adjoining each other or a plurality scan lines selected arbitrarily.

This embodiment is provided with the area-block-display control data storing section, and the display area or the non-display area is specified in units of area blocks so that the display area or the non-display area can be specified in units of the line blocks individually for the signal drive circuit or the scan drive circuit by the signal drive circuit setting section or the scan drive circuit setting section. In the case of the partial display control for reducing the power consumption accompanying the drive of the non-display area by driving only the display area, therefore, the memory capacity can be drastically reduced to achieve a low power consumption with the simple configuration, as compared with the case in which the display area is set at the pixel unit.

The display control circuit may further comprise: a band-partial-display control data holding section which holds band-partial-display control data used to set the display area or the non-display area in units of line blocks each of which includes a plurality of the scan lines; and a mode switching section which performs switching between a first mode and a second mode, wherein the display area or the non-display area is specified in units of the area blocks for the scan drive circuit and the signal drive circuit on the basis of the area-block-display control data, in the first mode; and wherein the display area or the non-display area is specified in units of the line blocks for the scan drive circuit on the basis of the band-partial-display control data, in the second mode.

According to this embodiment, the display control circuit further comprises the band-partial-display control data holding section, and the display area or the non-display area is specified in units of the line blocks of the scan lines. It is, therefore, possible to make the partial display control in which there is reduced the memory capacity necessary for the partial display control in the scan line direction.

According to one embodiment of the present invention, there is provided a display control circuit which controls display of an electro-optical device having pixels specified by 1st to N-th scan lines (N is a natural number) and 1st to M-th signal lines (M is a natural number) intersecting each other, the display control circuit further comprising:

a band-partial-display control data holding section which holds band-partial-display control data used to set a display area or a non-display area in units of area blocks each of which includes a plurality of the scan lines; and a scan drive circuit setting section which sets the display area or the non-display area in units of the area blocks on the basis of the band-partial-display control data, for a scan drive circuit which performs scan-driving of the 1st to N-th scan lines.

According to this embodiment, the display control circuit further comprises the band-partial-display control data holding section, and the display area or the non-display area is specified in units of area blocks of the scan lines on the basis of the band-partial-display control data. It is, therefore, possible to reduce the memory capacity necessary for the partial display control in the scan line direction thereby to simplify the settings of the display area and the non-display area for a lower power consumption.

In the display control circuit, the scan drive circuit may be controlled such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a given reference frame.

Here, the odd frame period of three or more frames from the reference frame sets the third frame, the fifth frame, and the (2k+1)-th (k: a natural number) frame when the reference frame is the 0th frame.

From the view point of the lower power consumption, the frame period for which the non-display scan lines are scanned and driven is the more desirable for the longer.

According to this embodiment, the display area is scanned and driven for every frame periods, but the non-display area is scanned and driven for the odd frame period of three or more periods. It is, therefore, possible to correspond to the polarity inverted drive method and to prevent the troubles due to the leakage of the TFT thereby to reduce the power consumption by reducing the unnecessary scan drive.

According to one embodiment of the present invention, there is provided a display control circuit which controls display of an electro-optical device having pixels specified by 1st to N-th scan lines (N is a natural number) and 1st to M-th signal lines (M is a natural number) intersecting each other, the display control circuit comprising:

a setting section which sets a display area or a non-display area for a scan drive circuit which performs scan-driving of the 1st to N-th scan lines; and a control section which controls the scan drive circuit such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a given reference frame.

In the case of the partial display control, according to this embodiment, the display area is scanned and driven for every frame periods, but the non-display area is scanned and driven for the odd frame period of three or more periods. While corresponding to the polarity inverted drive method, therefore, the troubles due to the leakage of the TFT can be prevented to reduce the power consumption by reducing the unnecessary scan drive.

In the display control circuit, the reference frame may be next to a frame in which a given display control event has occurred.

Upon the occurrence of the display control event, according to this embodiment, the foregoing display area or non-display area can be changed to avoid such a reduction in the display quality that the non-display area gets dark for a moment.

In the display control circuit, the scan drive circuit may be controlled such that scan-driving is performed on the non-display scan line in the frame in which the display control event has occurred, for at least one scan period after the occurrence of the display control event.

According to this embodiment, at the frame where the display control event has occurred, the non-display scan lines are scanned and driven for at least one scan period at or after the occurring timing, so that the degradation in the display quality accompanying the occurrence of the event can be unnoticed.

In the display control circuit, the display control event may occur on the basis of at least one of the generation, extinguishment, movement and size change of the display area or the non-display area.

According to this embodiment, it is possible to prevent the degradation in the display quality due to the generation, extinguishment, movement and size change of the window.

According to one embodiment of the present invention, there is provided an electro-optical device comprising: pixels specified by 1st to N-th scan lines (N is a natural number) and 1st to M-th signal lines (M is a natural number) intersecting each other; a scan drive circuit which performs scan-driving of the 1st to N-th scan lines; a signal drive circuit which drives the 1st to M-th signal lines on the basis of image data; and any of the above-described display control circuits.

According to this embodiment, it is possible to provide an electro-optical device which can reduce the memory capacity accompanying the partial display control capable of realizing the low power consumption and which can simplify the specification of the display area or the non-display area. It is, therefore, possible to realize a low cost for the electro-optical device of the low power consumption.

In the electro-optical device, the signal drive circuit may include:

a block output select data holding section which holds block output select data used to instruct whether or not signal-driving is performed in units of line blocks each of which includes a plurality of the signal lines;

a partial display data holding section which holds partial display data used to set a display area or a non-display area in units of line blocks each of which includes a plurality of the signal lines; and a signal line drive section which makes an output to a signal line in a line block instructed not to perform signal-driving by the block output select data into the high impedance state, performs one of signal-driving based on image data and provision of a given non-display level voltage, on the basis of the partial display data, for a signal line in a line block instructed to perform signal-driving by the block output select data, and the display control circuit may include:

a block output select data setting section which sets the block output select data in the block output select data holding section of the signal drive circuit;

a partial display data conversion section which converts first partial display data which sets the display area or the non-display area in units of the line blocks, into second partial display data which is obtained by shifting data in a P-th block (P is a natural number) of the first partial display data to data in a (P+1)-th block, when the P-th block set as the display area is instructed not to perform signal-driving by the block output select data; and a partial display data setting section which sets the second partial display data in the partial display data holding section of the signal drive circuit.

In the signal drive circuit in this embodiment, the display control circuit is provided with the partial display data conversion section, in case the output to the signal lines of the designated line block is set to the high impedance state so that the signal drive may not be done with the block output select data in units of the line blocks, and the signal drive corresponding to the image data or the supply of a given non-display level voltage is done on the basis of the partial display data for the signal line of the designated line block to be driven. In this partial display conversion unit, in the first partial display data for designate the display area or the non-display area in units of the line blocks, when the P-th block in the display area is designated as the block not to be driven by the block output select data, the first partial display data are converted to the second partial display data in which the data of the P-th block are shifted as the data of the (P+1)-th block.

Thus, in addition to the effect that it is possible to provide the signal drive circuit capable of easily corresponding the change in the panel size of the display pane by the block output select data, when the first partial display data are designated according to the image data, it is unnecessary to consider the set value of the block output select data, and it is possible to improve the usability of the user, for example The electro-optical device may further comprise:

an image data generation section which generates second image data obtained by shifting image data in the P-th block of first image data supplied to the signal drive circuit as image data in (P+1)-th block, when the P-th block set as the display area by the first partial display data which sets the display area or the non-display area in units of line blocks each of which includes a plurality of the signal lines; and an image data providing section which provides the second image data to the signal drive circuit.

This embodiment is provided with the image data generation section. The second image data shifted are generated as image data of the (P+1)-th block from such ones of first image data supplied to the signal drive circuit as correspond to the P-th block, when the P-th block designated by the display area is designated as a block not to be driven by the block output select data, by the 1st partial display data in units of line blocks, and the 2nd image data are supplied to the signal drive circuit. As a result, by the block output select data, for the signal drive circuit capable of easily corresponding to the change in the panel size of the display panel, the 2nd image data can be supplied to only the signal lines of the line blocks designated as the line blocks to be driven. It is, therefore, unnecessary for the image creating side such as the user to consider the set value of the block output select data.

According to one embodiment of the present invention, there is provided a display device comprising: an electro-optical device having pixels specified by 1st to N-th scan lines (N is a natural number) and 1st to M-th signal lines (M is a natural number) intersecting each other; a scan drive circuit which performs scan-driving of the 1st to N-th scan lines; a signal drive circuit which drives the 1st to M-th signal lines on the basis of image data; and the above-described display control circuit.

According to this embodiment, it is possible to provide a display device which can reduce the memory capacity accompanying the partial display control capable of realizing the low power consumption and which can simplify the designations of the display area or the non-display area. Therefore, it is possible to reduce the cost for the display device for reducing the power consumption.

According to one embodiment of the present invention, there is provided a display control method of controlling display of an electro-optical device having pixels specified by 1st to N-th scan lines (N is a natural number) and 1st to M-th signal lines (M is a natural number) intersecting each other, the method comprising:

storing area-block-display control data used to set a display area or a non-display area in units of area blocks each of which includes a plurality of the signal lines and a plurality of the scan lines; and setting the display area or the non-display area in units of the area blocks on the basis of the area-block-display control data, for a scan drive circuit which performs scan-driving of the 1st to N-th scan lines and for a signal drive circuit which drives the 1st to M-th signal lines.

According to this embodiment, on the basis of the area-block-display control data for designating the display area or the non-display area in units of area blocks, the display area or the non-display area can be set individually in units of the line blocks in the signal drive circuit or the scan drive circuit. In case the partial display control capable of reducing the power consumption accompanying the drive of the non-display area is made by driving only the display area, the memory capacity can be drastically reduce to lower the power consumption with the simple configuration, as compared with the case in which the display area is set at the pixel unit.

According to one embodiment of the present invention, there is provided a display control method of controlling display of an electro-optical device having pixels specified by 1st to N-th scan lines (N is a natural number) and 1st to M-th signal lines (M is a natural number) intersecting each other, the method comprising:

holding band-partial-display control data used to set a display area or a non-display area in units of line blocks each of which includes a plurality of the scan lines; and setting the display area or the non-display area in units of the line blocks on the basis of the band-partial-display control data, for a scan drive circuit which performs scan-driving of the 1st to N-th scan lines.

According to this embodiment, on the basis of the band-partial-display control data, the scan lines are specified in units of area blocks in the display area or the non-display area. It is, therefore, possible to reduce the memory capacity necessary for the partial display control in the scan line direction thereby to simplify the setting of the display area and the non-display area at the low power consumption.

According to one embodiment of the present invention, there is provided a display control method of controlling display of an electro-optical device having pixels specified by 1st to N-th scan lines (N is a natural number) and 1st to M-th signal lines (M is a natural number) intersecting each other, the method comprising:

specifying a display area or a non-display area for a signal drive circuit in units of line blocks each of which includes a plurality of the signal lines and for a scan drive circuit in units of line blocks each of which includes a plurality of the scan lines, the signal drive circuit driving 1st to M-th signal lines, and the scan drive circuit performing scan-driving on 1st to N-th scan lines; and providing image data corresponding to the display area to the signal circuit.

According to this embodiment, for the signal drive circuit and the scan drive circuit, in units of the line blocks divided individually for the lines, the display area or the non-display area is set. After this, the display drive control is made by supplying the image data for displaying the display area. It is, therefore, possible to make the partial display control for reducing the power consumption accompanying the signal drive of the non-display area.

In the display control method, scan-driving may be performed on the basis of the image data; a given non-display level voltage may be applied to a signal line in a line block set as the non-display area, and signal-driving may be performed on a signal line in a line block set as the display area with a drive voltage corresponding to the image data; and scan-driving may be performed on a scan line in a line block set as the display area for every frame period, and also scan-driving may be performed on a scan lines in a line block set as the non-display area for every three or more odd frame periods from a given reference frame.

According to this embodiment, the scan lines of the line block set in the non-display area are scanned and driven for the odd frame period of three or more frames. In case the liquid crystal panel using the TFT is used as the electro-optical device, for example, the display control method capable of making the high image quality and the low power consumption compatible can be provided by solving the problem that the high power consumption makes the dynamic partial display impossible due to the leakage of the TFT.

According to one embodiment of the present invention, there is provided a display control method of controlling display of an electro-optical device having pixels specified by 1st to N-th scan lines (N is a natural number) and 1st to M-th signal lines (M is a natural number) intersecting each other, wherein a display area or a non-display area is set an area of the pixels; and wherein scan-driving is performed on a display scan line which is at least part of the 1st to N-th scan lines corresponding to the display area, for every frame period, and scan-driving is also performed on a non-display scan line which is at least part of the 1st to N-th scan lines except the display scan line, for every three or more odd frame periods from a given reference frame.

According to this embodiment, in the case of the partial display control, the display area is scanned and driven for every frame periods, but the non-display area is scanned and driven for the odd frame period of three or more frames. While corresponding to the polarity inverted drive method, therefore, the troubles due to the leakage of the TFT can be prevented to lower the power consumption by reducing the unnecessary scan drive.

In the display control method, the reference frame may be next to a frame in which a given display control event has occurred.

According to the present embodiment, the foregoing the display area or non-display area is changed by the occurrence of the display control event so that the degradation of the display quality such as an instant dark change of the non-display area can be avoided.

In the display control method, scan-driving may be performed on the non-display scan line in the frame in which the display control event has occurred, for at least one scan period after the occurrence of the display control event.

According to this embodiment, in the frame at which the display control event has occurred, the non-display scan lines are scanned and driven for at least one scan period at and after the timing of that occurrence. It is, therefore, possible to the reduction of the display quality unnoticed, as might otherwise be caused by the occurrence of that event.

In the display control method the display control event may occur on the basis of at least one of the generation, extinguishment, movement and size change of the display area or the non-display area.

According to this embodiment, it is possible to prevent the degradation of the display quality which might otherwise be caused by any of the generation, extinguishment, movement and size change.

A preferred embodiment will be described in detail with reference to the accompanying drawings.

1. Display Device 1.1 Configuration of Display Device

FIG. 1 shows a schematic configuration of a display device, to which a signal drive circuit (or an LCD controller or a display controller) of this embodiment is applied.

A liquid crystal device 10 as a display device includes: a liquid crystal display (as will be abbreviated into the "LCD") panel 20; a signal driver (or a signal driving circuit) (or a source driver in a narrow sense) 30, a scan driver (or a scan drive circuit (or a gate driver in a narrow sense) 50, and an LCD controller 60 and a power circuit 80.

The LCD panel (or an electro-optical device in a wide sense) 20 is formed over a glass substrate, for example. Over this glass substrate, there are arranged: a plurality of scan lines (or gate lines in a narrow sense) $G_1$ to $G_N$ (where N indicates a natural number of 2 or more) arrayed in a Y-direction and extending individually in an X-direction; and a plurality of signal lines (or source lines in a narrow sense) $S_1$ to $S_M$ (where M indicates a natural number of 2 or more) arrayed in the X-direction and extending individually in the Y-direction. At the cross point between the scan line $G_n$ ($1 \leqq n \leqq N$, n indicates a natural number) and the signal line Sm ($1 \leqq m \leqq M$, m indicates a natural number), moreover, there is disposed a TFT $\mathbf{22}_{nm}$ (or a switching unit in a wide sense).

The gate electrode of the TFT $\mathbf{22}_{nm}$ is connected with the scan line $G_n$. The source electrode of the TFT $\mathbf{22}_{nm}$ is connected with the scan line Gn. The drain electrode of the TFT $\mathbf{22}_{nm}$ is connected with a pixel electrode $\mathbf{26}_{nm}$ of a pixel electrode $\mathbf{26}_{nm}$ of a liquid crystal capacitor (or a liquid crystal element in a wide sense) $\mathbf{24}_{nm}$.

In the liquid crystal capacitor $\mathbf{24}_{nm}$, a liquid crystal is sealed between the pixel electrode $\mathbf{26}_{nm}$ and a common electrode $\mathbf{28}_{nm}$ so that the transmission factor of the pixel is changed according to the voltage applied between those electrodes.

To the common electrode $\mathbf{28}_{nm}$, there is supplied a common electrode voltage Vcom which is generated by the power circuit 80.

The signal driver 30 is based on the image data at one horizontal scan unit, to drive the signal lines $S_1$ to $S_M$ of the LCD panel 20.

The scan driver 50 is synchronized with a horizontal synchronizing signal for one vertical scan period, to scan and drive the scan lines $G_1$ to $G_N$ of the LCD panel 20 sequentially.

In accordance with the contents which are set by a host such as a not-shown central processing unit (as will be abbreviated into the "CPU"), the LCD controller 60 controls the signal driver 30, the scan driver 50 and the power circuit 80. More specifically, the LCD controller 60 sets the action mode or supplies a vertical synchronizing signal or the horizontal synchronizing signal it produces, for the signal driver 30 and the scan driver 50, and supplies the polarity inverting timing of the common electrode voltage Vcom to the power circuit 80.

The power circuit 80 is based on the reference voltage supplied from the outside, to generate the voltage level necessary or the common electrode voltage Vcom for driving the liquid crystal of the LCD panel 20. The various voltage levels necessary for driving the liquid crystals of the LCD panel 20 are supplied to the signal driver 30, the scan driver 50 and the LCD panel 20. Moreover, the common electrode voltage Vcom is supplied to the common electrode which is opposed to the pixel electrodes of the TFTs of the LCD panel 20.

The liquid crystal device 10 thus constructed is controlled by the LCD controller 60 and based on the image data supplied from the outside, to drive the display of the LCD panel 20 in association with the signal driver 30, the scan driver 50 and the power circuit 80.

Here in FIG. 1, the liquid crystal device 10 is constructed to include the LCD controller 60 but may also be constructed by disposing the LCD controller 60 outside of the liquid crystal device 10. Alternatively, the liquid crystal device 10 can also be constructed to include a host together with the LCD controller 60.

In FIG. 1, moreover, there are disposed outside of the LCD panel 20 the signal driver 30 and the scan driver 50, at least one of which may be formed over the same glass substrate as that of the LCD panel 20.

1.2 Signal Driver

Figure 2:
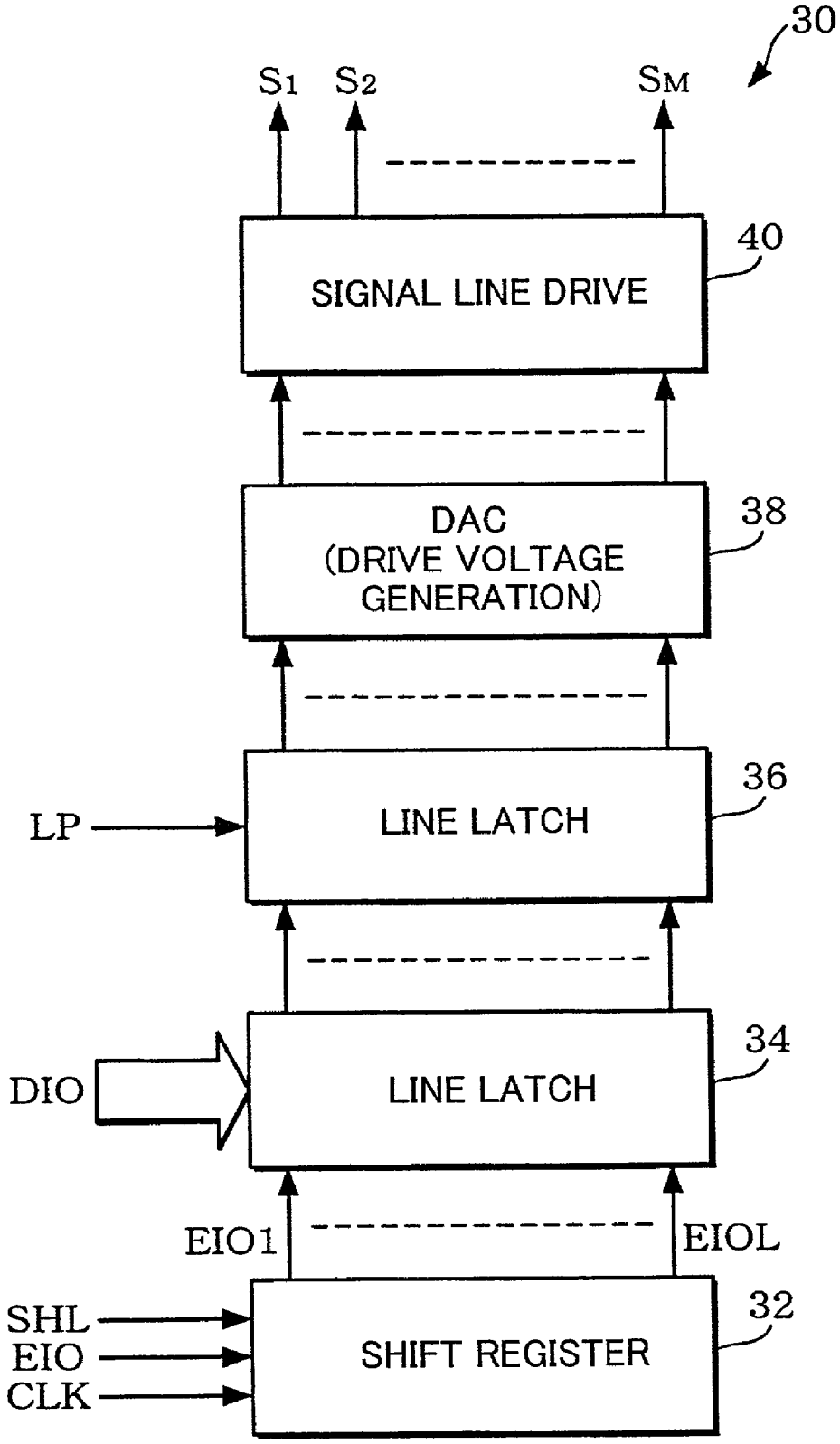
FIG. 2 is a block diagram schematically showing the configuration of a signal driver shown in FIG. 1.

FIG. 2 shows a schematic configuration of the signal driver shown in FIG. 1.

The signal driver 30 includes a shift register 32, line latches 34 and 36, a digital/analog converter circuit (or a drive voltage generation circuit in a wide sense) 38, and a signal line drive circuit 40.

The shift register 32 is provided with a plurality of flip-flops, which are sequentially connected. This shift register 32 shifts, when it holds an enable input/output signal EIO in synchronism with a clock signal CLK, the enable input/output signal EIO to the adjoining flip-flops sequentially in synchronism with the clock signal CLK.

Moreover, this shift register 32 is supplied with a shift direction switching signal SHL. In response to the shift direction switching signal SHL, the shift register 32 is switched between the shift direction of image data (DIO) and the input/output direction of the enable input/output signal EIO. By switching the shift direction in response to the shift direction switching signal SHL, therefore, even if position of the LCD controller 60 for supplying the image data to the signal driver 30 is different according to the packaged state of the signal driver 30, a soft packaging can be made without increasing its area by designing its wiring lines.

The line latch 34 is supplied with the image data (DIO) in units of 18 bits (i.e., 6 bits (of gradation data)×3 (of individual RGB colors)), for example, from the LCD controller 60. The line latch 34 latches the image data (DIO) in synchronism with the enable input/output signal EIO shifted sequentially by the individual flip-flops of the shift register 32.

In synchronism with a horizontal synchronizing signal LP supplied from the LCD controller 60, the line latch 36 latches the image data of one horizontal scan unit, as latched by the line latch 34.

The DAC 38 generates, for each signal line, the drive voltage which was made analog on the basis of the image data.

On the basis of the drive voltage generated by the DAC 38, the signal line drive circuit 40 drives the signal lines.

This signal driver 30 fetches the image data sequentially in given units (e.g., in units of 18 bits), as sequentially inputted from the LCD controller 60, and the line latch 36 latches the image data at one horizontal scan unit in synchronism with the horizontal synchronizing signal LP. On the basis of these signals, moreover, the individual signal lines are driven. As a result, the source electrodes of the TFTs of the LCD panel 20 are supplied with the drive voltages based on the image data.

Figure 3:
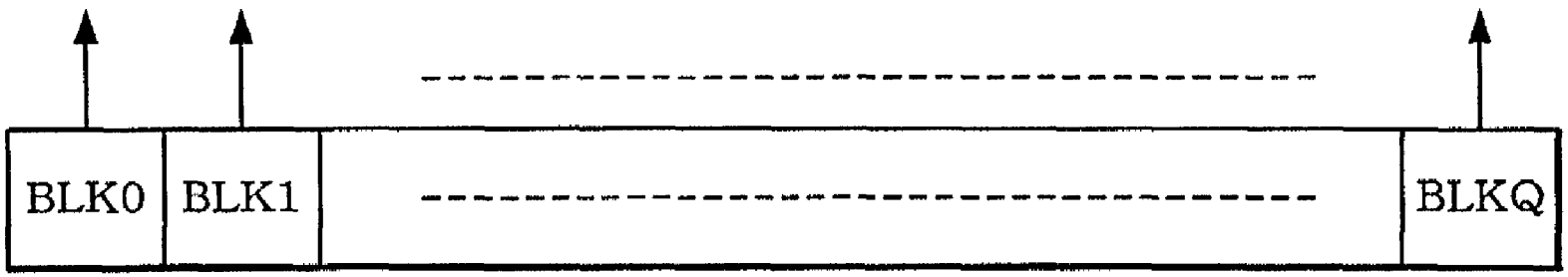
FIG. 3 is an explanatory diagram schematically showing the configuration of a block output select register.

This signal driver 30 can control its output in a high impedance control in units of line blocks which is divided for a given number of signal lines. Therefore, the signal driver 30 has a block output select register (or a block output select data holding section), as shown in FIG. 3, and holds block output select data (or control instruct data in a wide sense) BLK0 to BLKQ for setting whether or not the output of the signal lien drive circuit for driving the signal lines of each block in units of the line blocks is to be subjected to the high-impedance control.

In this block output select data, the signal line of the line block, as set ON ("1"), is driven by the signal line drive circuit, and the signal line of the block, as set OFF ("0"), comes into the high impedance state. As a result, the signal line drive circuit, as connected with the signal line of the LCD panel 20, can be arbitrarily selected in units of the line blocks so that the size change in the LCD panel 20 can be easily coped with. Moreover, there is reduced the current consumption which accompanies the impedance conversion made in signal line drive circuit requiring no drive.

Figure 4:
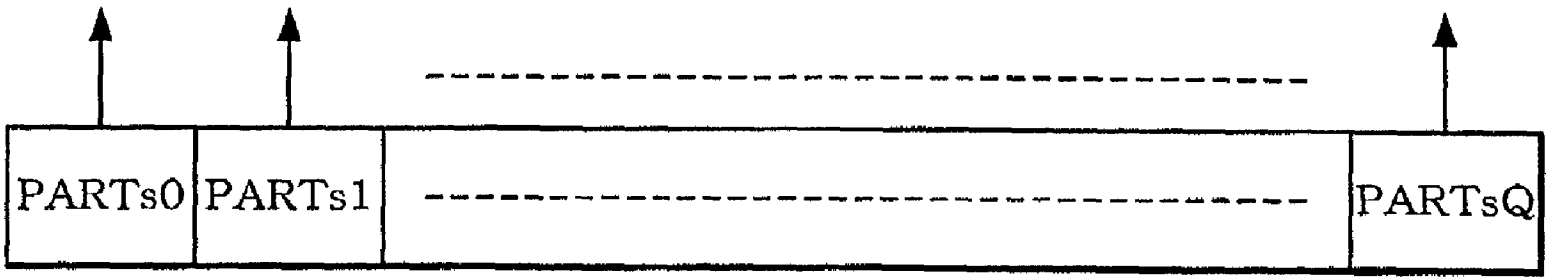
FIG. 4 is an explanatory diagram schematically showing the configuration of a partial display select register.

On the other hand, the signal driver 30 can set the display area or the non-display area at that line block unit. Therefore, the signal driver 30 is provided, as shown in FIG. 4, with a partial display select register (or a partial display data holding section) for holding partial display data (or control instruction data in a wide sense) $PART_S$0 to $PART_S$Q for setting whether or not the signal lines of the individual blocks in units of the line blocks are to be driven on the basis of the image data.

In these partial display data, the signal drive is done for the signal line of the line block, as set ON ("1"), on the basis of the image data as the display area, and a given non-display level voltage is supplied as the non-display area to the signal line of the block, as set OFF ("0"). Therefore, it is possible to reduce the current consumption of the operation amplifier circuit as the impedance conversion unit for driving the signal lines of the non-display area and accordingly to reduce the consumption of the LCD panel using the TFTs of a high image quality. Simultaneously with this, the liquid crystal capacitor to be connected through the TFTs with the signal lines supplied with the non-display level voltage is supplied with a voltage proper for the non-display.

Moreover, the signal driver 30 is given eight pixel units or the aforementioned control section. Here, one pixel is composed of three bits of RGB signals. Therefore, the signal driver 30 has one line block of totally twenty four outputs (e.g., $S_1$ to $S_{24}$). As a result, the display area of the LCD panel 20 can be specified in units of characters (1 byte). In an electronic device such as a mobile telephone for displaying characters, therefore, it is possible to set an efficient display area and to display its image.

Figure 5:
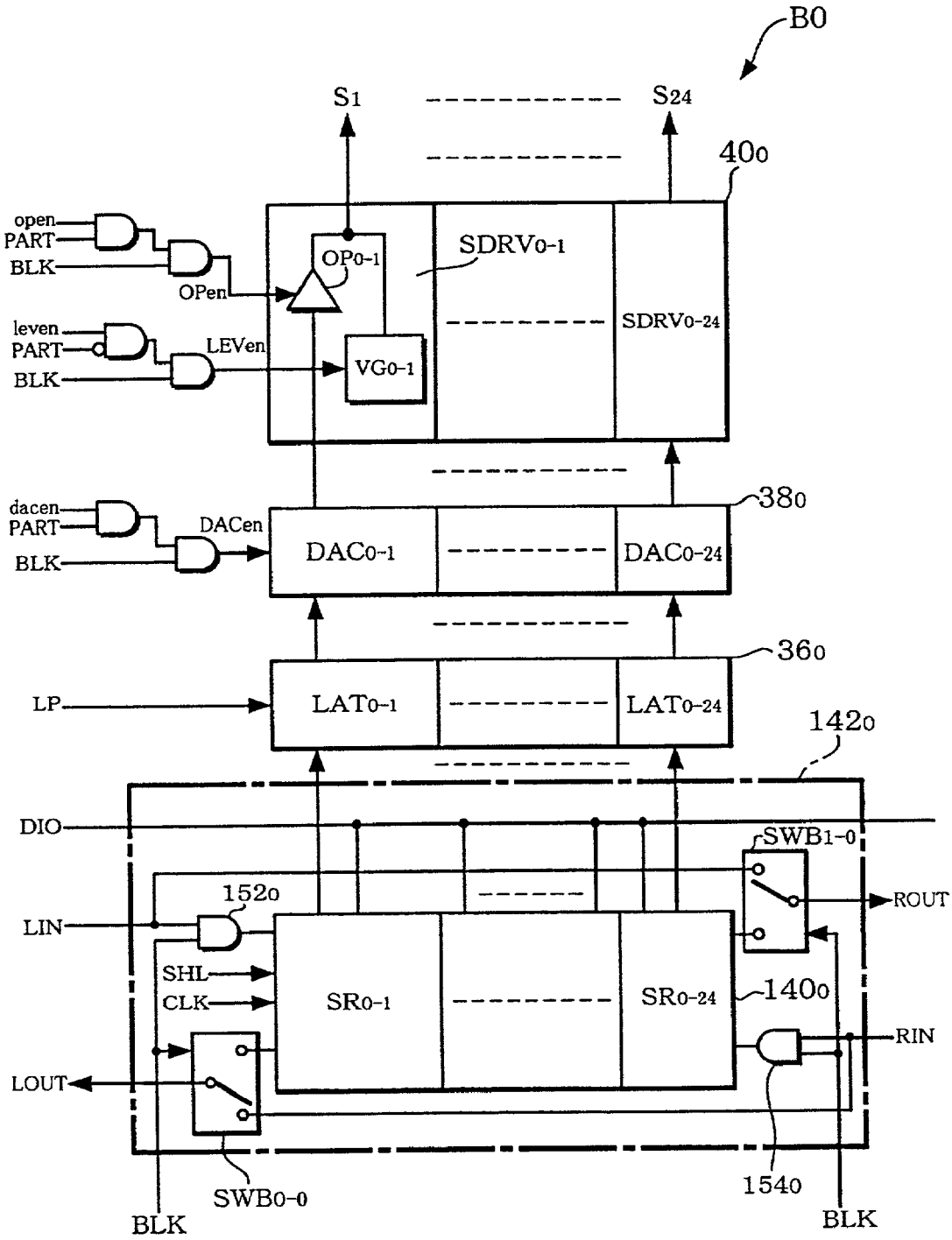
FIG. 5 is a configuration diagram schematically showing the configuration of a line block unit of the signal driver.

FIG. 5 schematically shows the configuration of the line block unit or the control section of the signal driver 30.

This signal driver 30 is assumed to have 288 signal line outputs ($S_1$ to $S_{288}$).

Specifically, the signal driver 30 is provided with the configuration shown in FIG. 5 at its 24 output terminal units ($S_1$ to $S_{24}$, $S_{25}$ to $S_{48}$, . . . and $S_{265}$ to $S_{288}$) so that it has totally 23 line blocks (B0 to B11). In the description to be made in the following, FIG. 5 shows the block B0, but the remaining blocks B1 to B11 are similar.

The block B0 of the signal driver 30 is constructed, for the individual signal lines $S_1$ to $S_{24}$, to include a data bypass circuit $\mathbf{142}_0$ having a shift register $\mathbf{140}_0$, a line latch $\mathbf{36}_0$, a drive voltage generation circuit 380 and a signal line drive circuit $\mathbf{40}_0$. Here, the shift register $\mathbf{140}_0$ has the functions of the shift register 32 and the line latch 34, as shown in FIG. 2.

The shift register $\mathbf{140}_0$ belonging to the data by pass circuit $\mathbf{142}_0$ includes the $SR_{0-1}$ to $SR_{0-24}$ for the individual signal lines. The line latch $\mathbf{36}_0$ includes the $LAT_{0-1}$ to $LAT_{0-24}$ for the individual signal lines. The drive voltage generation circuit $\mathbf{38}_0$ includes the $DAC_{0-1}$ to $DAC_{0-24}$ for the individual signal lines. The signal line drive circuit $\mathbf{40}_0$ includes the $SDRV_{0-1}$ to $SDRV_{0-24}$ for the individual signal lines.

As described above, the signal driver 30 has the block output select register and the partial display select register to set the block output select data and the partial display data individually in units of the line blocks. For example, the block B0 shown in FIG. 5 is supplied with the block output select data BLK0 shown in FIG. 3 as the BLK and the partial display data PARTS0 shown in FIG. 4 as the PART.

The data bypass circuit $\mathbf{142}_0$ fetches the image data DIO in synchronism with the enable input/output signal EIO which is shifted in an ROUT direction from an LIN and in an LOUT direction from an RIN. At this time, the data bypass circuit $\mathbf{142}_0$ includes switch circuits $SWB_{1-0}$ and $SWB_{0-0}$ for bypassing the enable input/output signal EIO shifted to the line block, when the block output select data BLK is set to "0".

The switch circuit $SWB_{1-0}$ outputs the output data of the $SR_{0-24}$ as the rightward data output signal ROUT when the block output select data BLK is at "1" (or the logic level "H"). On the other hand, the switch circuit $SWB_{1-0}$ outputs the image data (e.g., EIO in the case of the block B0) inputted as the leftward data input signal LIN and shifted from the line block, as the rightward data output signal ROUT when the block output select data BLK is at "0" (or the logic level "L").

The switch circuit $SWB_{0-0}$ outputs the output data of the $SR_{0-1}$ as the leftward data output signal LOUT when the block output select data BLK is at "1" (or the logic level "H"). On the other hand, the switch circuit $SWB_{0-0}$ outputs the image data inputted as the rightward data input signal RIN and shifted from the line block, as the leftward data output signal LOUT when the block output select data BLK is at "0" (or the logic level "L").

The $SR_{0-1}$ to $SR_{0-24}$ corresponding to the signal lines $S_1$ to $S_{24}$ shift the enable input/output signal EIO supplied as the LIN or the RIN, and fetch the image data DIO in synchronism with the enable input/output signal EIO shifted.

Figure 6:
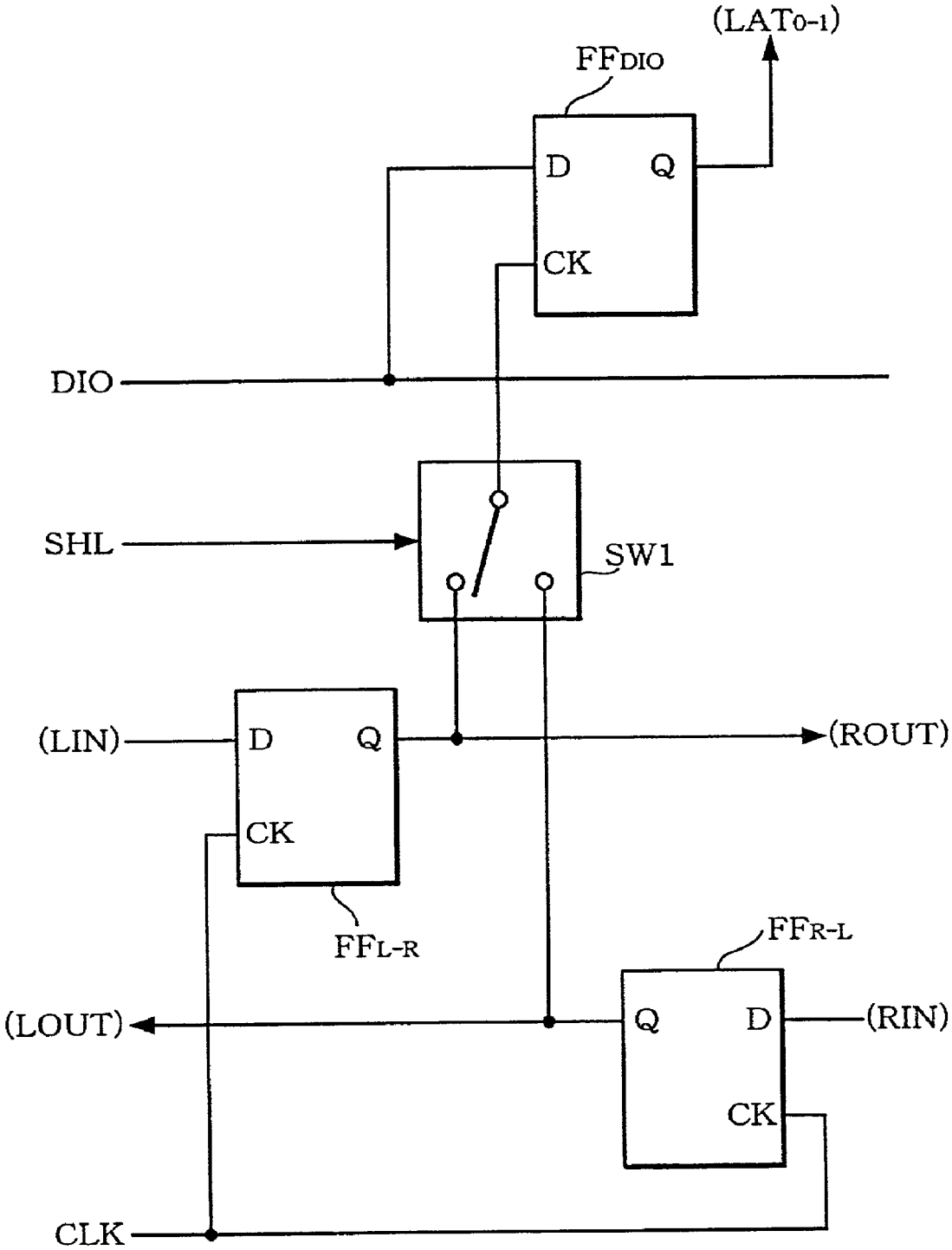
FIG. 6 is a configuration diagram schematically showing the configuration of one example of the configuration of an SR constructing a shift register of the signal driver.

FIG. 6 schematically shows the configuration of the $SR_{0-1}$ composing the shift register $\mathbf{140}_0$.

Here is shown the configuration of the $SR_{0-1}$, but the remaining $SR_{0-2}$ to $SR_{0-24}$ can also be likewise constructed.

The $SR_{0-1}$ includes $FF_{L-R}$, $FF_{R-L}$, $FF_{DIO}$ and SW1.

The $FF_{L-R}$ latches the enable input/output signal EIO, for example, as the leftward data input signal LIN inputted to the D-terminal, in synchronism with the rising edge of the clock signal inputted to the CK-terminal, and supplies the leftward data input signal LIN as the rightward data output signal ROUT from the Q-terminal to the D-terminal of the $SR_{0-2}$.

The $FF_{R-L}$ latches the enable input/output signal EIO, for example, as the rightward data input signal RIN inputted to the D-terminal, in synchronism with the rising edge of the clock signal inputted to the CK-terminal, and outputs the leftward data output signal LOUT from the Q-terminal.

The rightward data output signal ROUT outputted from the Q-terminal of the $FF_{L-R}$ is supplied to the SW1. The leftward output signal LOUT outputted from the Q-terminal of the $FF_{R-L}$ is also supplied to the SW1.

In response to the shift direction switching signal SHL, the SW1 selects either the rightward data output signal ROUT or the leftward output signal LOUT, and supplies the selected one to the CK-terminal of the $FF_{DIO}$.

In synchronism with the selected output signal of the SW1 supplied to the CK-terminal, the $FF_{DIO}$ latches the image data DIO. The image data latched are outputted from the $LAT_{0-1}$ of the line latch $\mathbf{36}_0$.

Thus, the image data held in the individual $SR_{0-1}$ to $SR_{0-24}$ of the shift transistor $\mathbf{140}_0$ are latched in the individual $LAT_{0-1}$ to $LAT_{0-24}$ of the line latch $\mathbf{36}_0$ in synchronism with the horizontal synchronizing signal LP.

Line Latch

The image data latched in the line latches $LAT_{0-1}$ to $LAT_{0-24}$ and corresponding to the signal lines S1 to S24 are supplied to the $DAC_{0-1}$ to $DAC_{0-24}$ of the drive voltage generation circuit.

Drive Voltage Generation Circuit

When a DAC enable signal DACen is at the logic level "H", the $DAC_{0-1}$ to $DAC_{0-24}$ generate gradation levels of 64 levels on the basis of the gradation data of 6 bits, for example, supplied from the corresponding $LAT_{0-1}$ to $LAT_{0-24}$.

The DAC enable signal DACen is generated as the AND operation between an enable signal dacen0 and the block output select data BLK. This enable signal dacen0 is generated as the AND operation of the DAC control signal dacen generated by the not-shown control signal of the signal driver 30 and the partial display data PART.

When the block output select data BLK are "0", the DAC enable signal DACen interrupts the action of the drive voltage generation circuit $\mathbf{38}_0$ of the BLK0 independently of the set value of the partial display data PART. When the block output select data BLK is at "1", on the other hand, the DAC action is done only in the setting case as the partial display area, but the DAC action is interrupted to reduce the consumption of the current to flow through a ladder resister in the setting case as the partial non-display area.

Here, this DAC enable signal DACen is likewise supplied to the $DAC_{0-2}$ to $DAC_{0-24}$ corresponding to the remaining signal lines $S_2$ to $S_{24}$ so that the action controls of the DAC are made in units of the line blocks.

Signal Line Drive Circuit

The $SDRV_{0-1}$ $SDRV_{0-24}$ of the signal line drive circuit $\mathbf{40}_0$ include a voltage-follower connected operation amplifiers $OP_{0-1}$ to $OP_{0-24}$ as the impedance conversion unit, and partial non-display level voltage supply circuits $VG_{0-1}$ to $VG_{0-24}$.

The voltage-follower connected operation amplifiers $OP_{0-1}$ to $OP_{0-24}$ are negatively supplied back at their output terminal and have a remarkably high input impedance so that the input current hardly flows. When the operation amplifier enable signal OPen is at the logic level "H", moreover, the drive voltages generated by the $DAC_{0-1}$ to $DAC_{0-24}$ are subjected to an impedance conversion to drive the signal lines $S_1$ to $S_{24}$. As a result, the signal drive can be made independently of the output loads of the signal lines $S_1$ to $S_{24}$.

The operation amplifier enable signal OPen is generated by the AND operation between an operation amplifier control signal open0 and the block output select data BLK. This enable signal open 0 is generated as the AND operation between the operation control signal open generated by the not-shown control circuit of the signal driver 30 and the partial display data PART.

When the block output select data BLK is at "0", more specifically, the operation amplifier enable signal OPen interrupts the operation amplifier of the BLK0 independently of the set value of the partial display data PART (i.e., interrupts the current source of the operation amplifier to reduce the current consumption). When the block output select data BLK is at "1", on the other hand, the drive voltage generated by the drive voltage generation circuit is subjected to the impedance conversion to drive the corresponding signal line, only in the setting case as the partial display area, but the action of the operation amplifier is interrupted to reduce the current consumption in the setting case as the partial non-display area.

Partial Non-display Level Voltage Supply Circuit

In case a non-display level voltage supply enable signal LEVen at the logic level "H", the partial non-display level voltage supply circuits $VG_{0-1}$ to $VG_{0-24}$ generate a given non-display level voltage $V_{PART-LEVEL}$ to be supplied to the individual signal lines, if the non-display area (for the OFF output) is set in the aforementioned partial display select register.

Here, the non-display level voltage $V_{PART-LEVEL}$ has a following relation (1) to a given threshold value $V_{CL}$ for the pixel transmission factor to change and the common electrode voltage Vcom of the common electrode opposed to the pixel electrode:

$$|V_{PART-LEVEL}-V\mathrm{com}|<V_{CL} \quad (1)$$

Specifically, the non-display level voltage $V_{PART-LEVEL}$ takes such a voltage level that the applied voltage of the liquid crystal capacitor does not exceed the threshold value $V_{CL}$, when it is applied to the pixel electrode which is connected with the drain electrode of the TFT connected with the signal line to be driven.

Here, this non-display level voltage $V_{PART-LEVEL}$ is desired to have a voltage level equivalent to that of the common electrode voltage Vcom, because of easy generation and control of the voltage level. When a voltage level equivalent to that of the common electrode voltage Vcom is supplied, the color for the OFF liquid crystal is displayed in the non-display area of the LCD panel 20.

Moreover, the non-display level supply circuits $VG_{0-1}$ to $VG_{0-24}$ can select and output either of the voltage levels V0 and V8 at the two ends of the gradation level voltage as the non-display level voltage $V_{PART-LEVEL}$. Here, the voltage level V0 or V8 at the two ends of the gradation voltage level is outputted alternately for every frames by the inverted drive method. In accordance with a select signal SEL from the user, the aforementioned common electrode voltage Vcom or the voltage level V0 or V8 at the two ends of the gradation level voltage can be selected as the non-display level voltage $V_{PART\text{-}LEVEL}$. As a result, the user can enhance the degree of freedom for selecting the color of the non-display area.

The non-display level voltage supply enable signal LEVen is generated as the AND operation between a non-display level voltage supply circuit control signal leven generated by the not-shown control circuit of the signal driver 30 and the inversion of the partial display data PART. Specifically, the non-display level voltage is supplied to the signal lines only in case the non-display area (for the OFF output) is set. In case the display area (for the ON output) is set, the outputs of the non-display level voltage supply circuits $VG_{0\text{-}1}$ to $VG_{0\text{-}24}$ take the high impedance state so that the signal lines are not driven.

Here, the operation amplifier enable signal OPen and the non-display level voltage supply enable signal LEVen are also supplied to the $SDRV_{0\text{-}2}$ to $SDRV_{0\text{-}24}$ corresponding to the remaining signal lines $S_2$ to $S_{24}$ so that the drive control of the signal lines is made at the block unit.

1.3 Scan Driver

Figure 7:
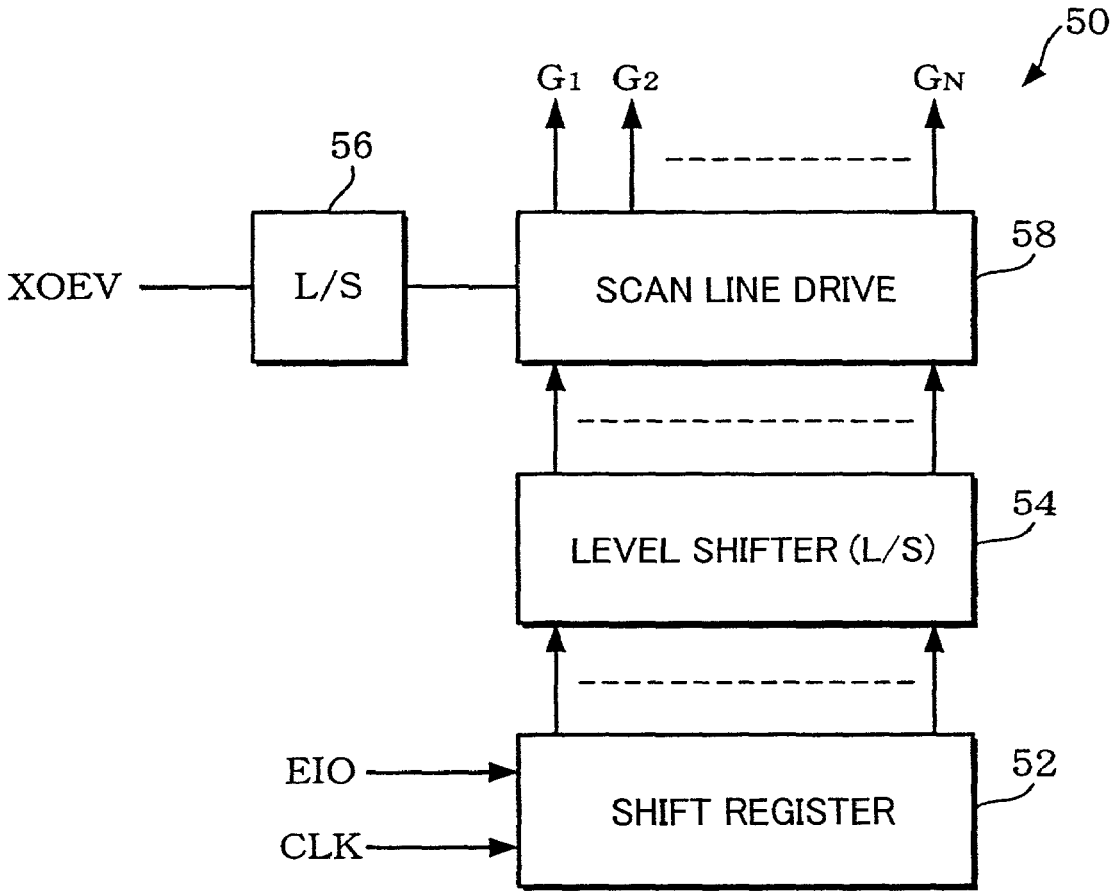
FIG. 7 is a block diagram schematically showing the configuration of the scan driver shown in FIG. 1.

FIG. 7 shows a schematic configuration of the scan driver shown in FIG. 1.

The scan driver 50 includes a shift register 52, level shifters (as will be abbreviated into the "L/S") 54 and 56, and a scan line drive circuit 58.

With the shift register 52, there are sequentially connected the flip-flops which are provided to correspond to the individual scan lines. When the scan enable input/output signal GEIO is held in the flip-flops in synchronism with the clock signal CLK, the shift register 52 shifts the scan enable input/output signal GEIO to the adjoining flip-flops sequentially in synchronism with the clock signal CLK. The scan enable input/output signal GEIO thus inputted is the vertical synchronizing signal supplied from the LCD controller 60.

The L/S 54 makes shift to a voltage level according to the liquid crystal material of the LCD panel 20. This voltage level has to be as high as 20 to 50 V, for example, so that a high breakdown process used is different from that of another logic circuit unit.

The scan line drive circuit 58 makes a CMOS drive on the basis of the drive voltage shifted by the L/S 54. Moreover, this scan driver 50 has the L/S for performing the voltage shift of an output enable signal XOEV supplied from the LCD controller 60. The scan line drive circuit 58 is turned ON/OFF in response to the output enable signal XOEV shifted by the L/S 56.

In this scan driver 50, the scan enable input/output signal GEIO inputted as the vertical synchronizing signal is shifted sequentially to the individual flip-flops of the shift register 52 in synchronism with the clock signal CLK. The individual flip-flops of the shift register 52 are provided to correspond to the individual scan lines so that these scan lines are sequentially selected alternatively with the pulses of the vertical synchronizing signals latched in the individual flip-flops. The scan line selected is driven by the scan line drive circuit 58 at the at the voltage level shifted by the L/S 54. As a result, the gate electrodes of the TFTs of the LCD panel 20 are provided with the scan drive voltage for one vertical scan period. At this time the drain electrodes of the TFTs of the LCD panel 20 are set at substantially equal potentials corresponding to the potential of the signal lines connected with the source electrodes.

Figure 8:
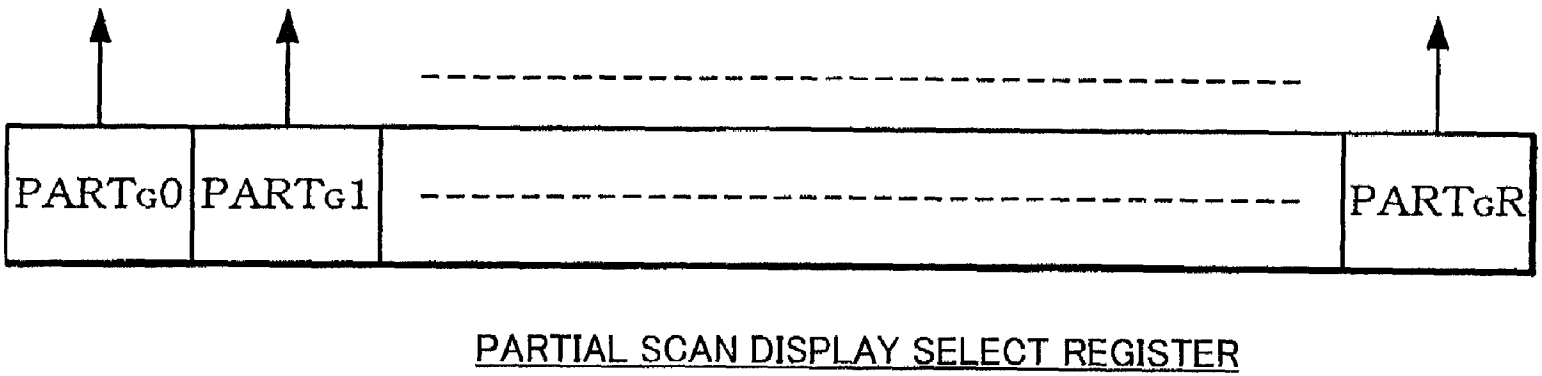
FIG. 8 is an explanatory diagram schematically showing the configuration of a partial scan display select register.

This scan driver can set the display area or the non-display area in units of the line blocks divided for a given number of scan lines. As shown in FIG. 8, therefore, the scan driver 50 has a partial scan display select register for holding partial scan display data (or control instruction data in a wide sense) $PART_G$0 to $PART_G$R for setting whether or not the scan lines of the individual line blocks are to be sequentially scanned and driven at that line block unit.

In the partial scan display data, the scan lines of the line block set ON ("1") are sequentially scanned and driven, but the scan lines of the line block set OFF ("0") are not scanned and driven. As a result, the circuit action can be stopped for the scan lines of the non-display area thereby to reduce the consumption of the LCD panel using the TFTs of high image quality.

Moreover, the scan driver 50 has a unit of eight scan lines as the line block or the aforementioned control section. As a result, the display area of the LCD panel 20 can be specified in units of characters (1 byte) thereby to set an efficient display area and its image display in an electronic device such as a mobile telephone for displaying characters.

Figure 9:
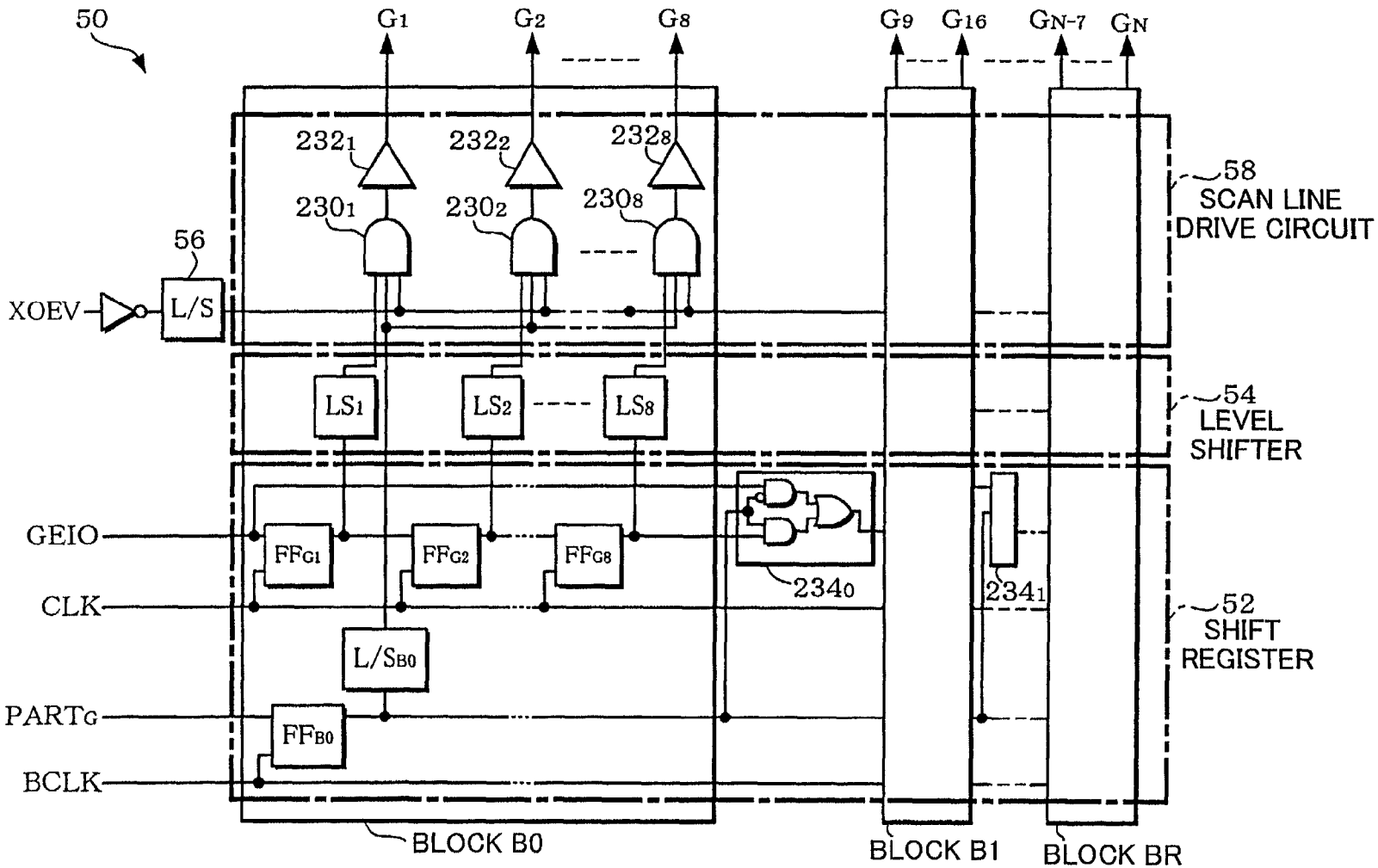
FIG. 9 is a block diagram showing an essential portion of the configuration of the scan driver.

FIG. 9 shows one example of a specific configuration of such scan driver 50.

In the shift register 52, there are connected in series $FF_{G1}$ to $FF_{GN}$ (i.e., the 1st to N-th FF) which correspond to the scan lines $G_1$ to $G_N$ (i.e., the 1st to N-th scan lines), respectively. The $FF_{G1}$ (i.e., the 1st FF) is supplied with the scan enable input/output signal GEIO from the LCD controller 60. Moreover, the $FF_{G1}$ to $FF_{GN}$ are likewise supplied with the clock signal CLK from the LCD controller 60. Therefore, the $FF_{G1}$ to $FF_{GN}$ shift the scan enable input/output signal GEIO (i.e., a given pulse signal) in synchronism with the clock signal CLK.

The scan enable input/output signal GEIO supplied from the LCD controller 60 is a vertical synchronizing signal. On the other hand, the clock signal CLK supplied from the LCD controller 60 is a horizontal synchronizing signal.

The L/S 54 has level shifter circuits $LS_1$ to $LS_N$ (i.e., the 1st to N-th LSes) corresponding to the scan lines $G_1$ to $G_N$, respectively, and shifts the voltage levels on the high potential sides of the held data of the corresponding $FF_{G1}$ to $FF_{GN}$, to 20 to 50 V, for example.

The L/S 56 shifts the voltage level on the high potential side of the inverted signal (or the output enable signal) of the output enable signal XOEV supplied from the LCD controller 60, to 20 to 50 V.

The scan line drive circuit 58 includes AND circuits $\mathbf{230}_1$ to $\mathbf{230}_N$ as mask circuits, and CMOS buffer circuits $\mathbf{232}_1$ to $\mathbf{232}_N$, individually for the scan lines $G_1$ to $G_N$. The AND circuits $\mathbf{230}_1$ to $\mathbf{230}_N$ and the CMOS buffer circuits $\mathbf{232}_1$ to $\mathbf{232}_N$ are formed by the high pressure-resisting process which can be operated at the aforementioned voltage level of 20 to 50 V. Here, this voltage level is determined according to a liquid crystal material, for example, for the LCD panel 20 to be driven.

The AND circuits $\mathbf{230}_1$ to $\mathbf{230}_N$ mask the logic levels of the output nodes of the $FF_{G1}$ to $FF_{GN}$, which have been level-shifted by the $LS_1$ to $LS_N$, with the output enable signal XOEV, which have been level-shifted by the L/S 56, and the block select data used to specify in units of the line blocks. When the partial scan display data are set at "0", more specifically, the logic levels of the output nodes of the $LS_1$ to $LS_N$ are masked to "L" independently of the logic level of the output enable signal XOEV. When the partial scan display data are set at "1", on the other hand, the logic levels of the output nodes of the $LS_1$ to $LS_N$ are masked to "L" with the output enable signal XOEV.

The partial scan display data are held in the $FF_{B0}$ to $FF_{BR}$ which are provided in units of the line blocks. The $FF_{B0}$ is supplied with the partial scan display data $PART_G$ which are serially inputted from the LCD controller 60. The $FF_{B0}$ to $FF_{BR}$ are commonly supplied from the LCD controller 60 with a clock signal BCLK for fetching the serially inputted partial scan display data $PART_G$ sequentially. The $FF_{B0}$ to $FF_{BR}$ shift the partial scan display data $PART_G$ supplied to the $FF_{B0}$, sequentially in synchronism with the clock signal BCLK.

Moreover, the scan driver 50 is provided with data switch circuits (or bypass units) $\mathbf{234}_0$ to $\mathbf{234}_{R-1}$ for bypassing the scan enable input/output signal GEIO in units of the line blocks.

When the scan line drive of the block B1 is not done by the block select data, for example, the scan enable input/output signal GEIO to be supplied to the $FF_{G1}$ of the block B0 is shifted in synchronism with the clock signal CLK by the $FF_{G2}$ to $FF_{G8}$, but the shift output of the $FF_{G8}$ of the block B2 is supplied to the $FF_{G17}$ of the block B2 by the data switch circuit $\mathbf{234}_1$ corresponding to the $FF_{G9}$ of the block B1.

Specifically, the data switch circuit $\mathbf{234}_0$ corresponding to the block B0 switches the shift output (i.e., the scan enable input/output signal GEIO to be supplied to the $FF_{G1}$ in the block B0) supplied from the line block at the upstream stage and the shift output (i.e., the shift output to be outputted from the $FF_{G8}$ in the block B0) of the FF of the final stage of the line block, by the block select data of that line block. The output signal switched by the data switch circuit $\mathbf{234}_0$ is supplied to the block B1.

Here, the data switch circuit can also be inverted with respect to the individual line blocks so that the shift direction of the scan enable input/output signal GEIO maybe switched with a given shift direction switching signal SHL. In this case, there are provided the data switch circuits corresponding to the blocks BQ to B1.

The scan driver 50 thus constructed is so set that the block select data of the line block set in the display area may take "1" whereas the block select data of the line block set in the non-display area may take "0" with respect to the $FF_{B0}$ to $FF_{BR}$ disposed in the individual line blocks.

Moreover, the LCD controller 60 supplies the vertical synchronizing signal and the horizontal synchronizing signal. When the block select data specified in units of the line blocks are at "0" with the logic level of the output enable signal XOEV being at "L", the CMOS buffer circuits $\mathbf{232}_1$ to $\mathbf{232}_N$ do not drive the scan lines because the logic level of the output node of the LS is masked to the logic level "L" by the AND circuit.

1.4 LCD Controller

Figure 10:
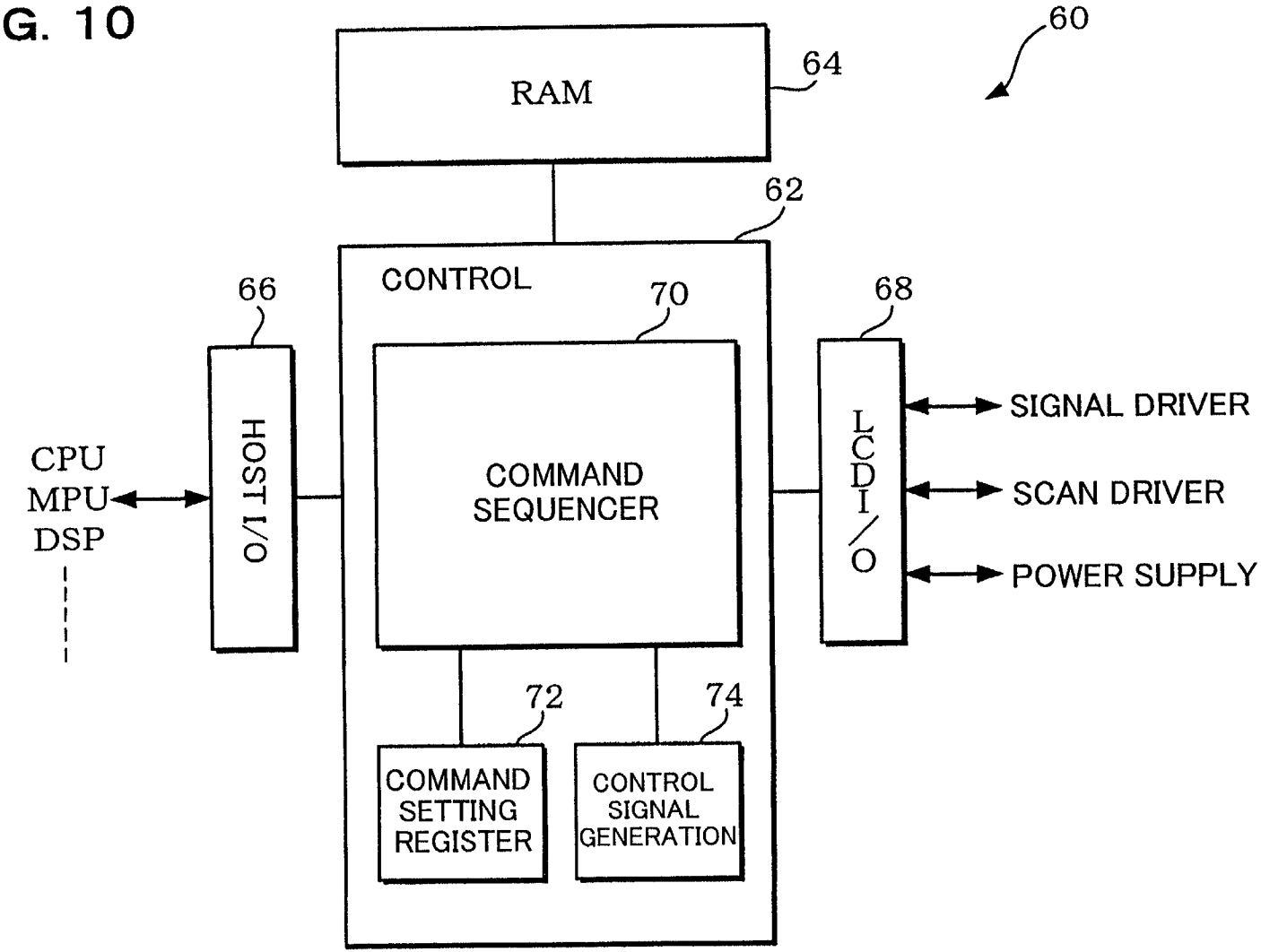
FIG. 10 is a block diagram schematically showing the configuration of an LCD controller shown in FIG. 1.

FIG. 10 shows a schematic configuration of the LCD controller shown in FIG. 1.

The LCD controller 60 includes a control circuit 62, a random access memory (as will be abbreviated into the "RAM") (or a storage unit in a wide sense) 64, a host input/output circuit (I/O) 66 and an LCD input/output circuit 68. Moreover, the control circuit 62 includes a command sequencer 70, a command setting register 72 and a control signal generation circuit 74.

In accordance with the contents set by the host, the control circuit 62 makes the various action mode settings and the synchronous controls of the signal driver 30, the scan driver 50 and the power circuit 80. In accordance with the instructions from the host, more specifically, the command sequencer 70 is based on the contents set by the command setting register 72, to generate synchronous timing in the control signal generation circuit 74 and to set a given action mode for the signal driver or the like.

The RAM 64 has a function as a frame buffer for the image display and provides a work area for the control circuit 62.

This LCD controller 60 is supplied through the host I/O 66 with the image data and the command data for controlling the signal driver 30 and the scan driver 50.

With the host I/O 66, more specifically, there are connected a CPU, a digital signal processor (DSP) or a microprocessor unit (MPU), although not shown. The LCD controller 60 is supplied through the host I/O 66 with the image data such as still image data from the not-shown CPU and moving image data from the DSP or MPU. The LCD controller 60 is further supplied through the host I/O 66 from the not-shown CPU with the command data such as the contents of the register for controlling the signal driver 30 or the scan driver 50 and the data for setting the various action modes.

The image data and the command data may be supplied individually through different data buses, or these data buses may be shared. In this case, the image data and the command data can be easily shared to reduce the packaging area, by making it possible to discriminate whether the data on the data bus are the image data or the command data, from the signal level inputted to the command (CoMmanD: CMD) terminal.

The LCD controller 60 latches the image data, when supplied, in the RAM 64 acting as the frame buffer. On the other hand, the LCD controller 60 latches the command data, when supplied, in the command setting register 72 or the RAM 64.

In the command sequencer 70, the various timing signals are generated by the control signal generation circuit 74 in accordance with the contents set by the command setting register 72. Moreover, the command sequencer 70 sets the mode of the signal driver 30, the scan driver 50 or the power circuit 80 through the LCD input/output circuit 68 in accordance with the contents set in the command setting register 72.

In response to the display timing generated by the control signal generation circuit 74, moreover, the command sequencer 70 generates the image data of the predetermined type from the image data stored in the RAM, and supplies the generated data to the signal driver 30 through the LCD input/output circuit (or LCD I/O) 68.

1.5 Inverted Drive Method

In case the liquid crystal is to be driven for the display, it is necessary from the viewpoint of the durability or contrast of the liquid crystal to periodically discharge the charge stored in the liquid crystal capacitor. In the aforementioned liquid crystal device 10, therefore, the polarities of the voltage to be applied to the liquid crystal are inverted for a given period by an AC drive. This AC drive method is exemplified by a frame-inverted drive method or a line-inverted drive method.

In the frame-inverted drive method, the polarities of the voltage to be applied to the liquid crystal capacitor are inverted for every frames. In the line-inverted drive method, on the other hand, the polarities of the voltage to be applied to the liquid crystal capacitor are inverted for every lines. In the line-inverted drive method, too, the polarities of the voltage to be applied to the liquid crystal capacitor are inverted for the frame periods if the individual lines are noted.

Figure 11A:
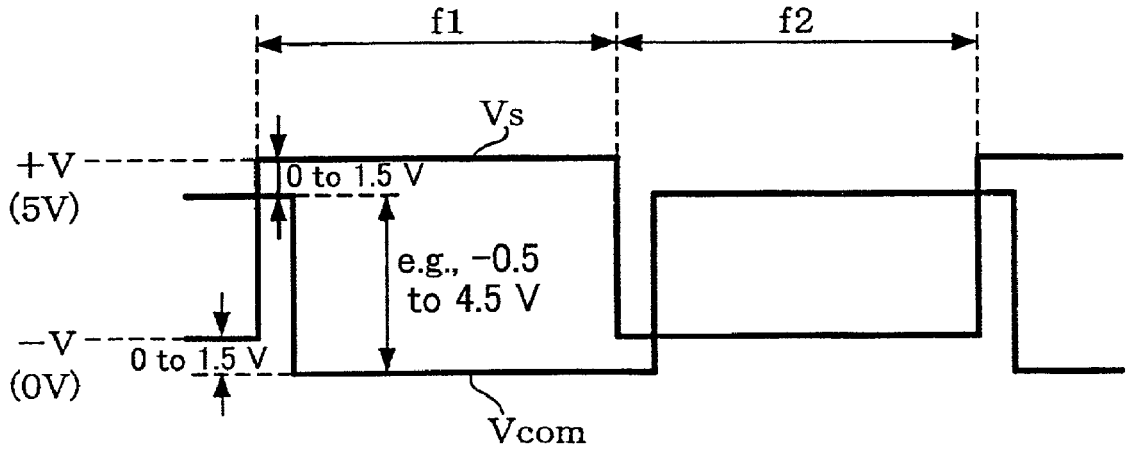
FIG. 11A is a schematic diagram schematically showing the waveforms of the drive voltage of a signal line and a common electrode voltage Vcom according to a frame inverted drive method.
Figure 11B:
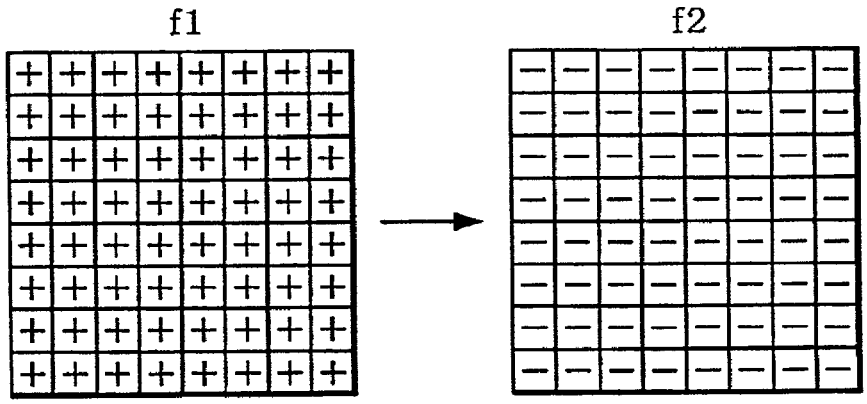
FIG. 11B is a schematic diagram showing the polarities of voltages to be applied to liquid crystal capacitors corresponding to individual pixels for individual pixels in the case of the frame inverted drive method.

FIGS. 11A and 11B are diagrams for explaining the actions of the frame-inverted drive method. FIG. 11A schematically shows the waveforms of the drive voltage and the common electrode voltage Vcom of the signal lines by the frame-inverted drive method. FIG. 11B schematically shows the polarities of the voltage to be applied to the liquid crystal capacities corresponding to the individual pixels, for every frames when the frame-inverted drive method is done.

In the frame-inverted drive method, the polarity of the drive voltage to be applied to the signal line is inverted for each frame period, as shown in FIG. 11A. Specifically, a voltage $V_S$ to be supplied to the source electrode of the TFT connected with the signal line takes a positive polarity "+V" for a frame f1 and a negative polarity "−V" for a subsequent frame f2. On the other hand, the common electrode voltage Vcom to be supplied to the common electrode opposed to the pixel electrode connected with the drain electrode of the TFT is also inverted in synchronism with the polarity inverting period of the drive voltage of the signal line.

The liquid crystal capacitor is supplied with the difference between the voltages of the pixel electrode and the common electrode so that the voltage of the positive polarity is applied for the flame f1 whereas the voltage of the negative polarity is applied for the frame f2, as shown in FIG. 11B.

Figure 12A:
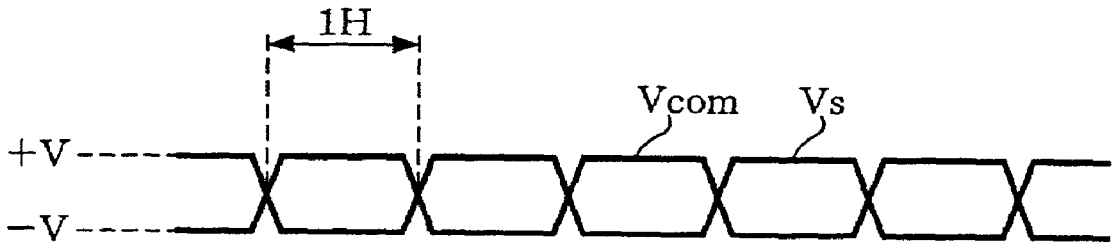
FIG. 12A is a schematic diagram schematically showing the waveforms of the drive voltage of a signal line and a common electrode voltage Vcom according to a line inverted drive method.
Figure 12B:
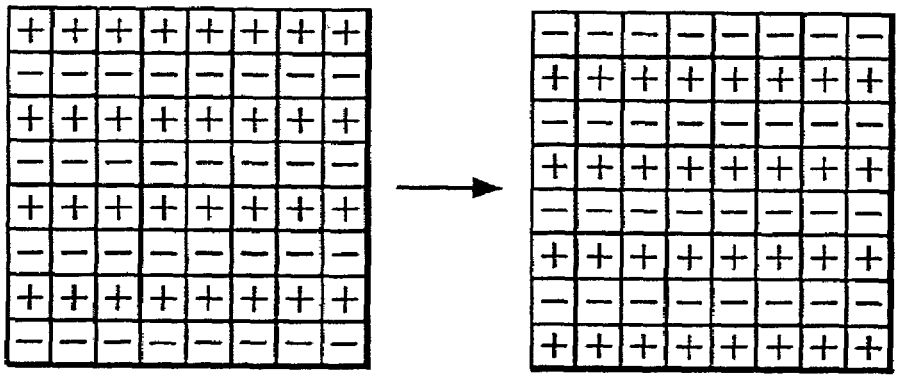
FIG. 12B is a schematic diagram showing the polarities of voltages to be applied to liquid crystal capacitors corresponding to individual pixels for individual pixels in the case of the line inverted drive method.

FIGS. 12A and 12B are diagrams for explaining the actions of the line-inverted drive method.

FIG. 12A schematically shows the waveforms of the drive voltage and the common electrode voltage Vcom of the signal lines by the line-inverted drive method. FIG. 12B schematically shows the polarities of the voltages to be applied to the liquid crystal capacities corresponding to the individual pixels, for every frames when the line-inverted drive method is done.

In the line-inverted drive method, the polarity of the drive voltage to be applied to the signal line is inverted for each horizontal scan period (1 H), as shown in FIG. 12A. Specifically, the voltage $V_S$ to be supplied to the source electrode of the TFT connected with the signal line takes the positive polarity "+V" for 1 H of the frame f1 and the negative polarity "−V" for 2 H. Here, the voltage $V_S$ takes the negative polarity "−V" for 1 H of the frame f2 and the positive polarity "+V" for 2 H.

On the other hand, the common electrode voltage Vcom to be supplied to the common electrode opposed to the pixel electrode connected with the drain electrode of the TFT is also inverted in synchronism with the polarity inverting period of the drive voltage of the signal line.

The liquid crystal capacitor is supplied with the difference between the voltages of the pixel electrode and the common electrode so that the voltage to have its polarity inverted for each line is applied for the frame period, as shown in FIG. 12B, by inverting the polarity for each scan line.

Generally, the line-inverted drive method can make more contribution to an improvement in the image quality but consumes a more power than the frame-inverted drive method, because the it changes for one line period.

1.6 Liquid Crystal Drive Waveforms

Figure 13:
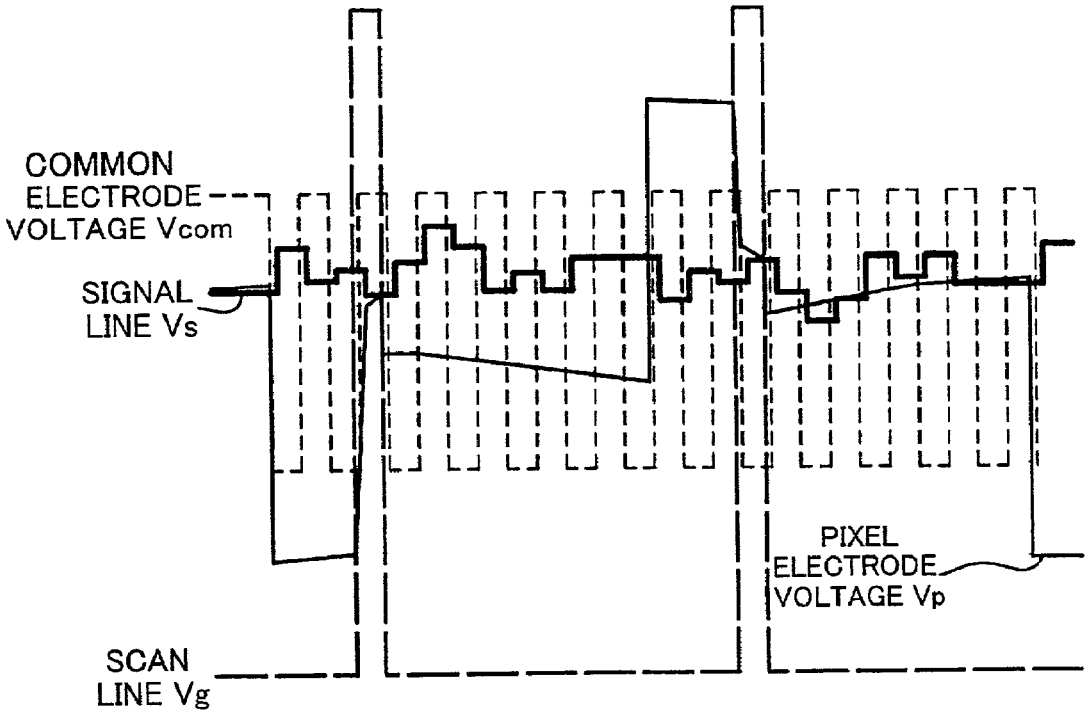
FIG. 13 is an explanatory diagram showing one example of the drive waveforms of an LCD panel of a liquid crystal device.

FIG. 13 shows one example of the drive waveforms of the LCD panel 20 of the liquid crystal device 10 having the configuration thus far described. Here is shown the case of the drive according to the line-inverted drive method.

In the liquid crystal device 10, the signal driver 30, the scan driver 50 and the power circuit 80 are controlled according to the display timing generated by the LCD controller 60, as has been described hereinbefore. The LCD controller 60 transfers the image data sequentially at one horizontal scan unit to the signal driver 30 and supplies the horizontal synchronizing signal generated therein and a polar inverting signal POL indicating the inverted drive timing. Moreover, the LCD controller 60 supplies the vertical synchronizing signal generated therein to the scan driver 50. Moreover, the LCD controller 60 supplies a common electrode voltage polarity inverting signal VCOM to the power circuit 80.

As a result, the signal driver 30 is synchronized with the horizontal synchronizing signal, to drive the signal line on the basis of the image data of one horizontal scan unit. The scan driver 50 is triggered by the vertical synchronizing signal scans and drives the scan lines connected with the gate electrodes of the TFTs arranged in the matrix shape in the LCD panel 20, sequentially a drive voltage Vg. The power circuit 80 supplies the common electrode voltage Vcom generated therein, to the common electrode of the LCD panel 20 while being polarity-inverted in synchronism with the common electrode voltage polarity inverting signal VCOM.

The liquid crystal capacitor is charged with an electric charge according to the voltage Vcom between the pixel electrode connected with the drain electrode of the TFT and the common electrode. When a pixel electrode voltage Vp latched by the electric charge stored in the liquid crystal capacitor exceeds a given threshold value $V_{CL}$, therefore, the image display can be made. When the pixel electrode voltage Vp exceeds the threshold value $V_{CL}$, the transmission factor of the pixel changes according to the voltage level so that the gradation expression can be made.

1.7 Partial Display Control

The LCD controller 60 in this embodiment for display controlling the liquid crystal device 10 thus constructed is enabled to perform the partial display control in which the display area and the non-display area are specified in units of the line blocks in the array direction of the signal lines, by setting the block output select data and the partial display data for the signal driver 30. Likewise, the LCD controller 60 is also enabled to perform the partial display control in which the display area and the non-display area are specified in units of the line blocks in the array direction of the scan lines, by setting the partial display data for the scan driver 50.

Figure 14A:
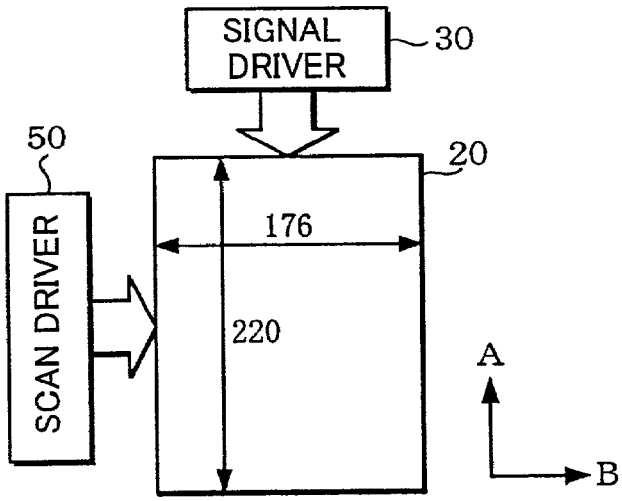
FIGS. 14A, 14B and 14C are explanatory diagrams schematically showing one example of a partial display control to be realized by the LCD controller in this embodiment.
Figure 14B:
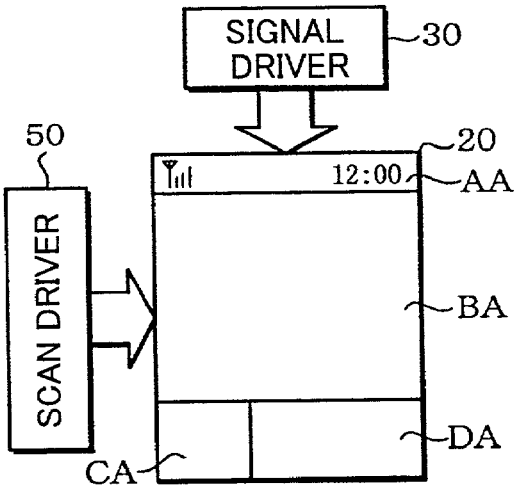
Figure 14C:
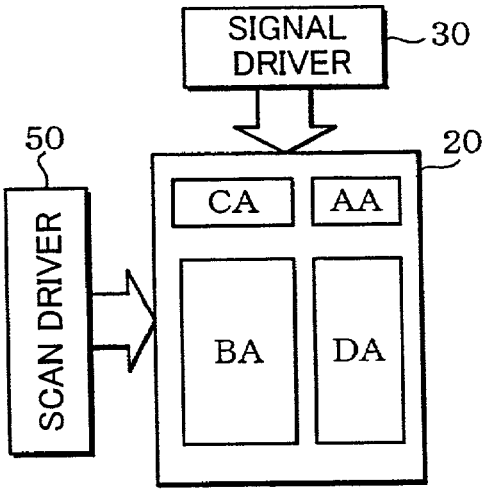

FIGS. 14A, 14B and 14C schematically show one example of the partial display control by the LCD controller 60 in this embodiment.

It is assumed that the signal driver 30 and the scan driver 50 are arranged, as shown in FIG. 14A, with respect to the LCD panel 20 in which the scan lines are arrayed in an A-direction whereas the signal lines are arrayed in a B-direction. When the display unit of a mobile telephone is constructed of such LCD panel 20, for example, the electric wave receiving state and the time are displayed in a display area AA, but a display area BA is left as a non-display area in the standby state. Moreover, information on a moving picture or a mail may be suitably displayed in display areas CA and DA.

Moreover, boundaries are set between the individual display areas AA to DA, and the partial display is controlled and arranged in an arbitrary area, as shown in FIG. 14C, so that an observable frame can be provided for the user.

By this partial display control, it is possible to drastically promote the lower consumption of the LCD panel using the TFTs, which can make the window display and can provide images of a high quality. By adopting this partial display control, moreover, the operability can be improved for the user, although it might otherwise become the lower for the larger frame size.

Figure 15A:
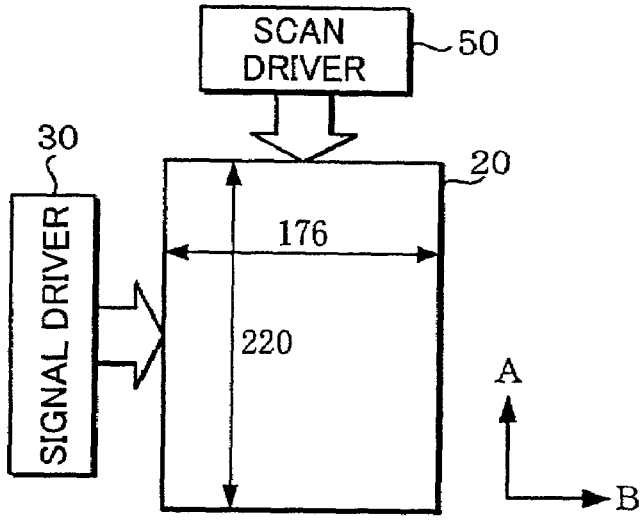
FIGS. 15A, 15B and 15C are explanatory diagrams schematically showing another example of a partial display control to be realized by the LCD controller in this embodiment.
Figure 15B:
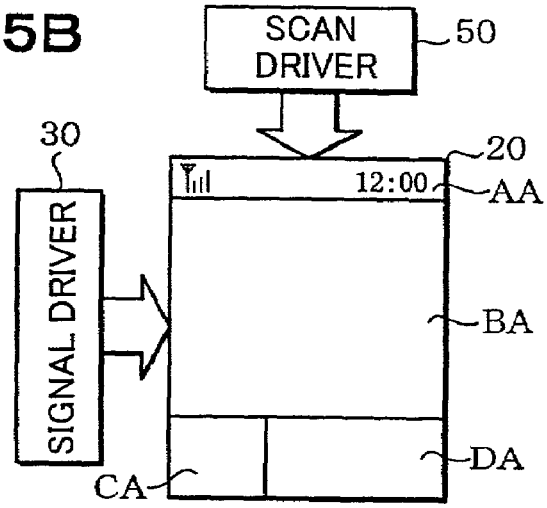
Figure 15C:
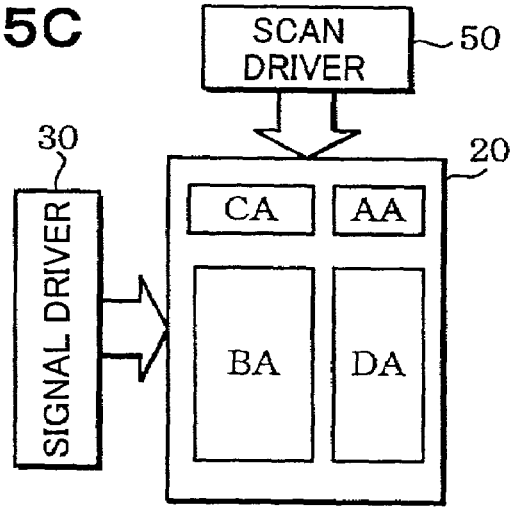

FIGS. 15A, 15B and 15C schematically show another example of the partial display control by the LCD controller 60 in this embodiment.

It is assumed that the signal driver 30 and the scan driver 50 are arranged, as shown in FIG. 15A, with respect to the LCD panel 20 in which the scan lines are arrayed in the A-direction whereas the signal lines are arrayed in the B-direction. Like FIGS. 14B and 14C, as shown in FIGS. 15B and 15C, by the partial display control, it is possible to drastically promote the lower consumption of the LCD panel using the TFTs, which can make the window display and can provide images of a high quality. By adopting this partial display control, moreover, the operability can be improved for the user, although it might otherwise become the lower for the larger frame size.

Especially by making the partial display control on the signal driver 30 and the scan driver 50 by the LCD controller 60, the window can be displayed at an arbitrary position in the display area of the LCD panel 20 so that the proper information can be displayed in the window.

2. LCD Controller in Embodiment

Here will be described in more detail the LCD controller 60 for making such partial display control possible.

2.1 Specific Example of Configuration

Figure 16:
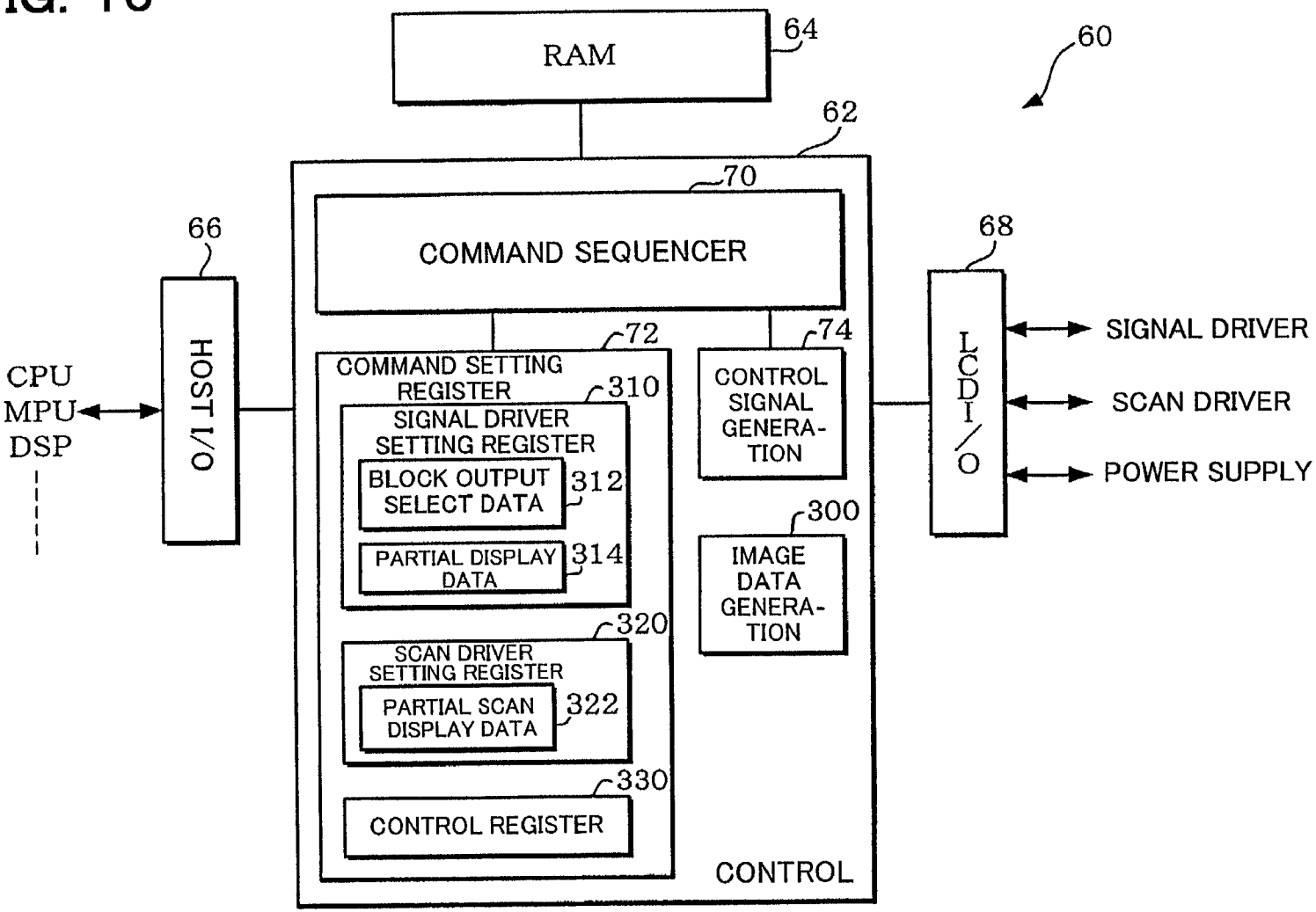
FIG. 16 is a block diagram showing an essential portion of the configuration of the LCD controller in this embodiment.

FIG. 16 shows one example of an essential portion of a functional block configuration of the LCD controller 60 in this embodiment.

Note that components corresponding to those in the LCD controller 60 of FIG. 10 are denoted by the same reference numbers.

The control circuit 62 further includes an image data generation circuit (or an image data generation section) 300.

This image data generation circuit 300 converts the data of the image, as temporarily stored in the RAM 64, for example, into image data of a predetermined type. The converted image data are supplied to the signal driver 30 by a command sequencer (or a image data supply unit in a wide sense) 70.

Moreover, the command setting register 72 includes a signal driver setting register 310, a scan driver setting register 320 and a control register 330.

The scan driver setting register 310 holds block output select data 312 and partial display data to be set in the signal driver 30 for the partial display control. These block output select data 312 and the partial display data 314 are set through the host I/O 66 by the not-shown host.

The scan driver setting register 320 holds the partial scan display data 322 to be set in the scan driver 50 for the partial display control. The partial scan display data 322 is set through the host I/O 66 by the not-shown host.

The control register 330 holds the controller control data for controlling the action of the LCD controller 60. The controller control data are set through the host I/O 66 by the not-shown host. On the basis of the controller control data set in the control register 330, the command sequencer 70 of the LCD controller 60 can control the action to control the partial display for the signal driver 30 and scan driver 50.

Figure 17:
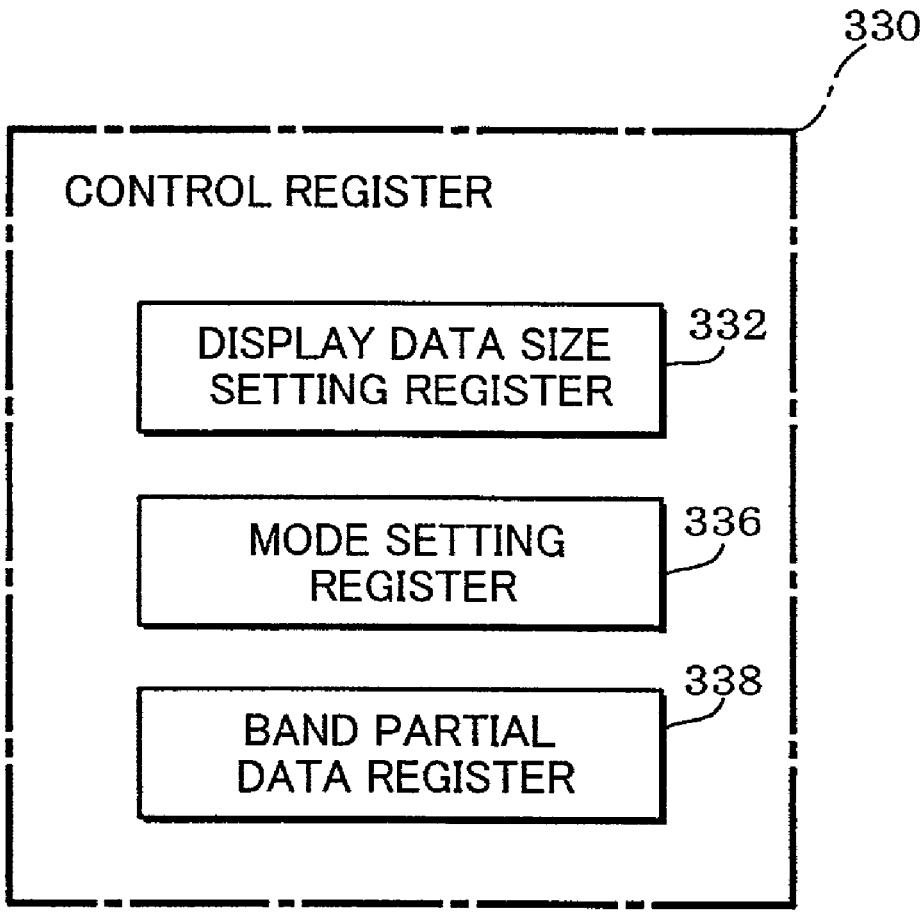
FIG. 17 is an explanatory diagram schematically showing the configuration of a control register in this embodiment.

FIG. 17 shows one example of the controller control data to be held in the control register 330.

This control register 330 includes a display data size setting register 332, a mode setting register 336 and a band partial data register (or a band-partial-display control data holding section) 338.

In the display data size setting register 332, there are set the display data sizes for specifying the image sizes to be display in the LCD panel 20. The display data sizes are set through the host I/O 66 by the not-shown host.

In the mode setting register 336, there are set the mode setting data for setting the various modes for the partial display control. When the mode setting data corresponding to the individual modes are set in the mode setting register 336 by the not-shown host, for example, the command sequencer (or a mode switching section in a wide sense) 70 acts in those modes. The LCD controller 60 in this embodiment performs different window managements for the modes and makes the optimum partial display controls for the signal driver 30 and the scan driver 50.

The band partial data register 338 holds the band partial data for making the partial display control only in the array direction of the scan lines. The band partial data are set through the host I/O 66 by the not-shown host. In this embodiment, the partial display control based on the band partial data is made when a given action mode is determined by the mode setting register 336.

For example, a given host machine (not shown) may instruct the mode setting register 336 to previously set an action mode for such LCD controller 60. When the band partial data are used, a given action mode is set by the mode setting register 336 before the band partial register 338 is set. In other action modes, memory areas for managing one or more windows for which partial display control is performed by the RAM 64 are secured.

After this, the LCD controller 60 is set with the various data of the signal driver setting register 310 and the scan driver setting register 320 by the not-shown host. Then, the command sequencer 70 sets the display area and the non-display area for the signal driver 30 and the scan driver 50 through the LCD I/O 68. More specifically, the command sequencer 70 sets the block output select data and the partial display data for the signal driver 30, and the partial scan display data for the scan driver 50.

At this time, the LCD controller 60 sets the display area (or the non-display area) for the signal driver 30 and the scan driver 50 in accordance with the action mode set in the mode setting register 336, with reference to the display control data or the band partial data to be managed over the memory retained in the RAM 64.

After this, the image data generated by the not-shown host are once stored in the RAM 64, and the image data generation circuit 300 generates the image data of a predetermined type with reference to the display data size setting register 332, for example. The LCD controller 60 supplies a given display timing to the scan driver 50, and supplies the generated image data to the signal driver 30 in synchronism with the display timing.

2.2 Partial Display Control 2.2.1 Refresh

The dynamically switchable partial display control has never been made in the active matrix type liquid crystal panel using the TFT. From the relation to the lifetime of the liquid crystal, as described hereinbefore, the AC drive has been done for every sixtieth seconds, for example. However, the liquid crystal is degraded if the gate electrode is turned ON with the liquid crystal capacitor being charged. It is, therefore, necessary to release the charge stored in the liquid crystal capacitor. In the active matrix type liquid crystal panel using the TFT, therefore, the voltage difference between the pixel electrode and the common electrode of the liquid crystal capacitor is set to 0 or a more or less offset for the non-display area.

Here, the liquid crystal capacitor is gradually stored with the electric charge by the leakage of the TFT. Even the OFF state of the gate electrode of the TFT is kept, therefore, the charge exceeding the threshold value VCL is finally stored. As a result, the transmission factor of the pixel changes into a gray display, for example, so that the so-called "partial display" cannot be made.

In other words, the partial display control method, as could be easily realized in the case of the passive matrix type liquid crystal panel using the STN liquid crystal so long as it is not scanned and driven, cannot be applied as it is to the active matrix type liquid crystal panel using the TFT. In case the non-display area is set in the active matrix type liquid crystal panel using the TFT, therefore, it has to be set in a fixed manner from the power ON so that the dynamically switchable partial display control cannot be made.

In this embodiment, on the contrary, the dynamically switchable partial display control is realized by controlling the voltage of the gate electrode of the TFT. By this partial display control, moreover, the electric power to be consumed by the scan drive of the non-display area can be lowered or reduced.

More specifically, the scan driver 50 scans and drives the scan lines as set in the display area in units of the line blocks, for one frame period, and scans and drives all the scan lines including the scan lines set in the non-display area in units of the line blocks, for an arbitrary odd frame period of three or more frames. Here, this odd frame period of three or more frames has the last fame that falls on the third frame, the fifth frame, . . . and the (2k+1)-th (k: a natural number) frame.

Figure 18A:
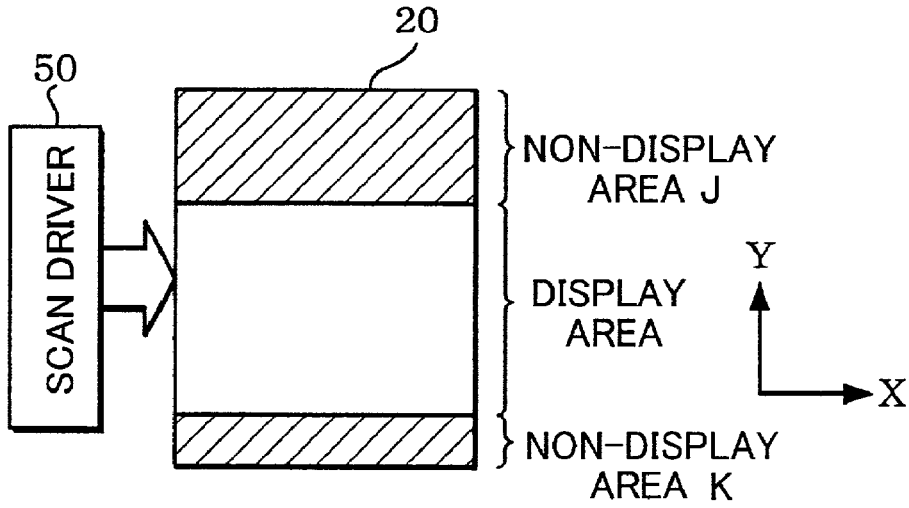
FIGS. 18A and 18B are explanatory diagrams showing one example of the actions of the scan driver.
Figure 18B:
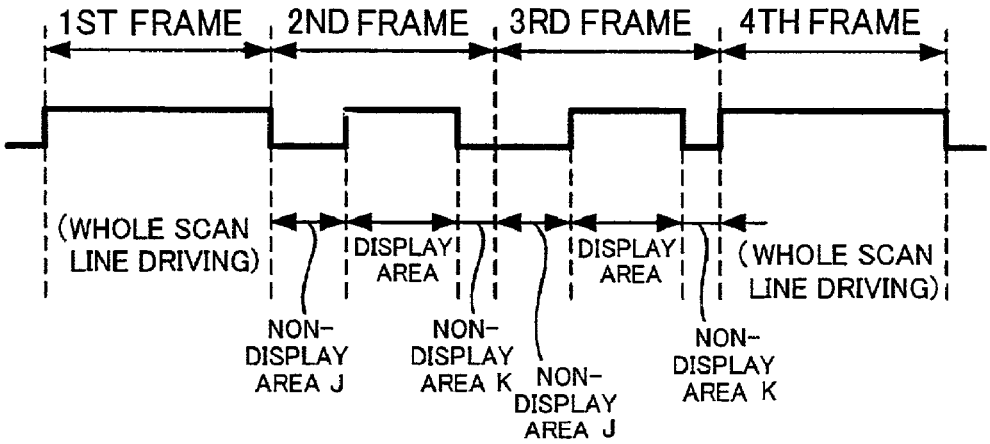

FIGS. 18A and 18B show one example of the actions of the scan driver 50 which is controlled by the LCD controller 60 in this embodiment.

For example, it is assumed that a display area and non-display areas J and K are specified in units of the line blocks, as shown in FIG. 18A, in case a plurality of scan lines extending in the B-direction are arrayed in the A-direction of the LCD panel 20.

In case the frame to sequentially scan and drive all the scan lines including the line blocks of the display area and the non-display areas J and K is located at the 1st frame, the scan driver 50 scans and drives all the scan lines of the LCD panel 20 sequentially at the two-frame spaced 4th frame, as shown in FIG. 18A. In short, all the scan lines of the LCD panel 20 are scanned and driven for the three-frame period, as shown in FIG. 18B.

In case polarity of the applied voltage of the 1st -frame liquid crystal capacitor is positive, for example, the polarity of the applied voltage of the 4th-frame liquid crystal capacitor is negative, and the polarity of the applied voltage of the 7th-frame liquid crystal capacitor is positive. Thus, it is possible to realize the AC drive. At the 2nd frame and the 3rd frame between the frames (i.e., the 1st frame and the 4th frame) for scanning and driving all the scan lines, moreover, the scan lines corresponding to the non-display areas J and K are not scanned and driven so that the power consumption can be accordingly reduced.

By thus refreshing the scan lines of the non-display area for the odd frame period of three or more frames in the active matrix type liquid crystal panel using the TFT, the polarities of the voltage to be applied to the liquid crystal capacitor are inverted to prevent the troubles due to the leakage of the TFT, and the power consumption can be reduced by reducing the unnecessary scan drive.

2.2.2 Refresh Control

By the refreshing actions thus far described, the low power consumption, as could otherwise be impossible, can be realized in the active matrix type liquid crystal panel using the TFT. If the lower power consumption is sought for, moreover, the frame frequency is lowered, or the aforementioned refresh period is elongated.

For this, however, a reduction in the display quality such as flickers may appear when the state of a window display by the partial display control is changed by an window access (e.g., an access to the aforementioned various registers for setting the display area, or a display control event) such as the generation, extinguishing, movement or size change of the widow for a frame period. This reduction is thought to be caused by the production dispersion such as the leakage of the TFT, and it is desired to make a proper refresh control for preventing the reduction in the display quality.

In this embodiment, therefore, a full scan (or a full frame scan) is done in a frame subsequent to that, in which the aforementioned window access was made, to avoid the troubles which might otherwise be caused by the leakage of the TFT. By using this fully canned frame as a reference frame, moreover, the partial scan is done for the odd frame period.

Here, the "full scan" is meant to scan all the scan lines irrespective of the display area and the non-display area. Moreover, the "partial scan" is meant to scan the scan lines corresponding to the display area for every frame periods and the scan lines corresponding to the non-display area for the odd frame periods.

Thus, the reduction in the display quality, as might otherwise be caused by the product dispersion, can be prevented to make the partial display control capable of realizing the low consumption.

As a concrete method for realizing such refresh control is realized by the following three methods, as will be described in detail.

2.2.3 First Method

In order to scan and drive the scan lines corresponding to the non-display area for a given odd frame of three or more, there is provided a frame counter for counting the frame number. This frame counter increments each frame, for example, by setting the frame for the full scan to "0". When the frame number held in a frame interval register and the counter value of the frame counter are equal, for example, the counter value of the frame counter is reset to "0".

With this configuration, the full scan is done, when the frame having the counter value "0" of the frame counter is detected, and is subsequently done for the period of the frame number held in the frame interval register.

In the first method, therefore, the counter value of the frame counter is forcibly set to "0" in the frame subsequent to that of the window access.

Figure 19:
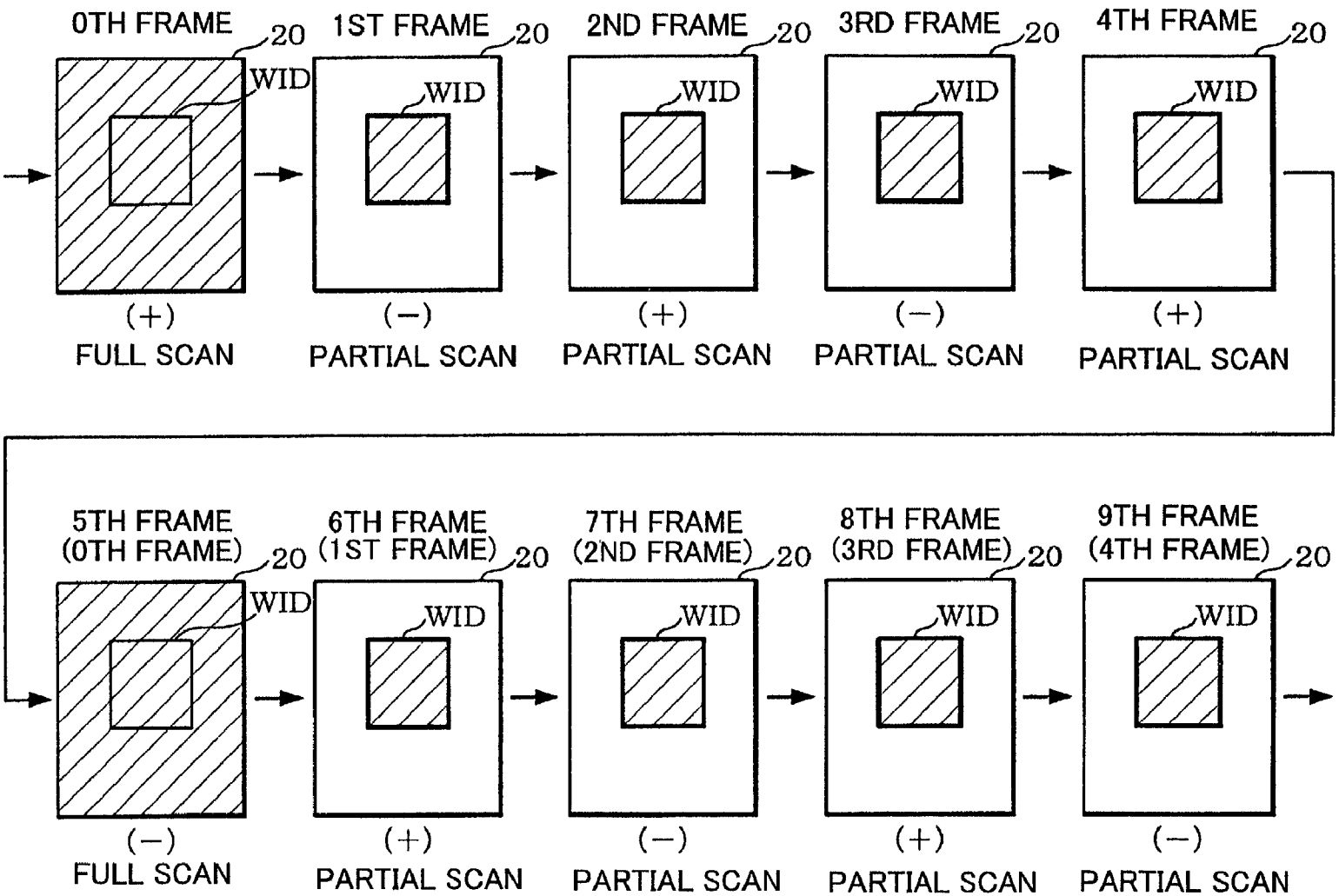
FIG. 19 is an explanatory diagram for explaining a refreshing action of the case without a window access.

FIG. 19 is a diagram as a comparison for explaining the refreshing actions of the case without the window access.

Here is thought the case in which a window WID is set in the display area of the LCD panel 20 by the signal driver 30 and the scan driver 50. This window WID acts as the display area for displaying a still image of texts or characters and a moving image.

In the following, it is assumed that the full scan is done by using the 0th frame as the reference frame and by exemplifying the odd frame period by a five-frame period.

Specifically, the scan lines corresponding to the display area are scanned for every frame periods, but the scan lines corresponding to the non-display area are scanned for the five-frame period. Here, the scan lines corresponding to the display area are the scan lines (or the display scan lines) contained at least partially in the display area, the scan lines corresponding to the non-display area are the remaining scan lines (or the non-display scan lines excepting the display scan lines).

In the full scan and the partial scan, on the other hand, it is assumed that the polarities to be applied to the liquid crystal capacitor of the TFT are inverted for every frames by the frame-inverted scan method or the line-inverted scan method.

In the 0th frame, as shown in FIG. 19, the positive polarity (+) prevails, and the scan drive is done (in the full scan) for all the scan lines of the display area of the LCD panel 20 irrespective of the display area and the non-display area.

At the subsequent 1st to 4th frames, only the scan lines corresponding to the display area in the window WID are scanned and driven (in the partial scan) as the display area.

At these 0th to 4th frames, the frame number is counted by the frame counter, and this counted value is reset to "0" at the frame subsequent to the 4th frame. However, the positive polarity (+) of the 4th frame is inverted to the negative polarity (−).

In the 5th frame (or the 0th frame), moreover, the full scan is done at the negative polarity (−). At the subsequent 6th to 9th frames (or the 1st to 4th frames), the partial scan is done while inverting the polarities for every frames.

At the next 10th frame, moreover, the counter value is reset again to "0", and the full scan is done in the positive polarity (+) inverted from the negative polarity (−) of the 9th frame. These actions are repeated in the following.

Figure 20:
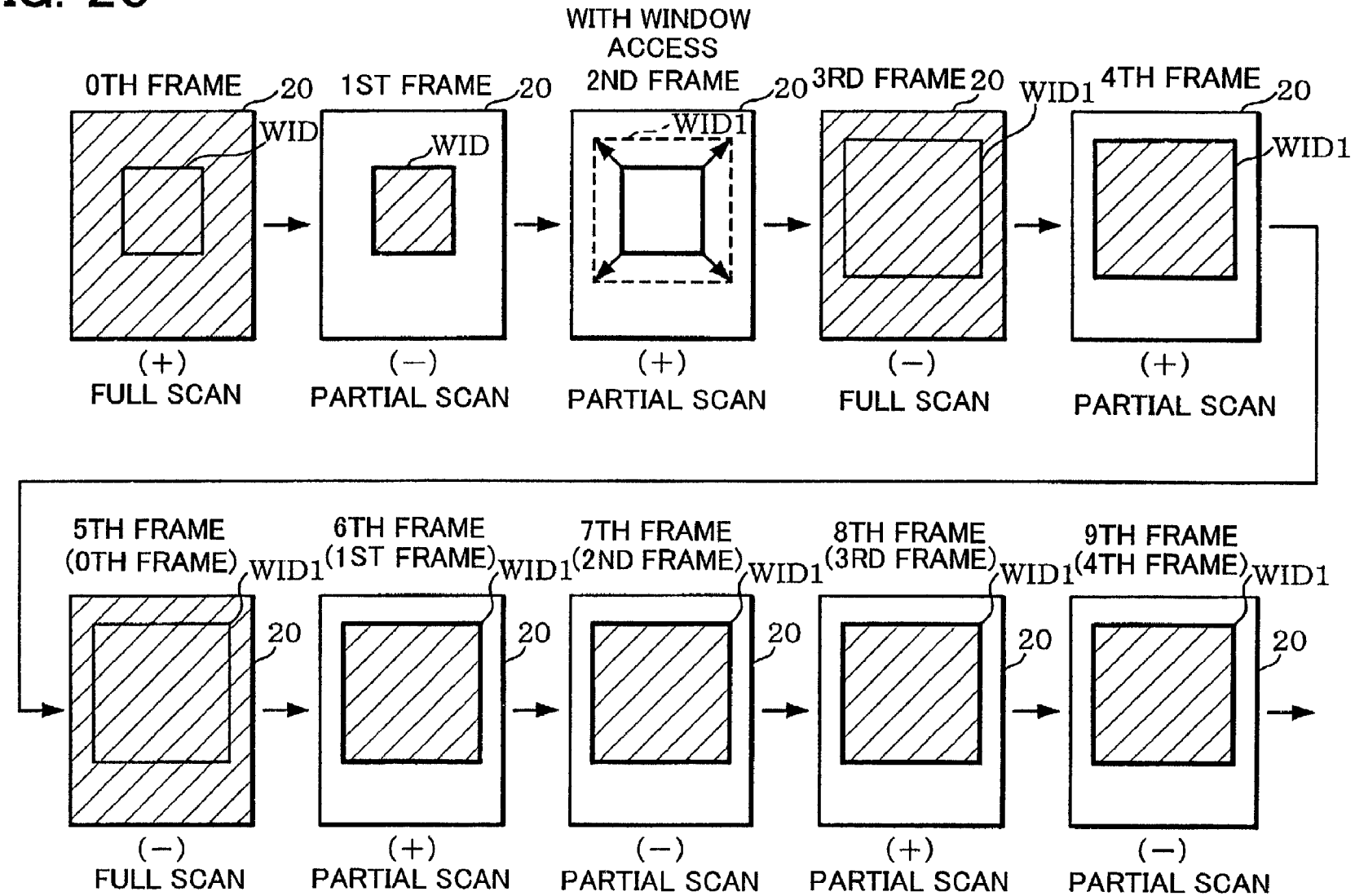
FIG. 20 is an explanatory diagram for explaining the refreshing action of the case with the window access in a first method for realizing a refresh control in this embodiment.

FIG. 20 is a diagram for explaining the refreshing actions of the case in which the window access is made in the first method.

Here is shown the case in which the size is changed from the window WID to a window WID1 for the frame period of the 2nd frame.

In the first method, when the window access is made at the 2nd frame (in the positive polarity (+)) in the partial scan, as described above, the full scan is done at the next 3rd frame (in the negative polarity (−)).

At the next 4th frame (in the positive polarity (+)), moreover, the partial scan is done for the window WID1 after the size change, and the full scan is done again at the 5th frame (or the 0th frame) (in the negative polarity (−)) after the partial scan.

At the subsequent 6th to 9th frames (or the 1st to 4th frames), the partial scan is done while inverting the polarities for every frames.

At the next 10th frame, moreover, the counter value is reset again to "0", and the full scan is done in the positive polarity (+) inverted from the negative polarity (−) of the 9th frame. These actions are repeated in the following.

Thus, the power consumption can be made without degrading the display quality even when the flickers are made to appear by the window access such as the size change.

Figure 21:
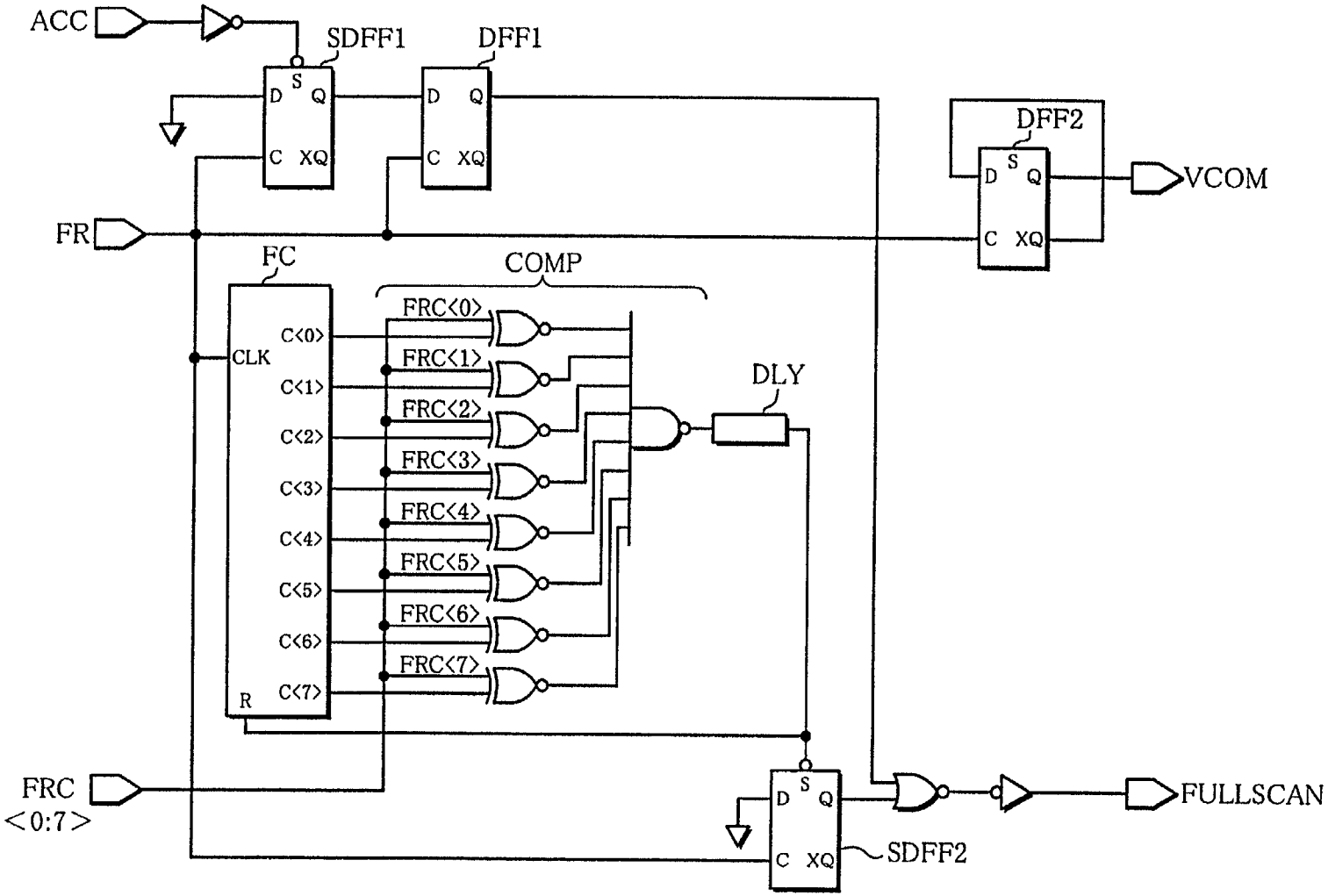
FIG. 21 is one example of a circuit configuration diagram for realizing the first method in this embodiment.

An example of circuit configuration for implementing the first method is shown in FIG. 21.

Here, "ACC" denotes a signal which takes the logic level "H" when the aforementioned window access is made. "FR" denotes a polarity inverting signal or a pulse signal to be supplied for every frames. "FRC<0:7>" denotes a signal of 8 bits having a frame period set in a frame interval register. "VCOM" denotes a timing signal for inverting the polarity of the common electrode and a signal to be inverted in synchronism with the FR signal, as shown in FIG. 21. "FULLSCAN" denotes a signal for doing the aforementioned full scan. The scan drive is done irrespective of the display area and the non-display area at the scan timing of the scan lines when the logic level of the FULLSCAN is at the "H".

The FR is supplied to the clock (C) terminals of the SDFF1, the SDFF2, the DFF1, the DFF2 and the FC. The SDFF1 and the SDFF2 are set D flip-flops, and the DFF1 and the DFF2 are D flip-flops. The FC is a frame counter of 8 bits and is incremented by 1 in synchronism with the edge of the signal inputted to the C-terminal and reset with the internal counter value by the signal inputted to the reset (R) terminal.

The inverted output data (XQ) terminal of the DFF2 is mutually connected with the data (D) terminal, and the output data (Q) terminal is the VCOM.

The ACC is supplied to the set (S) terminal of the SDFF1.

The D-terminals of the SDFF1 and the SDFF2 are connected with the ground level, and the D-terminal of the DFF1 is connected with the Q-terminal of the SDFF1.

The FRC<0:7> is supplied to the COMP. This COMP is a comparator of 8 bits for deciding whether or not the 8-bit outputs C<0:7> and FRC<0:7> of the FC are equal for every bits.

The output of the COMP is supplied to the S-terminal of the SDFF2 and the R-terminal of the FC through DLY. DLY denotes a delay element. When the output of the FC is identical to the FRC<0:7>, the counter value of the FC is reset after lapse of a given delay time.

The OR operation between the output of the Q-terminal of the DFF1 and the output of the Q-terminal of the SDFF2 is the FULLSCAN.

FIGS. 22A, 22B, 22C and 22D are timing charts in the circuit shown in FIG. 21.

Figure 22A:
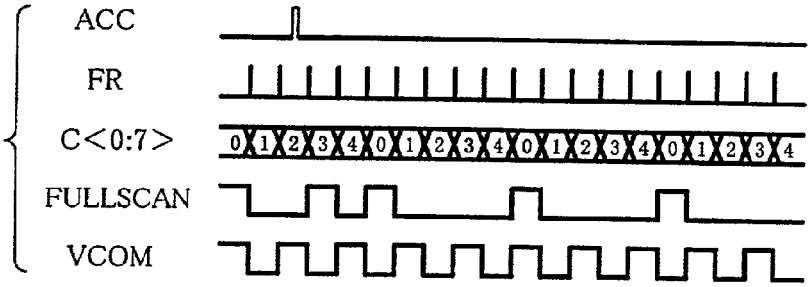
FIGS. 22A, 22B, 22C and 22D are timing charts showing one example of the timing of a circuit configuration diagram for realizing the first method in this embodiment.
Figure 22B:
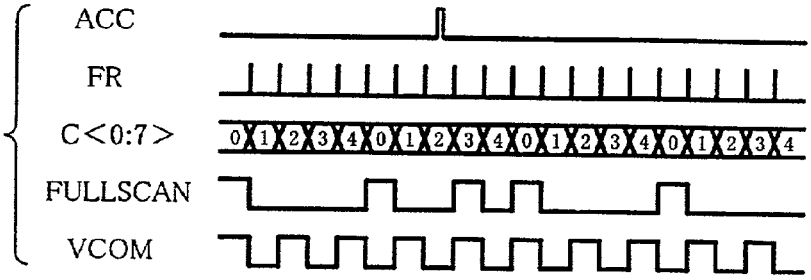
Figure 22C:
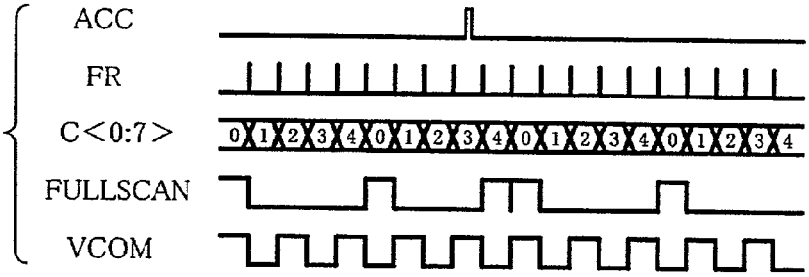
Figure 22D:
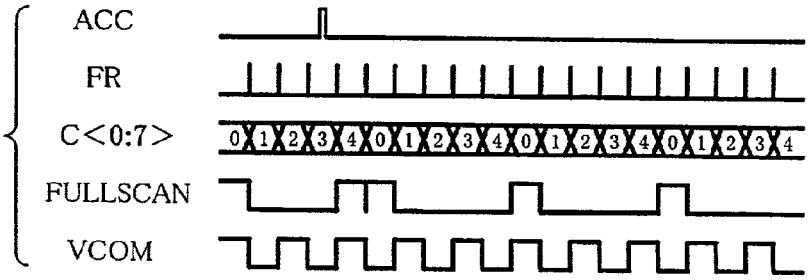

Here, FIG. 22A is a timing chart showing the refresh control by this circuit in the case of the window access when the VCOM has a positive logic at the 2nd frame. FIG. 22B is a timing chart showing the refresh control by this circuit in the case of the window access when the VCOM has a negative logic at the 2nd frame. FIG. 22C is a timing chart showing the refresh control by this circuit in the case of the window access when the VCOM has a positive logic at the 3rd frame. FIG. 22D is a timing chart showing the refresh control by this circuit in the case of the window access when the VCOM has a negative logic at the 3rd frame.

Thus, the logic level of the FULLSCAN is at the "H" at the frame subsequent to the frame of the window access. When the FULLSCAN takes the logic level "H", for example, the LCD controller 60 scans and drives the scan lines irrespective of the display area and the non-display area by supplying the a command to the gate driver 50. Thus, the full scan is done by the gate driver 50.

2.2.4 Second Method

In the first method, in the case of the window access, the frame period for the full scan is fixed, and the full scan is done at the next frame. As shown in FIG. 20, therefore, the full scan is done at the 3rd frame and the 5th frame both in the negative polarity (−), and the disorder feel maybe emphasized for the observer watching the screen.

In the second method, therefore, the full scan is done at the frame subsequent to the frame of the window access, and the counter value of the frame counter is reset so that the full scan is subsequently done for a given odd frame period of three or more periods.

Figure 23:
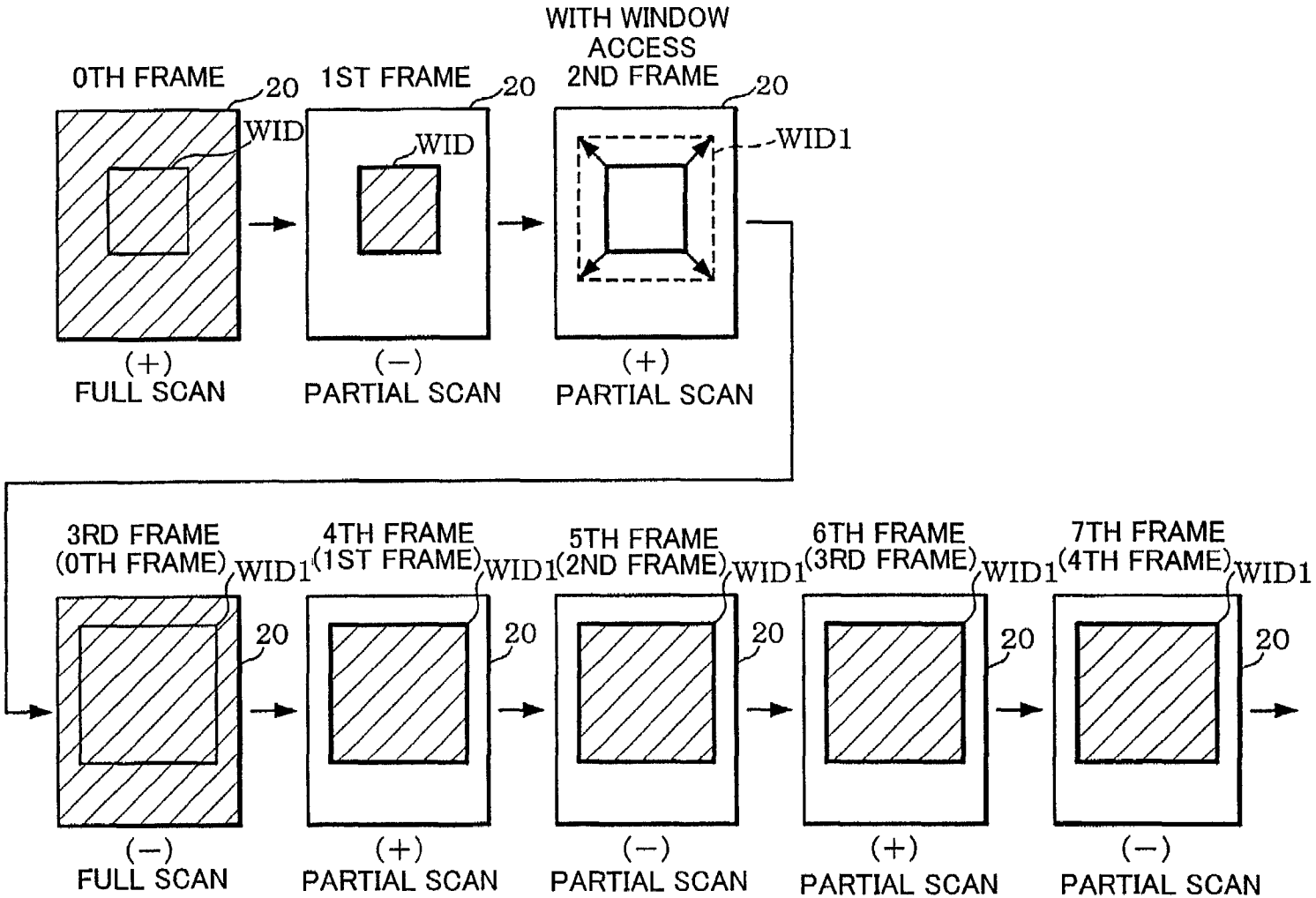
FIG. 23 is an explanatory diagram for explaining the refreshing action of the case with the window access in a second method for realizing the refresh control in this embodiment.

FIG. 23 is a diagram for explaining the refreshing actions of the case in which the window access is made in the second method.

Here is shown the case in which the size is changed from the window WID to a window WID1 for the frame period of the 2nd frame.

In the second method, when the window access is made at the 2nd frame (in the positive polarity (+)) in the partial scan, as described above, the full scan is done at the next 3rd frame (in the negative polarity (−)). At this time, the frame counter is reset to do the full scan in the negative polarity (−) inverted from the polarity of the 2nd frame.

At the subsequent 4th to 7th frames (or the 1st to 4th frames), the partial scan is done while inverting the polarities for every frames.

At the next 8th frame, moreover, the counter value is reset again to "0", and the full scan is done in the positive polarity (+) inverted from the negative polarity (−) of the 7th frame. These actions are repeated in the following.

Thus, the disorder feel by the full scan of the same polarity is not emphasized by the window access such as the size change so that the display quality can be better improved.

Figure 24:
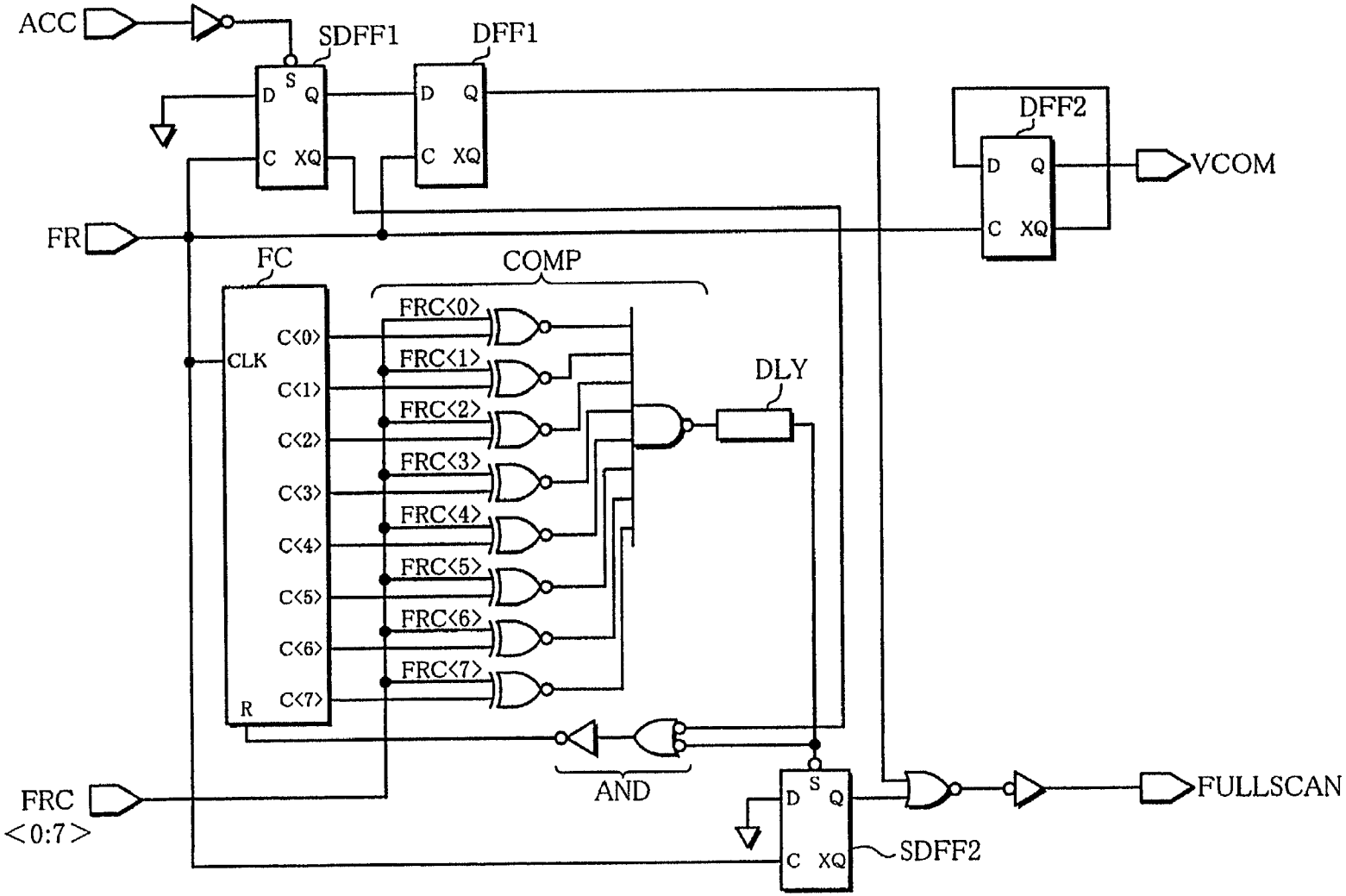
FIG. 24 is one example of a circuit configuration diagram for realizing the second method in this embodiment.

FIG. 24 shows one example of the circuit configuration for implementing the second method.

Note that components corresponding to those in the circuit of FIG. 21 are denoted by the same reference numbers and further description thereof is omitted.

The circuit shown in FIG. 24 is different from that shown in FIG. 21 in that the AND output between the inverted output from the SDFF1 and the output of the DLY is supplied to the R-terminal of the FC.

FIGS. 25A, 25B, 25C and 25D show timing charts in the circuit shown in FIG. 24.

Figure 25A:
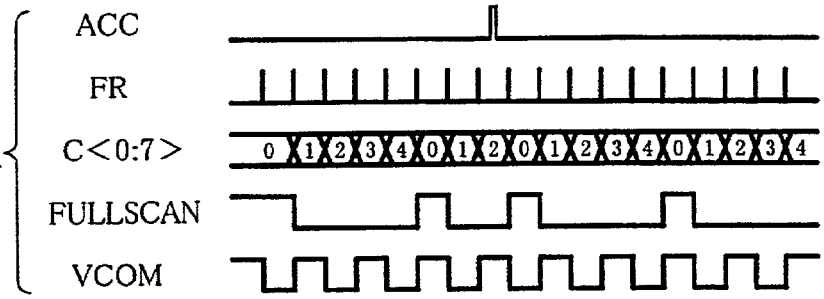
FIGS. 25A, 25B, 25C and 25D are timing charts showing one example of the timing of a circuit configuration diagram for realizing the second method in this embodiment.
Figure 25B:
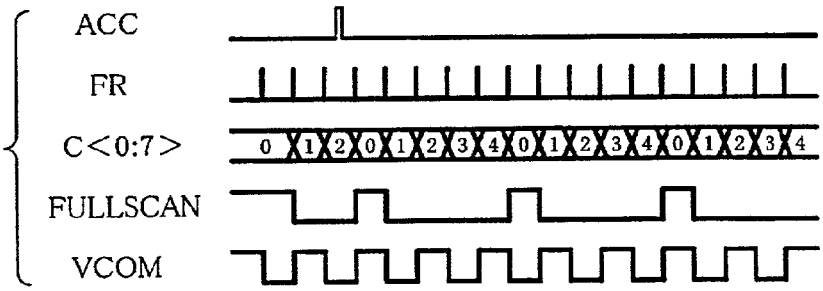
Figure 25C:
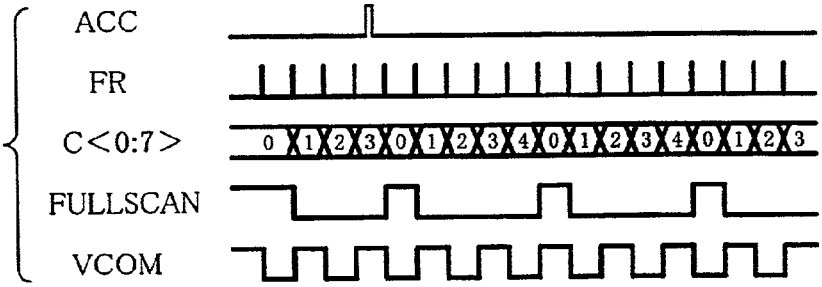
Figure 25D:
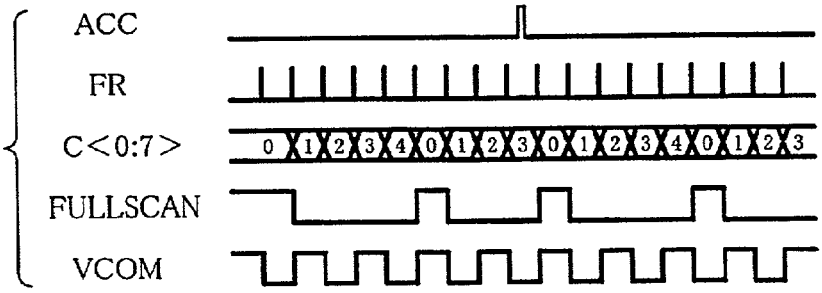

Here, FIG. 25A is a timing chart showing the refresh control by this circuit in the case of the window access when the VCOM has a positive logic at the 2nd frame. FIG. 25B is a timing chart showing the refresh control by this circuit in the case of the window access when the VCOM has a negative logic at the 2nd frame. FIG. 25C is a timing chart showing the refresh control by this circuit in the case of the window access when the VCOM has a positive logic at the 3rd frame. FIG. 25D is a timing chart showing the refresh control by this circuit in the case of the window access when the VCOM has a negative logic at the 3rd frame.

Thus, the logic level of the FULLSCAN is at the "H" at the frame subsequent to the frame of the window access, and the counter value of the FC is reset to "0". From now on, therefore, the full scan is done at a given odd frame period of three or more frames held in the frame interval register from the frame subsequent to the frame of the window access.

2.2.5 Third Method

In the second method, in the case of the window access, the full scan is done at the subsequent frame and is subsequently done for the odd frame periods from the subsequent frame.

In case the frame frequency is especially low, however, the display quality may be degraded for the frame of the window access.

In the third method, therefore, in addition to the second method, the frame of the window access is fully scanned at and after the timing of the window access.

Figure 26:
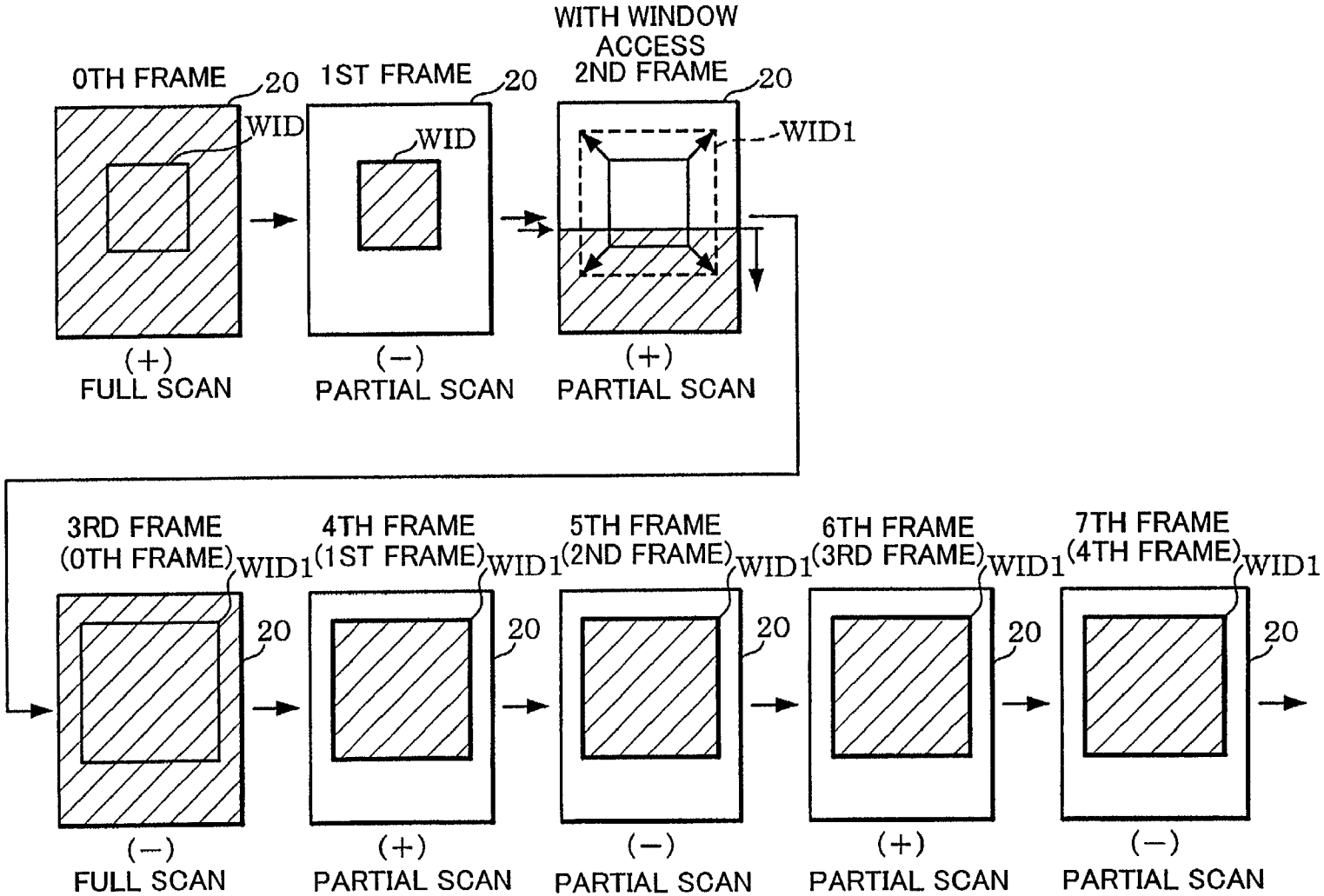
FIG. 26 is an explanatory diagram for explaining the refreshing action of the case with the window access in a third method for realizing the refresh control in this embodiment.

FIG. 26 is a diagram for explaining the refreshing actions of the case in which the window access is made in the third method.

Here is shown the case in which the size is changed from the window WID to a window WID1 for the frame period of the 2nd frame.

In the third method, when the window access is made at the 2nd frame (in the positive polarity (+)) in the partial scan, as described above, the full scan is done at the next 3rd frame (in the negative polarity (−)). If the window access at the 2nd frame of the window access is then timed between the scan timing of the (N0−1)-th line and the scan timing of the N0-th line, the scan lines are scanned and driven at and after the N0-th line irrespective of the display area and the non-display area.

At the 4th to 7th frames (or the 1st to 4th frames) subsequent to the 3rd frame (or the 0th frame), the partial scan is done while inverting the polarities for every frames.

At the next 8th frame, moreover, the counter value is reset again to "0", and the full scan is done in the positive polarity (+) inverted from the negative polarity (−) of the 7th frame. These actions are repeated in the following.

Thus, even in the case of the low frame frequency, the display quality does not become low at the frame of the window access such as the size change. Therefore, it is possible to make compatible the low power consumption resulting from the drop in the frame frequency and the prevention of the drop in the display quality.

Figure 27:
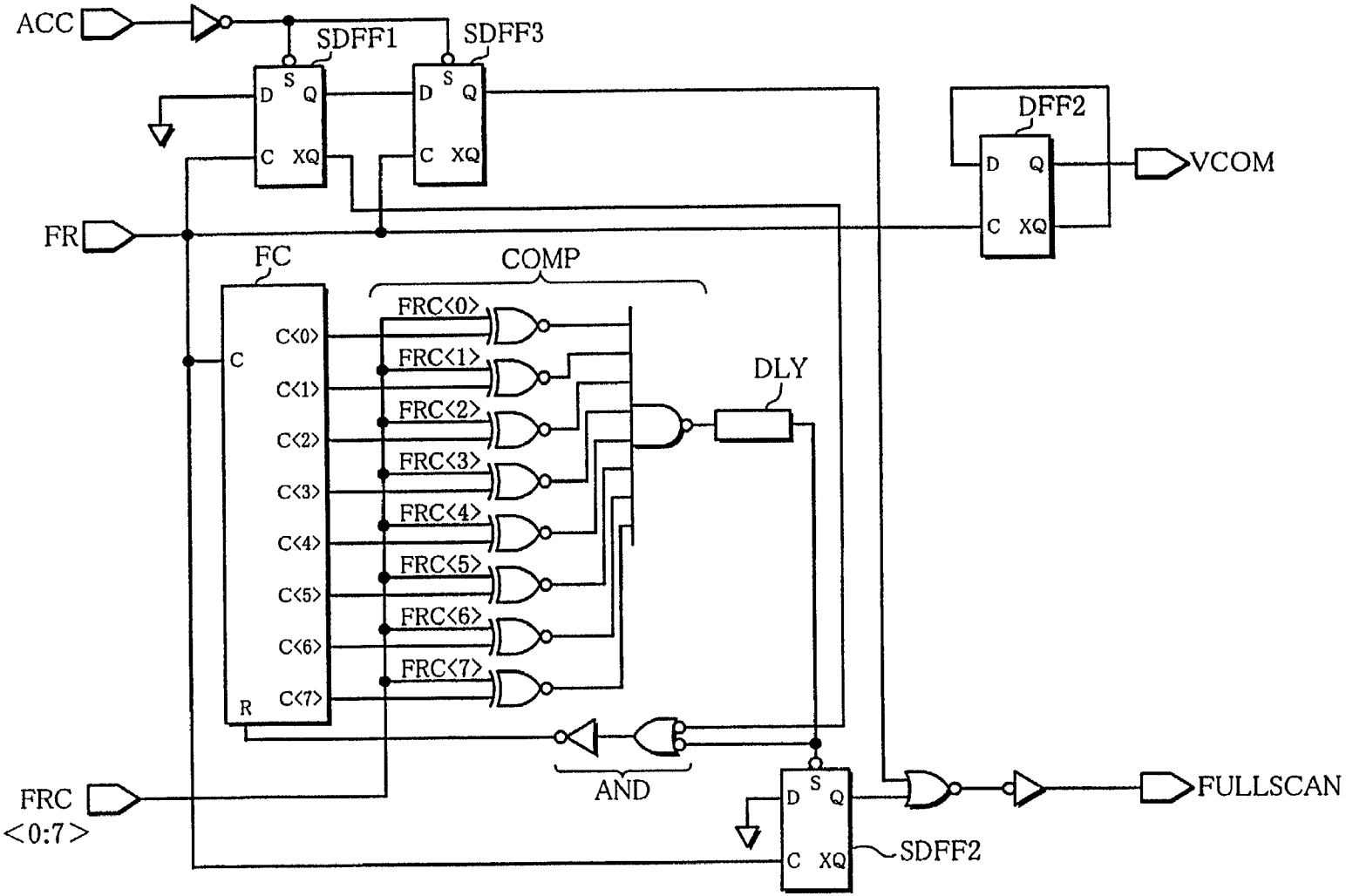
FIG. 27 is one example of a circuit configuration diagram for realizing the third method in this embodiment.

FIG. 27 shows one example of the circuit configuration for implementing the third method.

Note that components corresponding to those in the circuit of FIG. 24 are denoted by the same reference numbers and further description thereof is omitted.

The circuit shown in FIG. 27 is different from that shown in FIG. 24 in that an SDFF3 is provided in place of the DFF1. The S-terminal of the SDFF3 is supplied with the ACC.

With this configuration, the hold data of the SDFF3 are set a synchronously of the FR while being timed with the occurrence of the window access. By the set hold data, moreover, the FULLSCAN is caused to take the logic level "H" midway of the frame of the window access.

FIGS. 28A, 28B, 28C and 28D show timing charts in the circuit shown in FIG. 27.

Figure 28A:
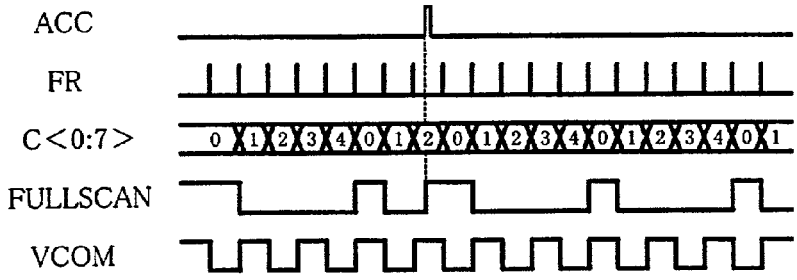
FIGS. 28A, 28B, 28C and 28D are timing charts showing one example of the timing of a circuit configuration diagram for realizing the third method in this embodiment.
Figure 28B:
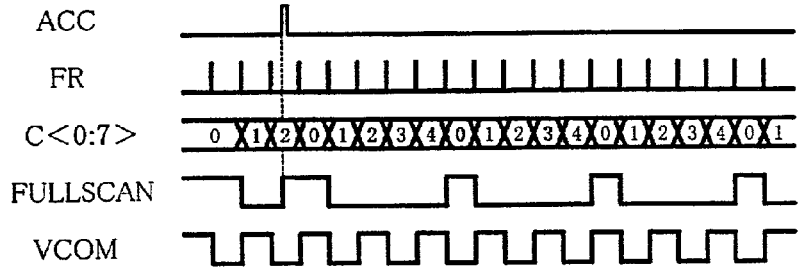
Figure 28C:
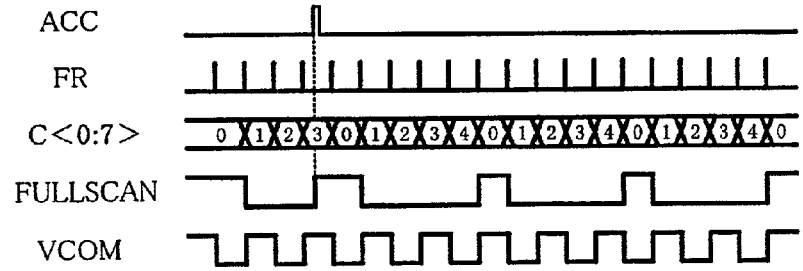
Figure 28D:
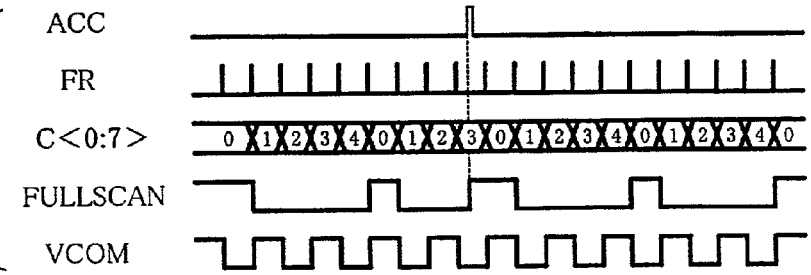

Here, FIG. 28A is a timing chart showing the refresh control by this circuit in the case of the window access when the VCOM has a positive logic at the 2nd frame. FIG. 28B is a timing chart showing the refresh control by this circuit in the case of the window access when the VCOM has a negative logic at the 2nd frame. FIG. 28C is a timing chart showing the refresh control by this circuit in the case of the window access when the VCOM has a positive logic at the 3rd frame. FIG. 28D is a timing chart showing the refresh control by this circuit in the case of the window access when the VCOM has a negative logic at the 3rd frame.

Thus, the logic level of the FULLSCAN is at the "H" at the frame midway of the frame of the window access in synchronism with the ACC. In the next frame, too, the logic level of the FULLSCAN is also at the "H", and the counter value of the FC is reset to "0".

At the frame of the window access, therefore, the scan lines at and after the window access timing are scanned and driven irrespective of the display area and the non-display area. From now on, the full scan is done for the odd frame period held in the frame interval register from the frame subsequent to the frame of the window access.

Here, the circuit for specifying the third method can be made in the following manner. At the time of the window access when the full scan is done for the N1 (odd) frame period, for example, the frame counter is not reset in its counter value but is forcibly loaded with (N1−1). At the next frame, therefore, the counter value of the frame counter can be reset for the actions similar to those of the aforementioned circuit.

Figure 29:
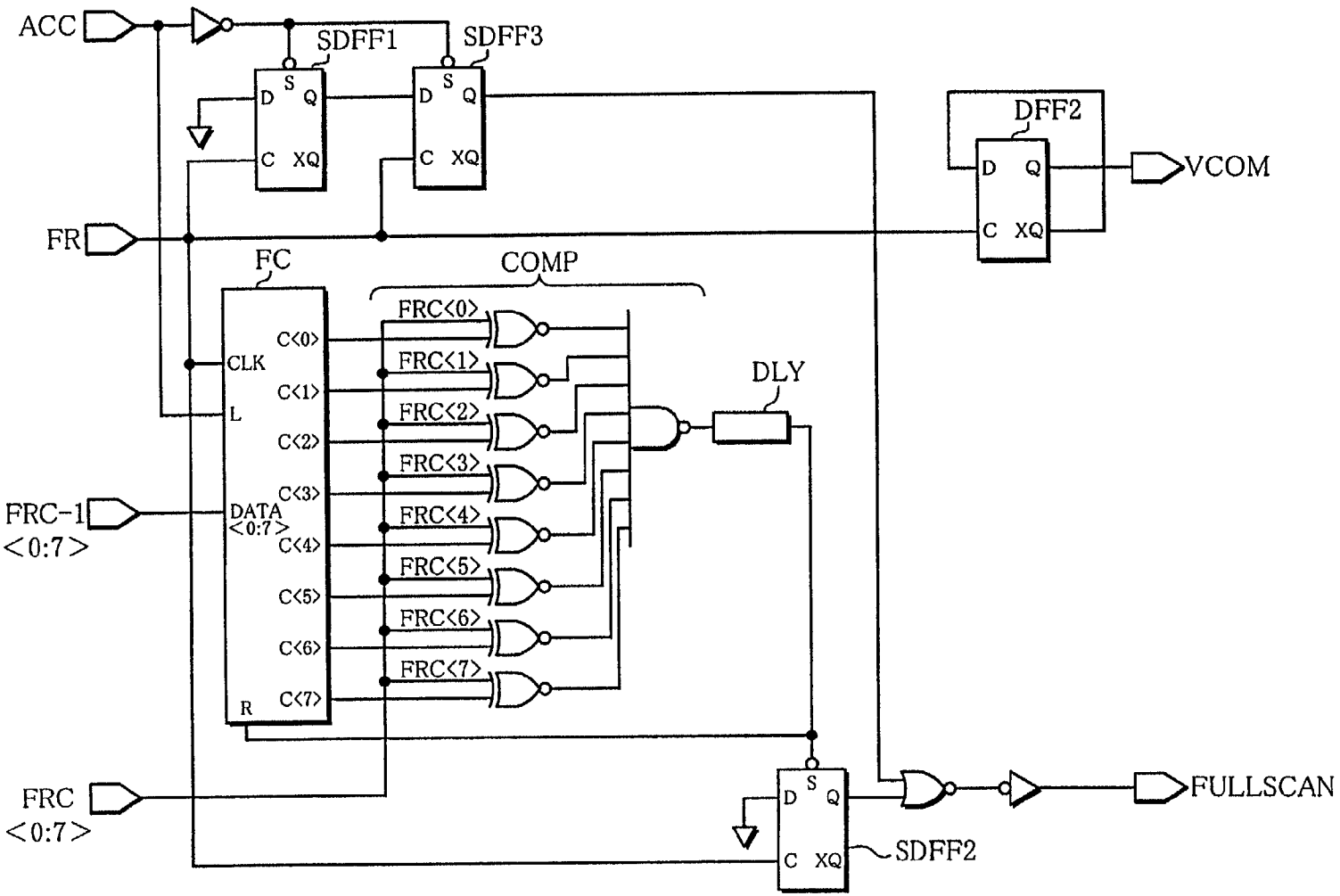
FIG. 29 is a modification of the circuit configuration diagram for realizing the third method in this embodiment.

FIG. 29 shows a modification of circuit configuration for implementing the third method.

Note that components corresponding to those in the circuit of FIG. 27 are denoted by the same reference numbers and further description thereof is omitted.

The circuit shown in FIG. 29 is different from the circuit shown in FIG. 27 in that the FC is provided with the load (L) terminal and the DATA<0:7> terminal to supply the output of the DLY to the S-terminal of the SDFF2 and the R-terminal of the FC.

The L-terminal of the FC is supplied with the ACC. The DATA<0:7> terminal of the FC is supplied with the FRC-1<0:7>. The FRC-1<0:7> is 8-bit data which are calculated by subtracting only 1 from the 8-bit data expressed by the FRC<0:7>.

The FC loads the internal counter value with the 8-bit data inputted to the DATA<0:7> terminal when the signal inputted to the L-terminal takes the logic level "H".

With this configuration, too, the hold data of the SDFF3 are set a synchronously of the FR while being timed with the window access. By the set hold data, moreover, the FULLSCAN takes the logic level "H" midway of the frame of the window access.

At the next frame of the window access, moreover, the FC takes the counter value "0", and the FULLSCAN takes the logic level "H".

2.3 Window Management

As described hereinbefore, the LCD controller 60 in this embodiment is enabled to do the window display by setting the display area and the non-display area individually for the signal driver 30 and the scan driver 50.

In this embodiment, in order to manage one or more windows on the screen of the LCD panel 20, the RAM 64 is stored thereon with the window management data (or partial display control data in a wide sense) so that the display controls of the individual windows are made on the basis of those window management data. More specifically, the window management data are made to correspond to the display areas of the LCD panel 20 so that one or more windows to be displayed on the LCD panel 20 are managed on the basis of the window management data corresponding to the display areas.

For example, the display of the LCD panel 20 corresponding to the address, at which the window management data are set at "1" can be positioned in the display area, and the display of the LCD panel 20 corresponding to the address, at which the window management data are set at "0" can be positioned in the non-display area.

In this embodiment, the display controls of the individual windows are performed on the basis of those window management data in units of area blocks or line blocks divided at every eighth scan line specified by the band partial data, depending on the action mode.

Figure 30A:
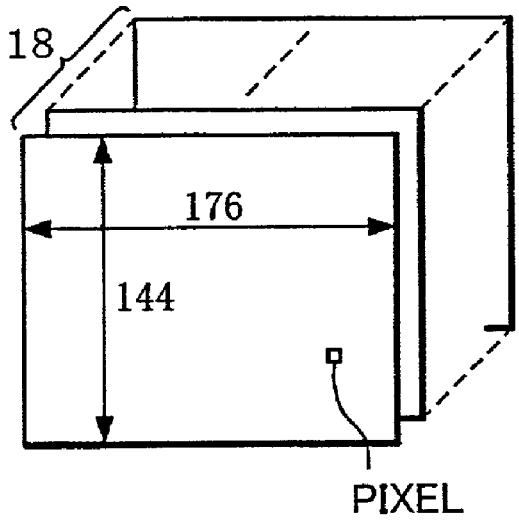
FIGS. 30*a*, 30B and 30C are explanatory diagrams for explaining window management data in individual action modes.
Figure 30B:
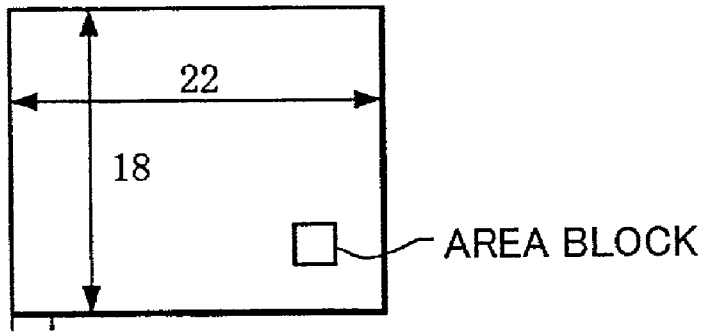
Figure 30C:
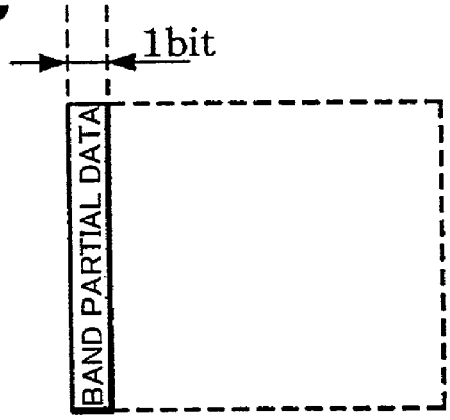

FIGS. 30A, 30B and 30C are schematic diagrams for explaining the window management data in the individual action modes.

Here, it is assumed that the screen size (or the display area) of the LCD panel 20 has 176×144 pixels.

When the display area or the non-display area set for the screen of the LCD panel 20 is set at the pixel unit, for example, the LCD controller 60 has to retain a memory area of 18 bits (i.e., 6 bits (gradation data)×3 (individual RGB colors)) of the image data for 176×144 pixels.

In the first mode set by the mode setting register 336 in this embodiment, on the other hand, the display area or the non-display area is specified in units of area blocks for the screen of the LCD panel 20.

Here, the area block is given a unit of the area, in which the signal lines are divided in units of eight pixels whereas the scan lines are divided in units of eight lines.

As shown in FIG. 30B, therefore, the LCD controller 60 retains a memory area of the image data for 22×18 area blocks. It is, therefore, it is possible to drastically reduce the memory area to be retained in the RAM 64.

In the second mode to be set by the mode setting register 336, on the other hand, the display area or the non-display area to be set for the screen of the LCD panel 20 is specified in units of eight scan lines only in the array direction of the scan lines by the band partial data.

As shown in FIG. 30C, therefore, the LCD controller 60 holds the band partial data for the 18 line blocks in the band partial data register 338 of the control register 330. Therefore, it is unnecessary to keep the memory area in the RAM 64.

2.3.1 First Mode

In the first mode, on the basis of the window management data managed in units of area blocks, the window is displayed at the corresponding position of the display area of the LCD panel 20.

Figure 31:
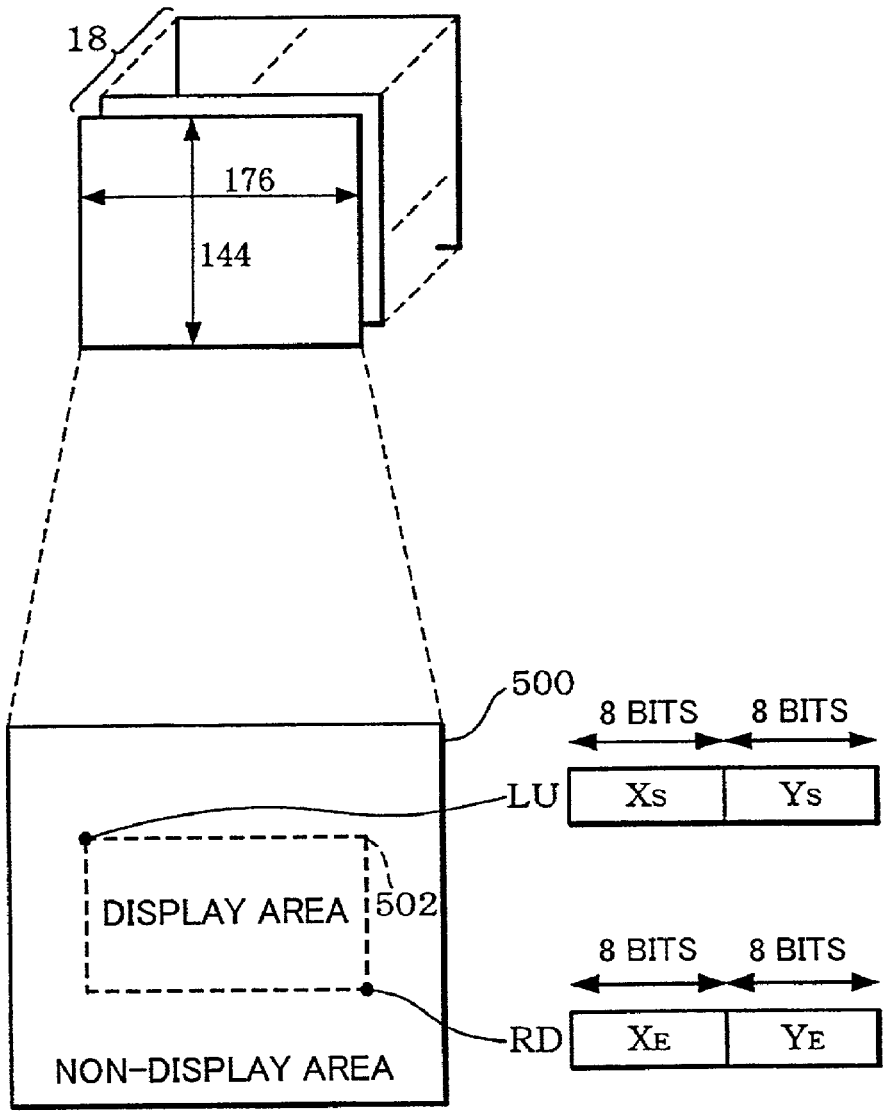
FIG. 31 is an explanatory diagram for explaining the case in which the window is managed at a pixel unit.

The coordinates specification performed when the window display is based on the window management data managed in units of pixels is schematically illustrated in FIG. 31 as a comparison example.

In this case, the LCD controller 60 specifies the lefthand upper coordinates LU ($X_S$, $Y_S$) and the right hand lower coordinates RD ($X_E$, $Y_E$) of a display area 502 so that a rectangular window may be displayed in the display area 502 of a display area 500 of the LCD panel 20.

In case the window management data are managed in units of pixels, therefore, the bit number necessary for specifying the individual coordinates is "8" so as to specify 176×144 pixels. In other words, at least 32 bits (i.e., (8 bits+8 bits)×2) are necessary for setting the display area 502. In case three windows can be simultaneously managed with the window management data, 96 bits are necessary for setting the display area.

Figure 32:
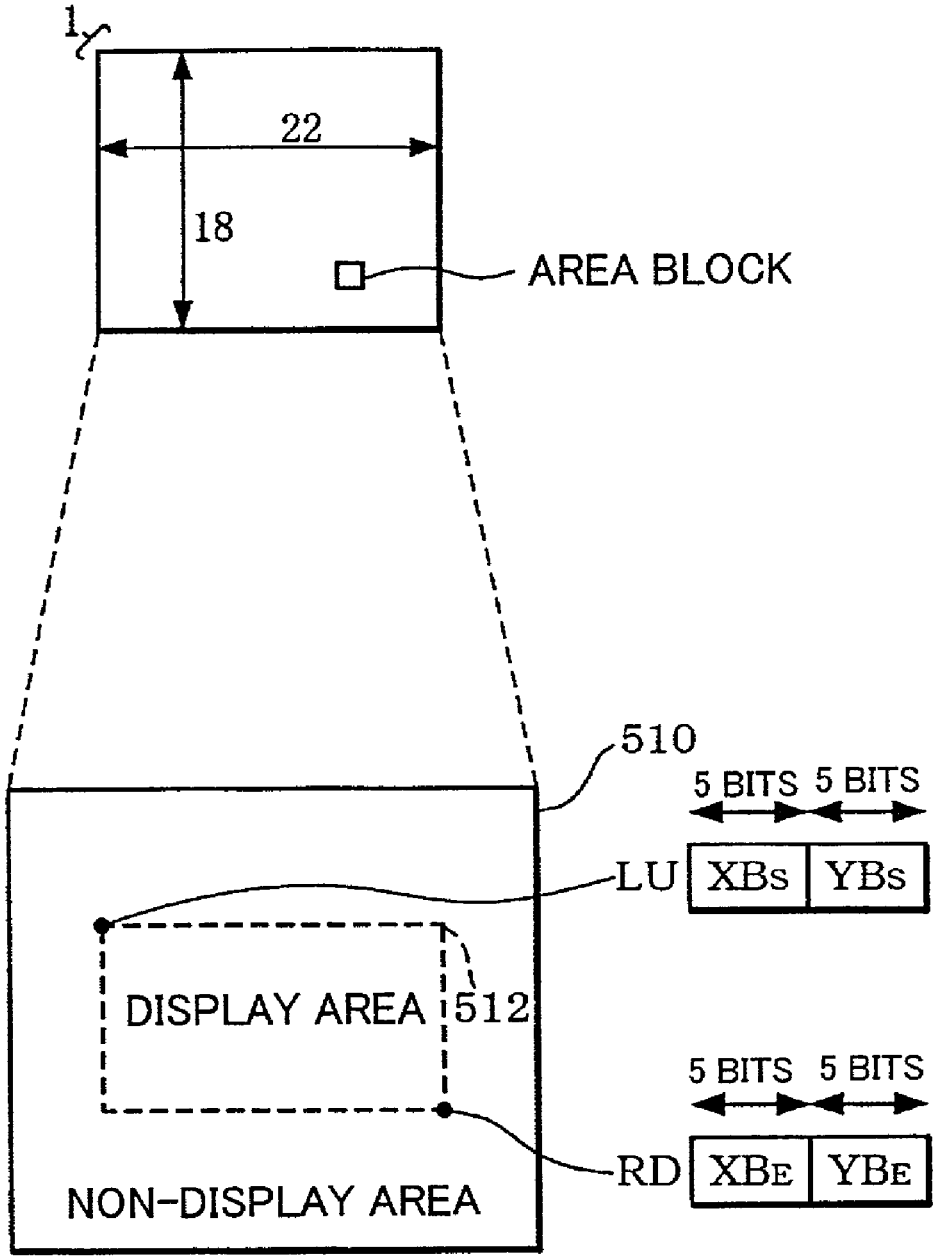
FIG. 32 is an explanatory diagram for explaining the case in which the window is managed at an area block unit.

FIG. 32 schematically illustrates the coordinates specification in the first mode when the window display is based on the window management data to be managed in units of the area blocks.

In the first mode, the LCD controller 60 specifies the leftward upper coordinates LU ($XB_S$, $YB_S$) and the rightward lower coordinates RD ($XB_E$, $YB_E$) so that a rectangular display window may be displayed in a display area 512 of a display region 510 of the LCD panel 20.

The window management data (or the area-block-display control data) to be managed in units of area blocks have a bit number "5" necessary for each coordinate position so as to specify any of the 22×18 area blocks. In other words, at least 20 bits ((5 bits+5 bits)×2) are necessary for setting the display area 512. If three windows are simultaneously managed by the window management data, 60 bits are sufficient for setting the display area so that the window specification can be made more efficient than that of the case in which the window is managed at the pixel unit.

Figure 33:
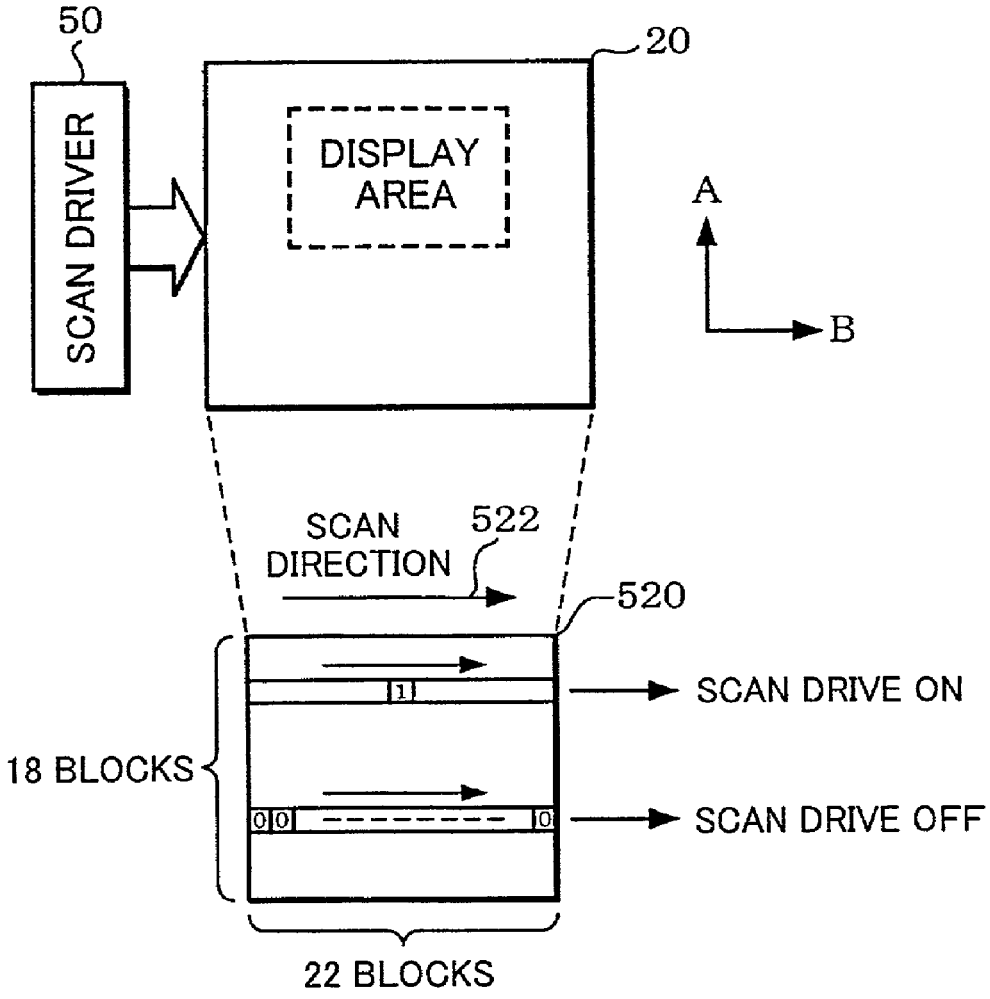
FIG. 33 is an explanatory diagram for explaining a scan drive control of the case in which the window is managed in units of area blocks.

Here, in case the scan lines are extended in the B-direction of the LCD panel 20, it is assumed that the scan driver 50 for scanning and driving the scan lines is arranged at a position shown in FIG. 33 with reference to the LCD panel 20.

At first, the LCD controller 60 is set by the host with the window management data corresponding to the display area or the non-display area.

The LCD controller 60 for making the aforementioned partial display control scans the window management data 520 set at each area block unit, along a scan direction 522.

In case at least one area block set with "1" exists when the window management data 520 are scanned for each line along the scan direction, the command sequencer (or the scan drive circuit setting section and the signal drive circuit setting section in a wide sense) 70 of the LCD controller 60 decides that the scan drive of the corresponding scan line is ON, and sets the display area for the scan driver 50 and the signal driver 30. More specifically, the command sequencer 70 sets the partial scan display select register of the scan driver 50 on the basis of the partial scan display data 322, and sets the block output select register and the partial display select register of the signal driver 30 on the basis of the block output select data 31 and the partial scan data 314. Moreover, the command sequencer 70 supplies the scan enable input/output signal GEIO to the scan driver 50 in accordance with the scan timing of the scan lines, and supplies the image data sequentially for one scan line to the signal driver 30 for a given horizontal scan period.

In case all the area blocks of one line are set at "0" when the data are scanned along the scan direction 522, on the other hand, it is decided that the scan drive of the corresponding scan line is OFF. For the LCD panel 20, as described above, it is necessary that the scan drive is periodically made to release the electric charge stored in the liquid crystal capacitor, by the leakage of the TFT. Therefore, the scan line, as decided at the scan drive OFF, is scanned and driven for an arbitrary odd frame period from a given reference frame but is not for the remaining periods. Therefore, the LCD controller 60 (or the command sequencer 70) supplies the output enable signal XOEV only for the scan drive period in accordance with the scan timing of the corresponding scan line.

Here, the reference frame is the frame which corresponds to the access timing to any of the aforementioned signal driver setting register 310, canning driver setting register 320 and control register 330 at the event of the generation, extinguishment or change of the widow. In other words, from the frame for which the displayed window is changed, the scan lines of the non-display area are scanned and driven for an arbitrary odd frame period by making an access to those various registers.

Here, the signal driver 30 and the scan driver 50 are controlled in their outputs in units of 24 outputs and 8 scan line outputs, as described hereinbefore, so that the windows are specified in units of 24 outputs or 8 scan lines. Although not limited thereto, however, the LCD controller 60 can also manage the window management data at the pixel unit.

Here, it has been described that the each line block or the output control section of the signal driver 30 and the scan driver 50 has the unit of 24 outputs or 8 scan lines. Although not limited thereto, however, the unit of 24 or less outputs or 8 or less scan lines can be used for each line block.

2.3.2 Second Mode

Figure 34:
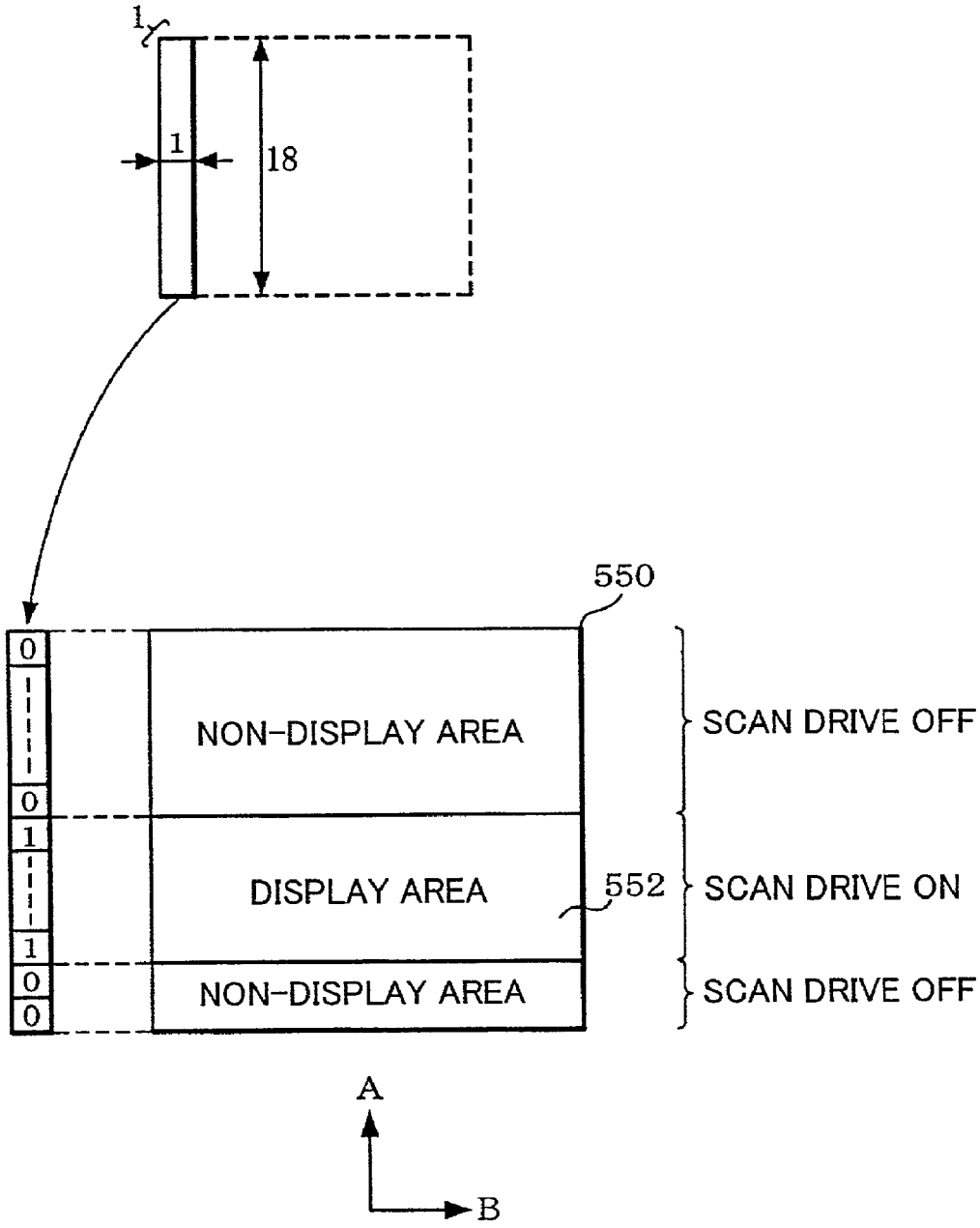
FIG. 34 is an explanatory diagram for explaining the case in which the window is managed with band partial data.

FIG. 34 schematically shows the coordinates specification in the second mode when the window display is based on the band partial data.

In the second mode, the LCD controller 60 sets the display area or the non-display area in units of 8 scan lines based on the band partial data (or the band-partial-display control data) so as to set a display area 552 in a display region 550 of the LCD panel 20.

In order to set the display area 552, therefore, the necessary bit number is only 1 bit in units of 8 scan lines. As a result, it is possible to drastically reduce the bit number for setting the display area.

Here, it is assumed that the scan lines are extended in the B-direction of the LCD panel 20, as shown in FIG. 33. At first, the LCD controller 60 is set by the not-shown host with the band partial data corresponding to the display area or the non-display area.

In the second mode, the LCD controller 60 for the aforementioned partial display control refers to the band partial data, and decides that the scan drive of the scan line of the line block set at "1" is ON. In this case, the command sequencer (or the scan drive circuit setting section in a wide sense) 70 of the LCD controller 60 sets the display area for the scan driver 50. More specifically, the command sequencer 70 sets the partial scan display select register of the scan driver 50 on the basis of the partial scan display data 322. Moreover, the command sequencer 70 supplies the scan enable input/output signal GEIO to the scan driver 50 in accordance with the scan timing of the corresponding scan line. The command sequencer 70 supplies the image data sequentially for each scan line to the signal driver 30 for a given horizontal scan period.

On the other hand, it is decided that the scan drive of the corresponding scan line of the line block set with the band partial data at "0" is OFF. For the LCD panel 20, as described above, it is necessary that the scan drive is periodically made to release the electric charge stored in the liquid crystal capacitor, by the leakage of the TFT. Therefore, the scan line, as decided at the scan drive OFF, is scanned and driven for an arbitrary odd frame period from a given reference frame but is not for the remaining periods. Therefore, the LCD controller 60 (or the command sequencer 70) supplies the output enable signal XOEV only for the scan drive period in accordance with the scan timing of the corresponding scan line.

The LCD controller 60 in this embodiment contemplates to make the memory capacitor efficient and to simplify the display window specification by realizing the mode switching by such mode setting register 336.

2.4 Generation of Standard Data

The LCD controller 60 sets the display area for the signal driver 30 and the scan driver 50, as described above, and supplies the signal driver 30 with the image data corresponding to that display area. These image data is generated by the user, for example, and are supplied to the LCD controller 60.

Here, the aforementioned signal driver 30 is enabled to correspond to the change in the panel size of the LCD panel 20 by the block output select data. Therefore, no signal drive is done on the signal lines of the unnecessary line block. In case the generated image data are supplied to the LCD controller 60, therefore, the user is required to grasp what line block the signal drive is not done on its signal lines for. In other words, the user has to work the generated image data and to supply them to the LCD controller 60 so that the normal image can be displayed when the signal drive is done while excluding that line block.

In order to improve the usability for the user, therefore, the LCD controller 60 in this embodiment is enabled to generate the image data for the signal driver 30 in accordance with the block output select data. As a result, the user may supply the generated image data as they are to the LCD controller 60 without recognizing the block output select data set in the signal driver 30 (that is, without grasping what line block the signal drive is not done for).

This point will be specifically described in the following.

Here, it is assumed that the display region of the LCD panel 20 is divided into six line blocks in the B-direction so that no consideration is made on the A-direction. It is also assumed that the signal driver 30 can drive the signals of the signal lines of the eight line blocks divided in units of 24 outputs, for example.

Figure 35:
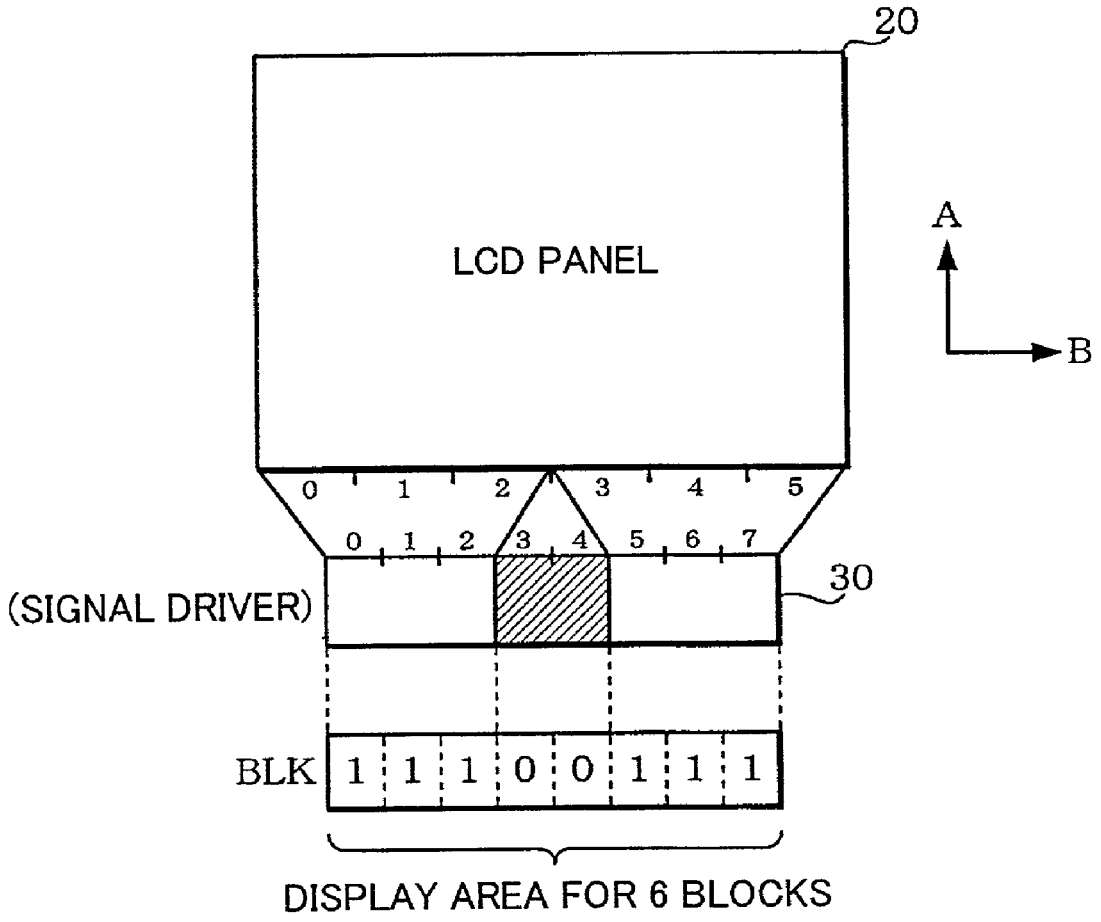
FIG. 35 is an explanatory diagram showing one example of the packaged state of the signal driver.

When the signal drive is done by the signal driver 30 for the LCD panel 20, the two line blocks in the vicinity of the center are eliminated from the block output select data so as to drive the signal lines of the six line block. As shown in FIG. 35, more specifically, the display area of "11100111" is set by the block output select data, for example, when the system is ON.

Therefore, the signal driver 30 drives only the signal lines of the BLK0 to BLK2 and BLK5 to BLK7, and sets the outputs of the signal line drive circuit of the BLK3 and BLK4 to a high impedance state. The BLK0 to BLK2 and the BLK5 to BLK7 of the signal driver 30 drive the signal lines of the block numbers 0 to 5 of the LCD panel 20, respectively.

Here is considered the case in which the user generates the image data of four line blocks in the B-direction for the LCD panel 20.

Figure 36:
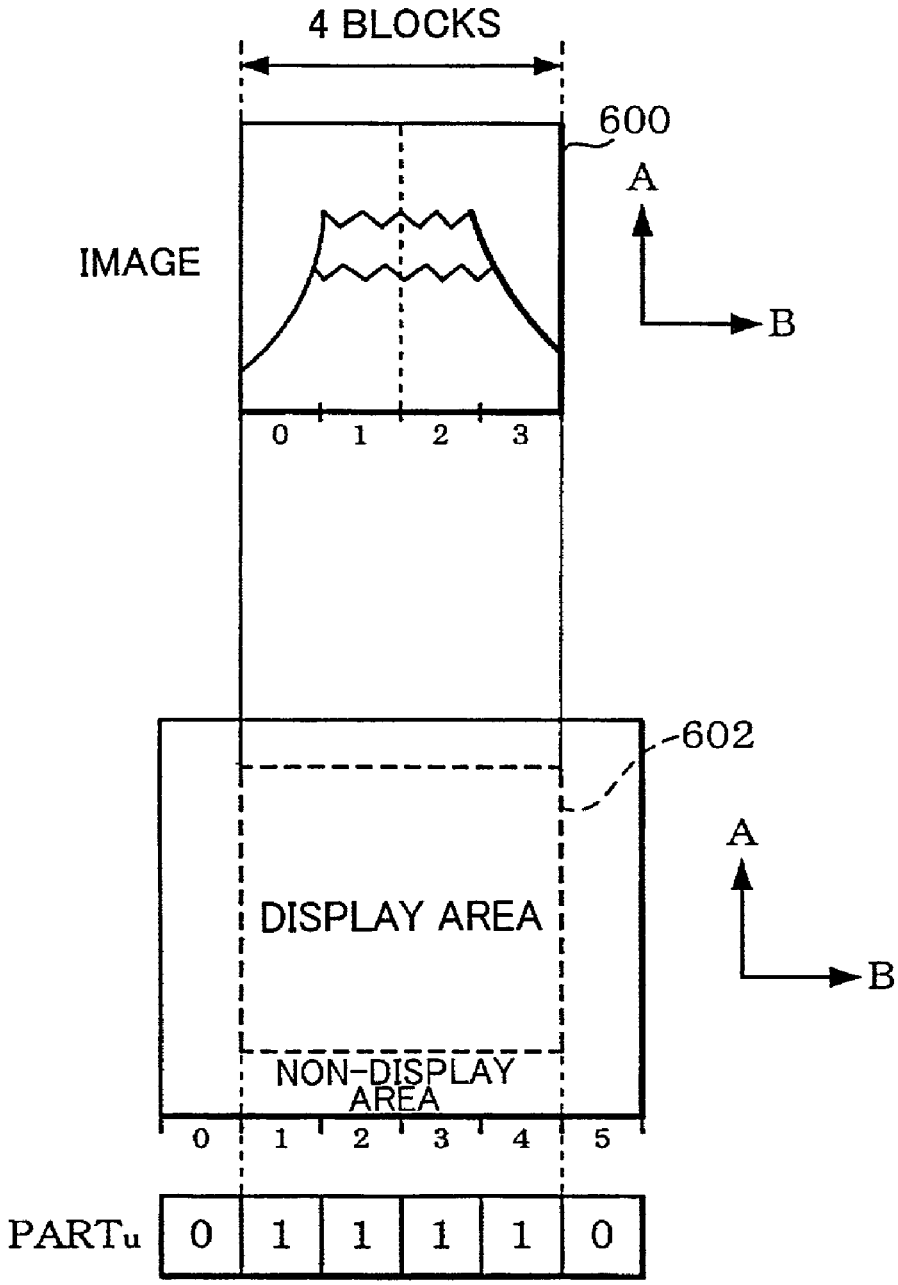
FIG. 36 is an explanatory diagram for explaining the partial display data corresponding to an image generated by the user.

FIG. 36 schematically shows a picture image which is created by the user, for example.

When the user creates a picture image of one frame for four line blocks in the B-direction and displays the image in a display area 602 of the display region of the LCD panel 20, the user sets the line block corresponding to the display area to "1" for the partial display data of the six line blocks or the display region.

Generally, the user (or the image developer) does not grasp what line block is to be used for the signal driver 30 to drive the signal of the LCD panel 20. This is because what signal line of the signal driver 30 for driving the signal of the LCD panel 20 is to be used is arbitrarily determined by the designing plane on the maker side. Therefore, the user sets the totally four line blocks of block numbers 1 to 4 of the block numbers 1 to 5, as the display area. In short, the user sets "011110" as partial display data PARTu.

Figure 37:
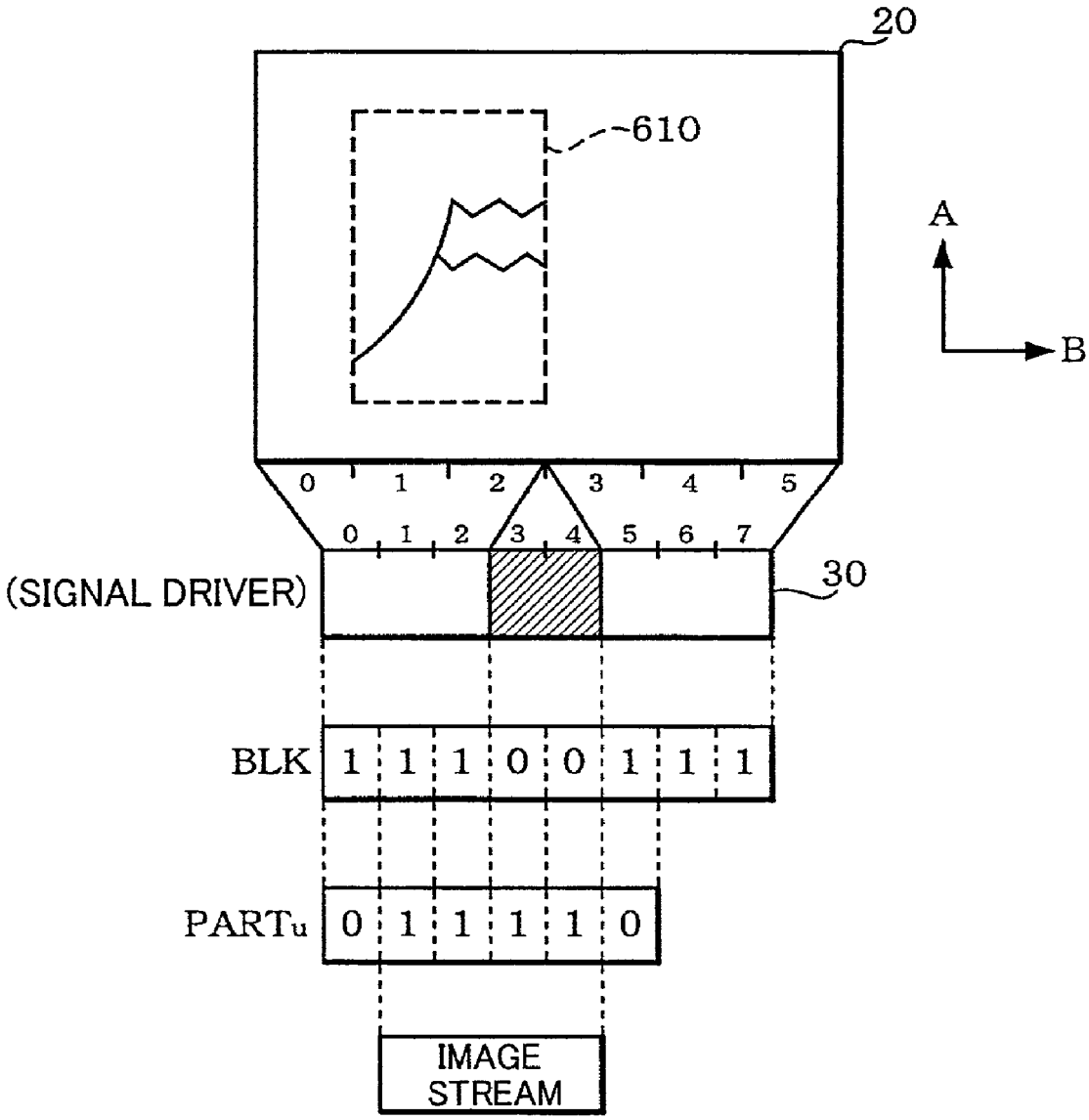
FIG. 37 is an explanatory diagram for explaining relations between the partial display data corresponding to the image created by the user and block output select data.

In this case, as shown in FIG. 37, the display area set by the user is superposed over the BLK3 and BLK4 of the signal driver 30 by the partial display data PARTu. Even if an image stream (or image data) is supplied to correspond to the partial display data PARTu, therefore, only the line block, for which both the block output select data and the partial display data are set to "1", is driven so that an image 610 is displayed.

In this embodiment, therefore, the partial display data PARTu corresponding to the line block set at "0" in the block output select data can be shifted to display the image corresponding to the display area correctly without any consideration of the user into the set value of the block output select data. Correspondingly, moreover, the image stream is shifted to generate an image stream of the standard format.

Figure 38:
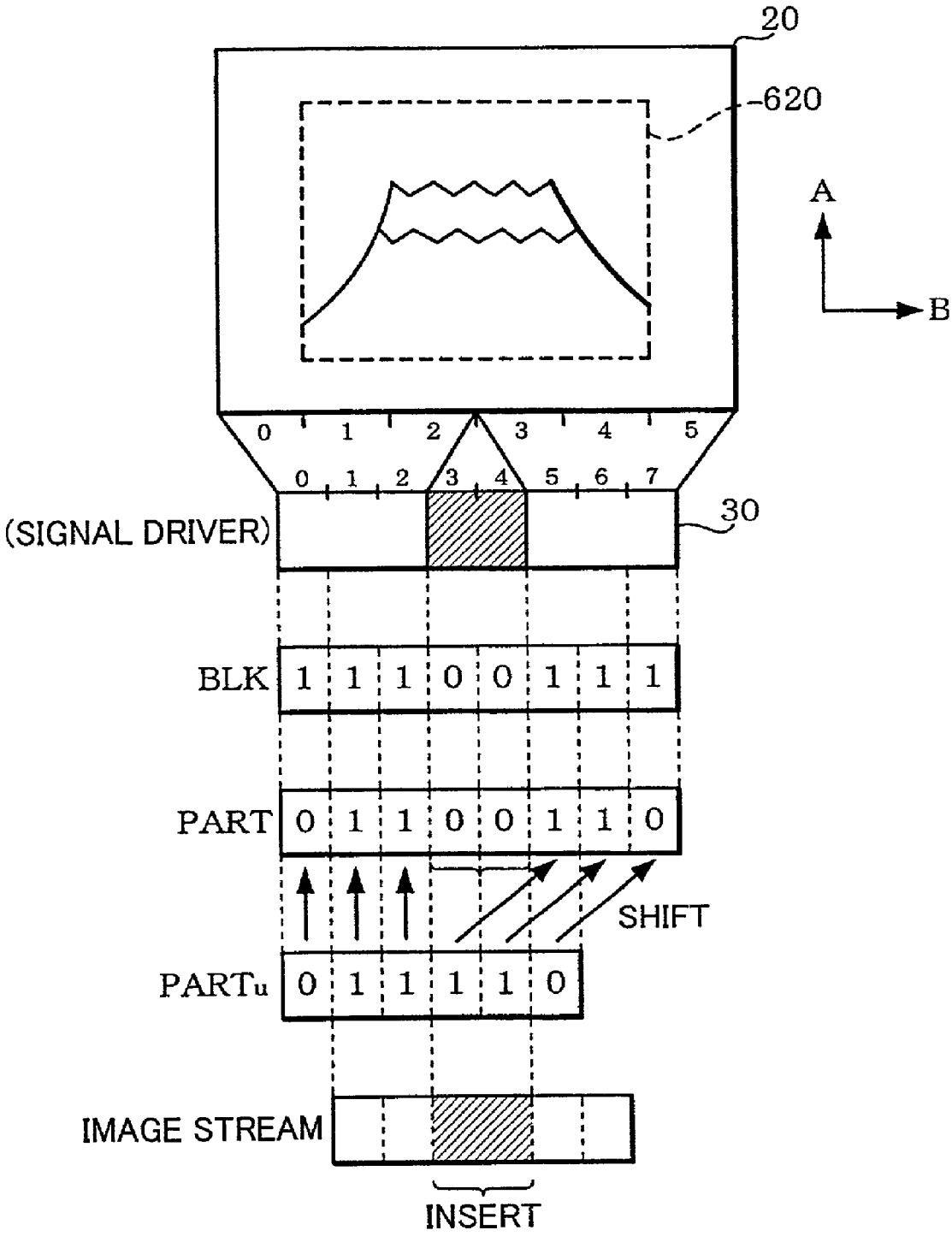
FIG. 38 is an explanatory diagram for explaining the necessity for converting the partial display data corresponding to the image created by the user, on the basis of the block output select data.

As shown in FIG. 38, more specifically, the partial display data PARTu corresponding to the line block set at "0" with the block output select data are converted into the partial display data PART which are shifted to the line block set at "1" with the block output select data. Moreover, these partial display data PART are supplied to the signal driver 30. Still moreover, dummy image data are inserted into the image stream corresponding to the position which has been shifted at the conversion time. Thus, the signal lines of the block numbers 3 and 4 of the LCD panel 20 can be driven on the basis of the image stream corresponding to the BLK 5 and BLK6 of the signal driver 30 so that a correct image 620 can be displayed in the display area.

Therefore, the LCD controller 60 in this embodiment includes a partial display data conversion circuit for converting the partial display data PART from the partial display data PARTu.

Figure 39:
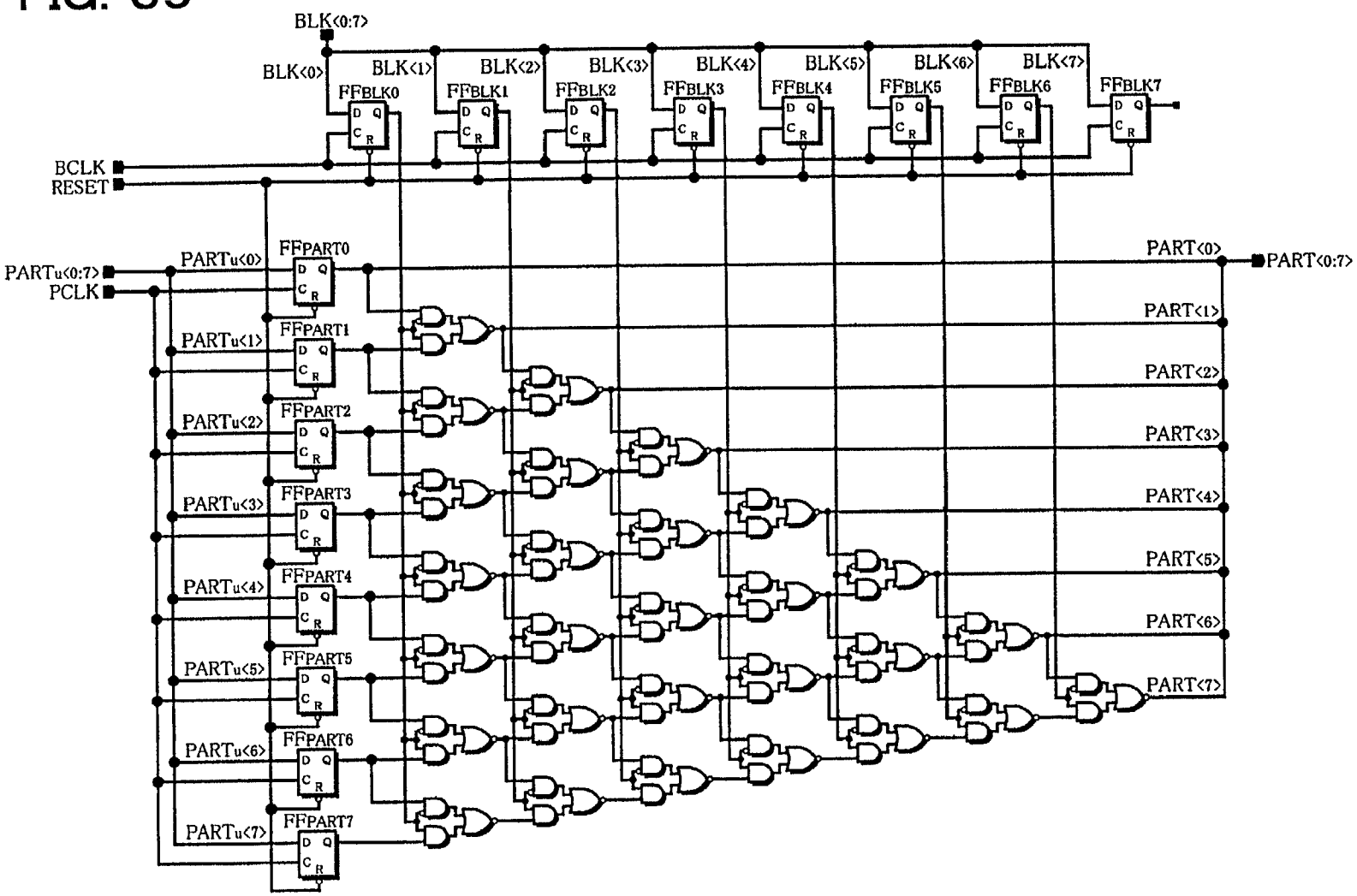
FIG. 39 is a configuration diagram showing one example of the configuration of a partial display data conversion circuit.

FIG. 39 shows one example of the partial display data conversion circuit.

$FF_{BLK0}$ to $FF_{BLK7}$ are reset with a reset signal RESET to latch totally eight bits of block output select data BLK<0:7> individually in synchronism with the clock signal BCLK.

$FF_{PART0}$ to $FF_{PART7}$ are reset with the reset signal RESET to latch totally eight bits of partial display data PARTu<0:7>, as set by the user, individually in synchronism with a clock signal PCLK.

The Q-terminals of the $FF_{BLK0}$ to $FF_{BLK7}$ and the $FF_{PART0}$ to $FF_{PART7}$ are connected with a selector circuit SEL.

The selector circuit $SEL_{ab}$, as connected with the Q-terminals of the $FF_{BLKa}$ and $FF_{PARTb}$ selects and outputs the partial display data outputted from the Q-terminal of the $FF_{PARTa-1}$, when the block output select data outputted from the Q-terminal of the $FF_{BLKa}$ are "0". The selector circuit $SEL_{ab}$ connected with the Q-terminals of the $FF_{BLKa}$ and $FF_{PARTb}$ selects and outputs the partial display data outputted from the Q-terminal of the $FF_{PARTa}$, when the block output select data outputted from the Q-terminal of the $FF_{BLKa}$ are "1".

For the line block in which the block output select data are set at "0", therefore, there are generated the partial display data PART (or the second partial display data), to which the partial display data PARTu (or the first partial display data) are sequentially shifted.

The LCD controller 60 (or the command sequencer (or the block output select data setting section and the partial display data setting section in a wide sense) 70 sets not only the block output select data but also the partial display data PART for the corresponding data of the signal driver 30.

Likewise, the image data generation circuit 300 generates the image data, in which the dummy image data are inserted into that shifted line block, and supplies the image stream of the eight line blocks of the standard format to the signal driver 30.

When the P-th block set in the display area with the partial display data PARTu (or the first partial display data) by the user, for which the display area or the non-display area was designated, is specified as the line block which is not driven by the block output select data, more specifically, the image data generation circuit 300 converts the image data corresponding to the P-th block of the image data to be supplied to the signal driver 30, into the image stream shifted as the image data of the (P+1)-th block. Moreover, this converted image stream is supplied by the command sequencer 70.

Without recognizing the set value of the block output select data, as described above, the user can display the correct image in the display area set by using the signal driver 30 which can be softly adapted to the panel size of the LCD panel 20.

2.5 Command Transmission

The LCD controller 60 can supply the image stream to the signal driver 30 in the following manner.

Figure 40A:
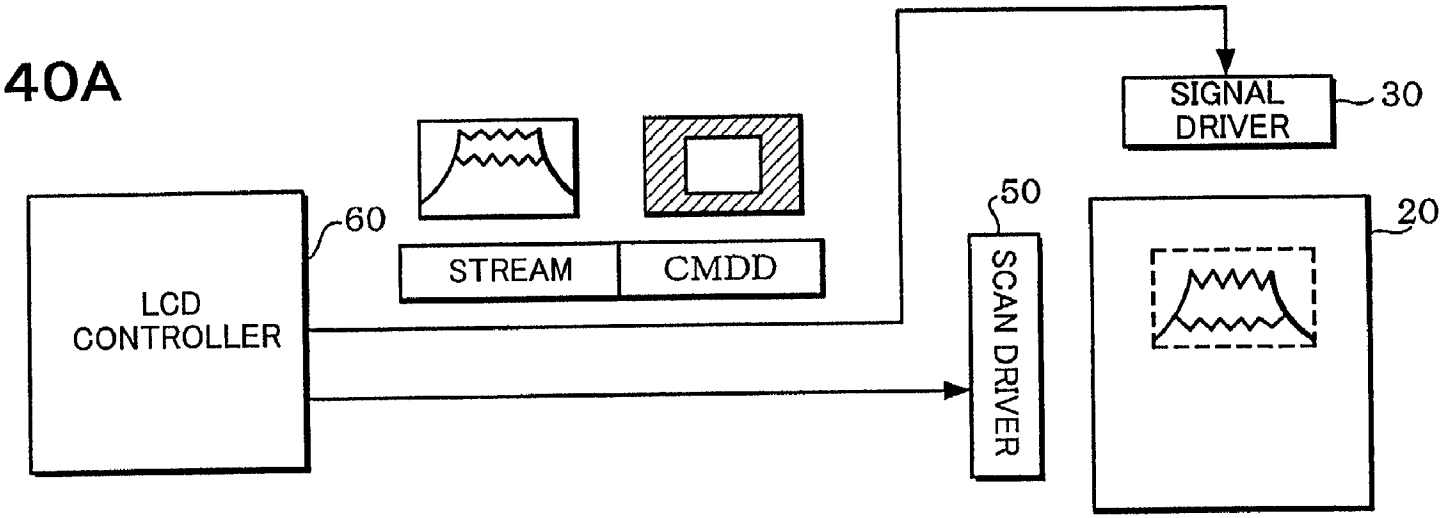
FIG. 40A is an explanatory diagram for schematically explaining the case in which a series of image stream is supplied after a command setting a display area was transmitted.
Figure 40B:
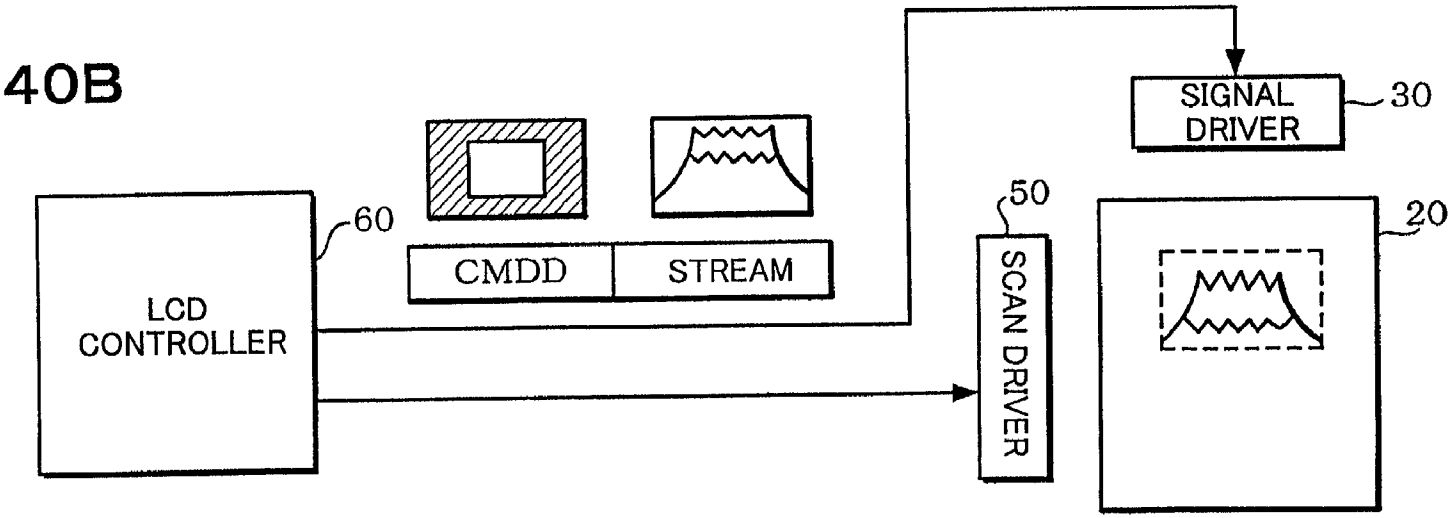
FIG. 40B is an explanatory diagram for schematically explaining the case in which the command setting the display area is supplied after the series of image stream was transmitted.

More specifically, a serial image stream may be provided before or after the transmission of a command (CMDD) which sets the display area, as shown in FIGS. 40A and 40B. The command (CMDD) may include the settings of the block output select register and the partial display select register of the signal driver 30, for example.

In case the serial image stream is provided after the command (CMDD) which sets the display area is transmitted, as shown in FIG. 40A, what is provided is only the image data corresponding to the display area, so that the amount of the image data to be provided can be reduced. Moreover, since the image stream is provided after the command transmission, the fetch of the image data for the non-display area set by the command can be avoided, leading to the power consumption.

If the command (CMDD) which sets the display area is transmitted after the serial image stream is sent, as shown in FIG. 40B, it is necessary to provide image data for the whole area of the display region. However, since the generation steps of the image data can be simplified, the image data is stably provided even when the processing time period is shortened as the frame frequency becomes the higher or as the image size becomes the larger.

2.6 One Example of Display Control Timing

Here will be specifically described one example of the partial display control by the LCD controller 60 in this embodiment.

Figure 41:
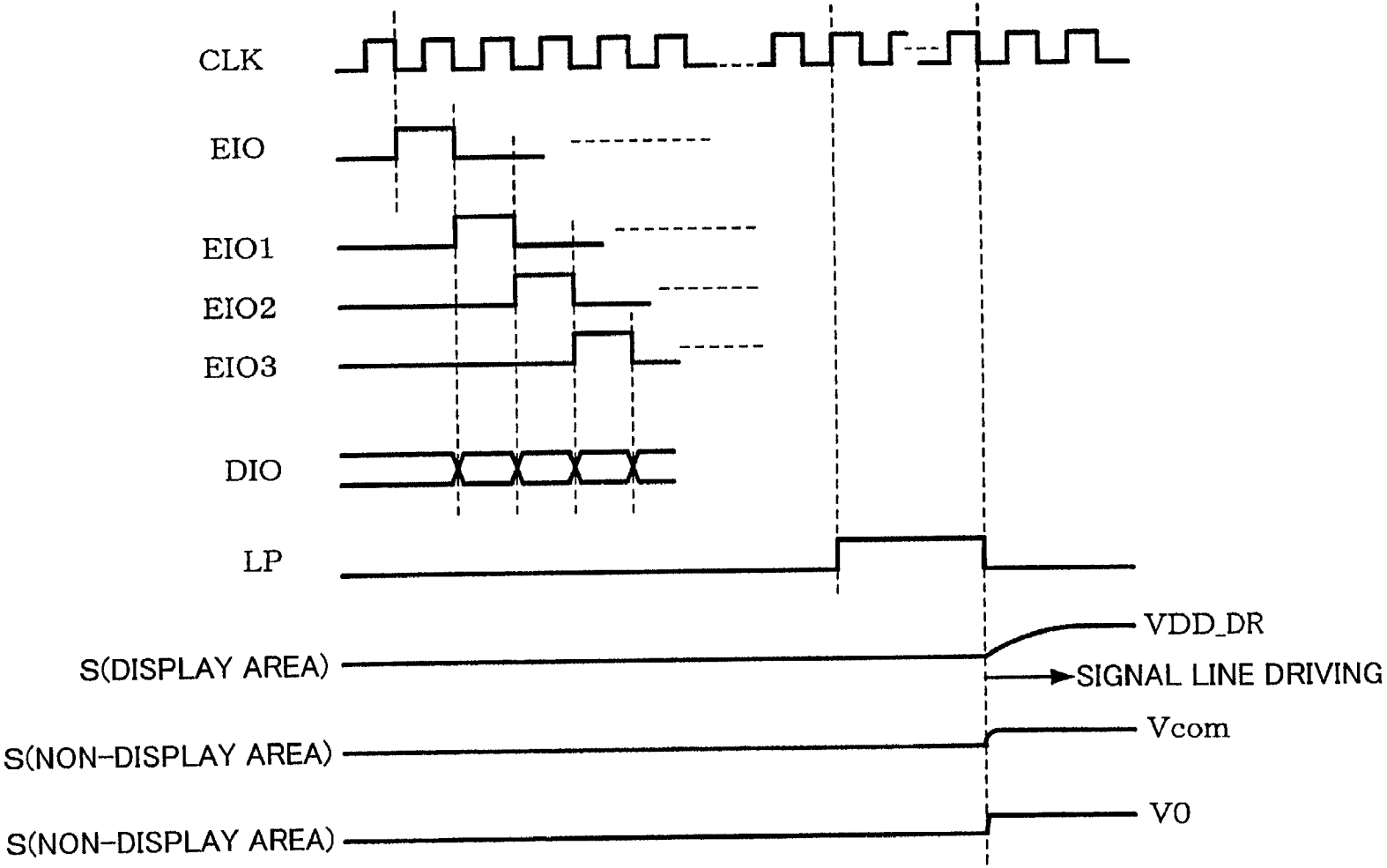
FIG. 41 is a timing chart showing one example of action timings of the signal driver which was controlled on its partial display by the LCD controller in this embodiment.

FIG. 41 shows one example of the action timings of the signal driver 30 controlled on its partial display by the LCD controller 60 in this embodiment.

In the signal driver 30 for which the display area or the non-display area is specified in units of the line blocks by the LCD controller 60, as described above, in synchronism with the clock signal CLK, the enable input/output signal EIO is shifted, and the shift register generates EIO1 to EIOL (L indicates a natural number of 2 or more). In synchronism with the individual EIO1 to EIOL, moreover, the image data (DIO) are sequentially latched by the line latch.

In synchronism with the rise of the horizontal synchronizing signal LP, the line latch 36 latches the image data at one horizontal scan unit and drives the signal line by the DAC 38 and the signal line drive circuit 40 from the fall.

The signal line of the line block set in the display area is driven by the LCD controller 60 on the basis of the drive voltage generated on the basis of the gradation data. For the signal line of the line block set in the non-display area, on the other hand, either the common electrode voltage Vcom or one of the two end voltages of the gradation voltage level is selected and outputted by the LCD controller 60.

Moreover, the signal lines of the line block for the non-selection of the block output are set in the high-impedance state (not shown).

Figure 42:
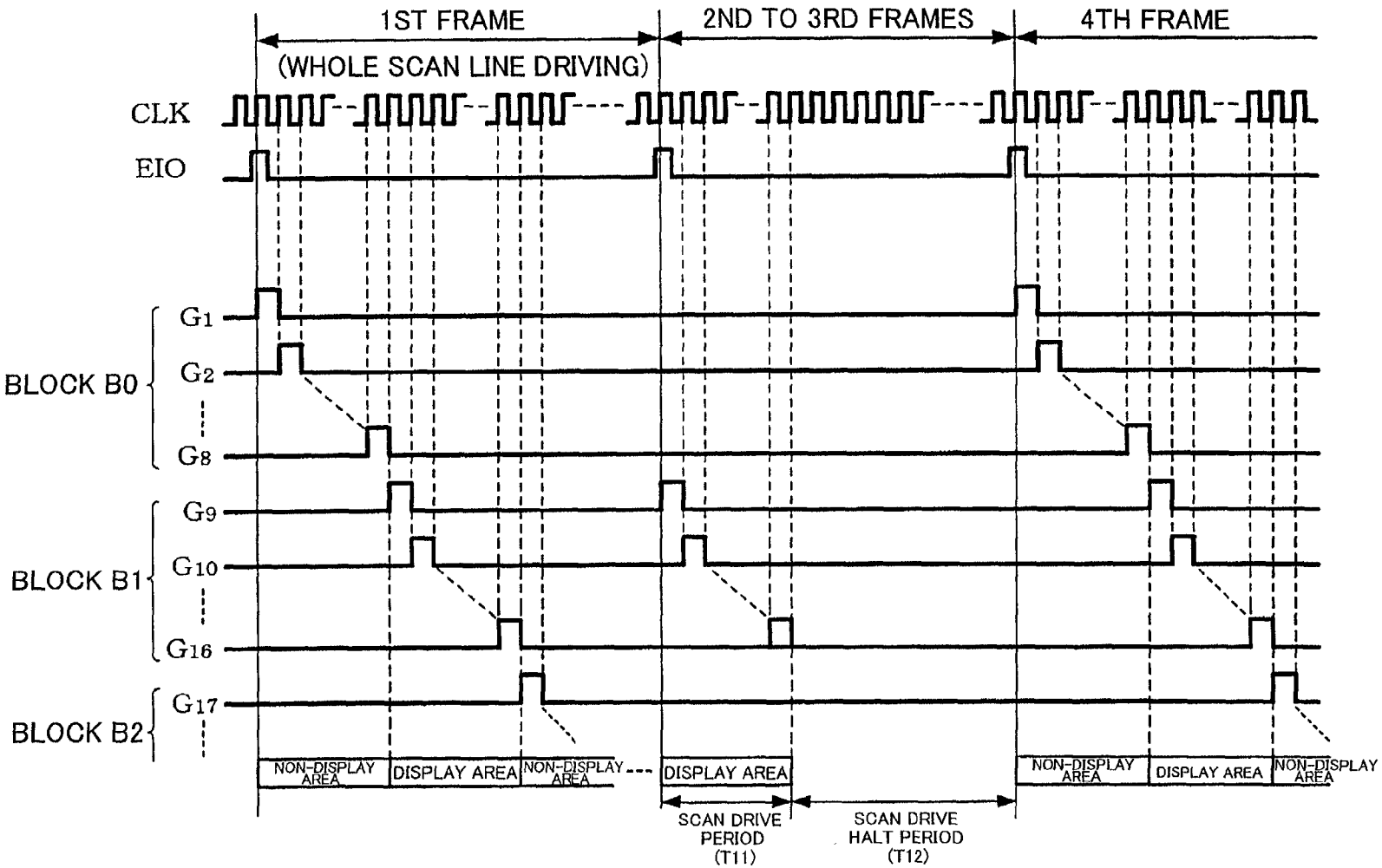
FIG. 42 is a timing chart showing one example of action timings of the scan driver which was controlled on its partial display by the LCD controller in this embodiment.

FIG. 42 shows one example of the action timings of the scan driver 50 controlled on its partial display by the LCD controller 60 in this embodiment.

Here, it is assumed that only the block B1 is set at the display area by the LCD controller 60 whereas the remaining blocks B0, B2, . . . and so on are set at the non-display areas.

The scan driver 50 scans and drives all the scan lines corresponding to the blocks B0 to BQ sequentially at the 1st frame and the 4th frame, for example, as described above, and only the scan lines of the block B1 set in the display area at the 2nd frame and the 3rd frame, for example.

In the scan driver 50, more specifically, at the 2nd frame and the 3rd frame, the enable input/output signal EIO is supplied only to the scan lines of the block set in the display area. Therefore, the scan driver 50 scans and drives only a period T11 corresponding to the display area. At this time, the signal driver to be controlled by the LCD controller 60 drives the signal lines on the basis of the image data corresponding to the display area. Thus, it is sufficient to do the drive only at the scan timing corresponding to the display area, and a scan drive halt period T12 can be provided at the 2nd frame and the 3rd frame.

At the 2nd frame and the 3rd frame, therefore, the scan drive is not required for the scan drive interrupt period so that the power consumption can be accordingly reduced.

Here in each frame, such a given non-display level voltage is supplied to the signal lines of the non-display area by the signal driver 30 that the voltage to be applied to the liquid crystal capacitor may not exceed a given threshold value. Therefore, it is possible to set the window for displaying a desired image only in the set display area.

2.7 Starting Sequence

The LCD controller 60 thus far described makes the display control of an LCD panel by controlling the signal driver 30 and the scan driver 50 in accordance with the contents set by the host such as the CPU.

In case the display device in this embodiment is individually started without considering the sequence after the start (i.e., the sequence after the LCD controller was started), it may be caused to normally act by such a failure that parameters are transmitted to the circuit which is not started.

In the following embodiment of the present invention, the signal driver 30 and scan driver 50 are started by the steps described below, before a desired image is displayed.

Figure 43:
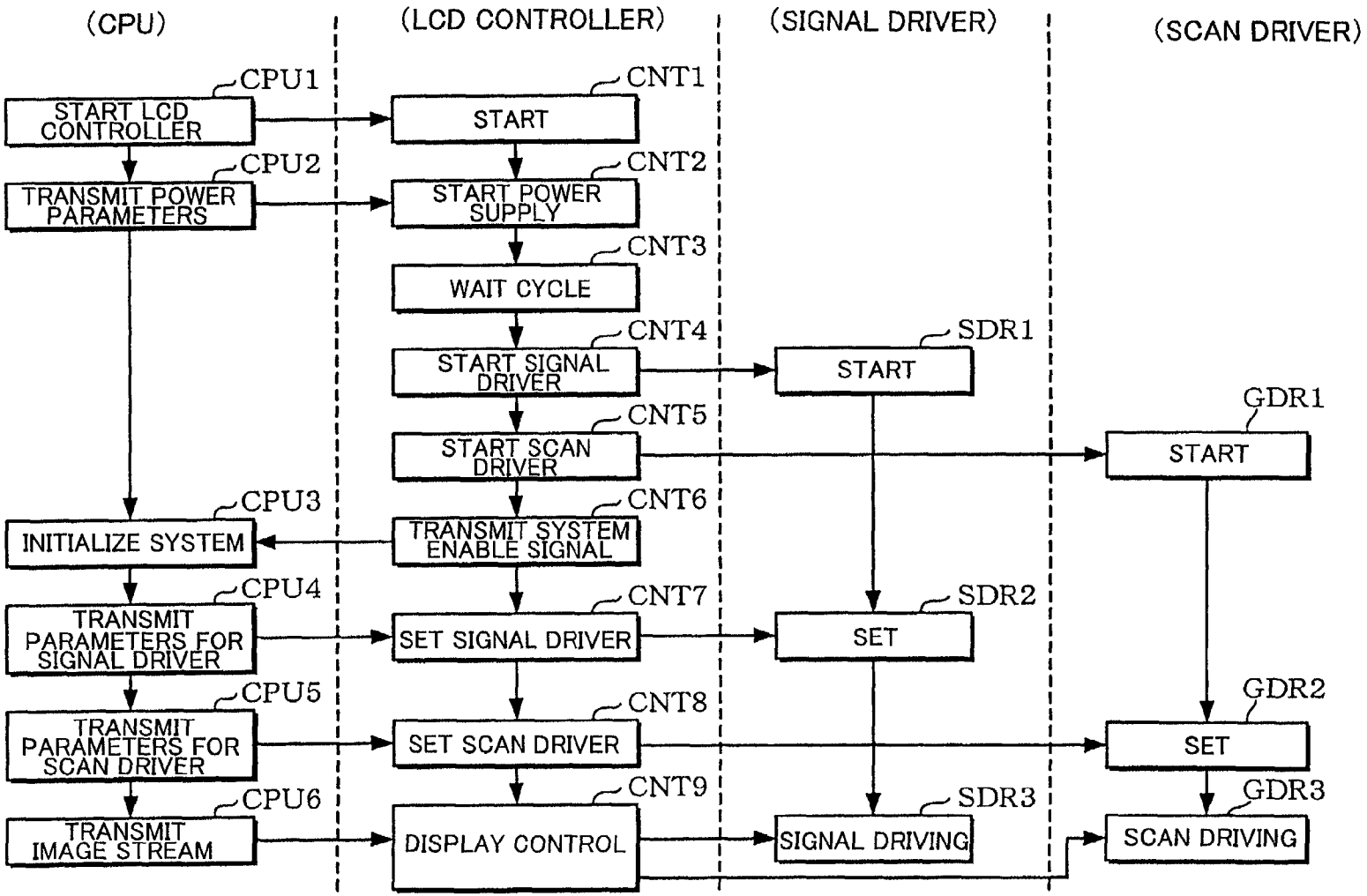
FIG. 43 is an explanatory diagram schematically showing a sequence for initializing a display device in this embodiment.

FIG. 43 schematically shows the starting sequence of the display device in this embodiment.

At first, the resets are activated all at once when the system power is turned ON. After this, the LCD controller 60 is started from the host (by CPU1). This can be realized by releasing the reset of the LCD controller 60, for example.

In response to this, the LCD controller 60 is started (at CNT1).

Moreover, the host transmits the parameters such as the frequencies of the boost/step-down clocks for determining the boosting efficiency and the step-down efficiency of the power circuits (CNT2). In this embodiment, the power circuit is controlled by the LCD controller 60. Then, the LCD controller 60 starts the power circuit (or releases the reset) (CNT2) and awaits the lapse of a given wait cycle (CNT3). After lapse of the wait cycle, the LCD controller 60 starts the signal driver 30 (or releases the rest) (CNT4) and starts the scan driver 50 (CNT5).

In response to the instruction from the LCD controller 60, the signal driver 30 and the scan driver 50 are started (SDR1 and GDR1).

Next, the LCD controller 60 transmits the system enable signal (CNT6) to inform the host of the preparation for starting the display device. In response to this, the host initializes the system (CPU3).

Moreover, the host transmits the signal driver parameters and the scan driver parameters to the LCD controller 60 (CPU4 and CPU5). Here, the signal driver parameters are the setting data for the block output select register or the setting data for the partial display select resistor. Moreover, the scan driver parameters are the setting data for the partial scan display select register.

In response to the signal driver parameters from the host, the LCD controller 60 sets the signal driver 30 in accordance with the contents (CNT7 and SDR2). In response to the scan driver parameters from the host, the LCD controller 60 sets the scan driver 50 in accordance with the contents (CNT8 and GDR2).

Then, the host transmits the image stream to the LCD controller 60 (CPU6), and the LCD controller 60 controls the display for the signal driver 30 and the scan driver 50 (CNT9). The signal driver 30 and the scan driver 50 do the signal drive (SDR3) and the scan drive (GDR3) to cause the liquid crystal panel of the display device to display the image.

3. Others

This embodiment has been described on the liquid crystal device having the LCD panel using the TFT liquid crystal, but should not be limited thereto. For example, the invention can also be applied to a signal driver or a scan driver for displaying and driving an organic EL panel including organic EL elements disposed to correspond to the pixels defined by signal lines and scan lines.

Figure 44:
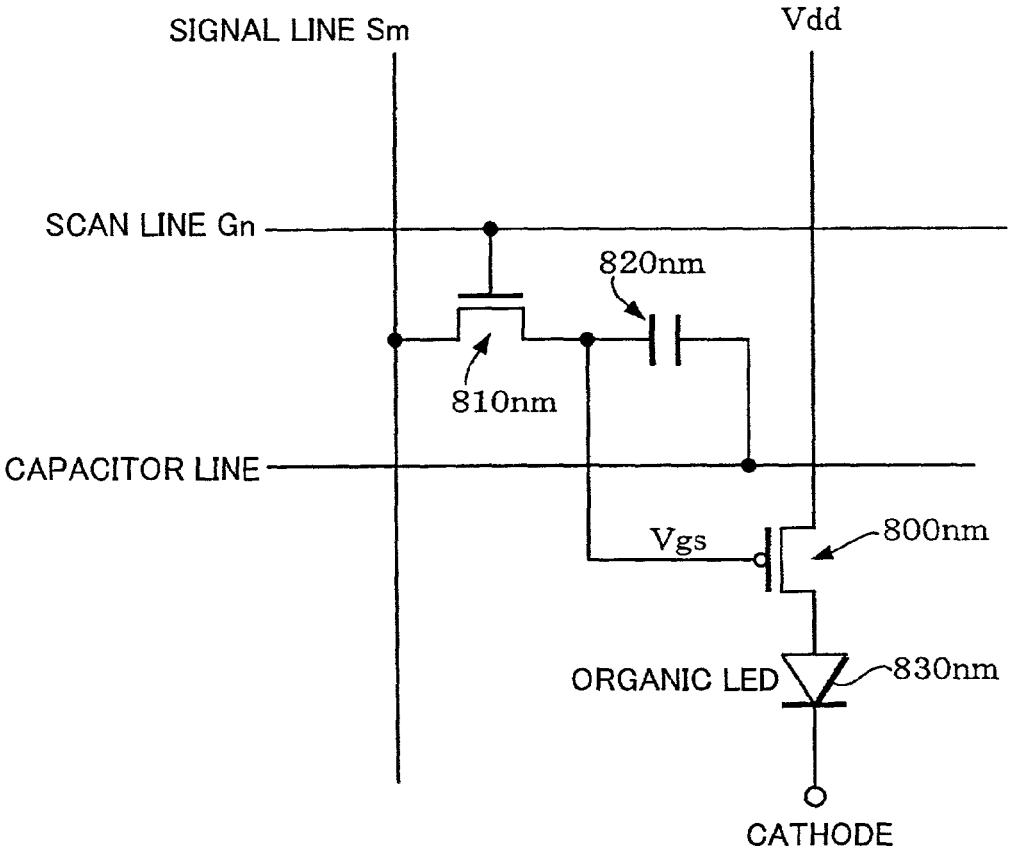
FIG. 44 is a circuit diagram showing one example of a two-transistor type pixel circuit in an organic EL panel.

FIG. 44 shows one example of a two-transistor type pixel circuit in the organic EL panel, the display of which is controlled by such signal driver and scan driver.

The organic EL panel is provided at the cross point between a signal line $S_m$ and a scan line $G_n$ with a drive TFT $\mathbf{800}_{nm}$, a switch TFT $\mathbf{810}_{nm}$, a hold capacitor $\mathbf{820}_{nm}$ and an organic LED $\mathbf{830}_{nm}$. The drive TFT $\mathbf{800}_{nm}$ is constructed of a p-type transistor.

The drive TFT $\mathbf{800}_{nm}$ and the organic LED $\mathbf{830}_{nm}$ are connected in series with the power line.

The switch TFT $\mathbf{810}_{nm}$ is interposed between the gate electrode of the drive TFT $\mathbf{800}_{nm}$ and the signal line $S_m$. The gate electrode of the switch TFT $\mathbf{810}_{nm}$ is connected with the scan line $G_n$.

The hold capacitor $\mathbf{820}_{nm}$ is interposed between the gate electrode of the drive TFT $\mathbf{800}_{nm}$ and the capacitor line.

When the scan line $G_n$ is driven in this organic EL element to turn ON the switch TFT $\mathbf{810}_{nm}$, the voltage of the signal line $S_m$ is written in the hold capacitor $\mathbf{820}_{nm}$ and is applied to the gate electrode of the drive TFT $\mathbf{800}_{nm}$. The gate voltage Vgs of the drive TFT $\mathbf{800}_{nm}$ is determined by the voltage of the signal line $S_m$ to decide the electric current to flow through the drive TFT $\mathbf{800}_{nm}$. The drive TFT $\mathbf{800}_{nm}$ and the organic LED $\mathbf{830}_{nm}$ are connected in series so that the current to flow through the drive TFT $\mathbf{800}_{nm}$ flows as it is through the organic LED $\mathbf{830}_{nm}$.

By holding the gate voltage Vgs according to the voltage of the signal line $S_m$ by the hold capacitor $\mathbf{820}_{nm}$, the current corresponding to the gate voltage Vgs is supplied to the organic LED $\mathbf{830}_{nm}$ for one frame period, for example, so that the continuously illuminating pixel can be realized in that frame.

Figure 45A:
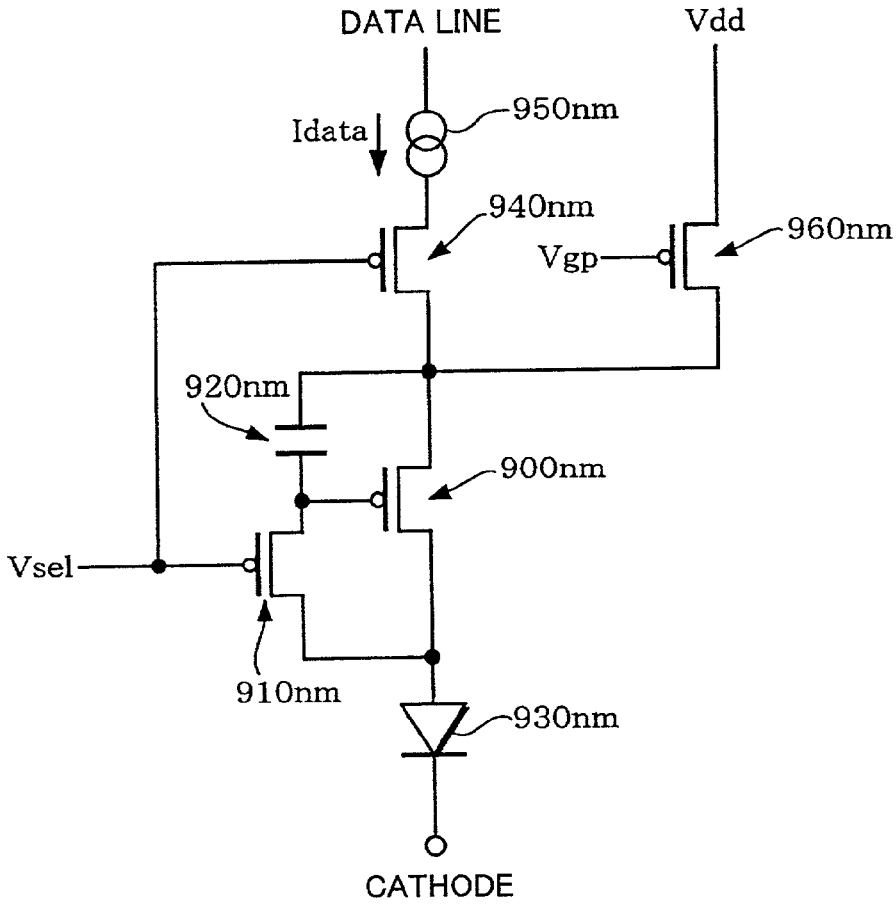
FIG. 45A is a circuit diagram showing one example of a four-transistor type pixel circuit in an organic EL panel.
Figure 45B:
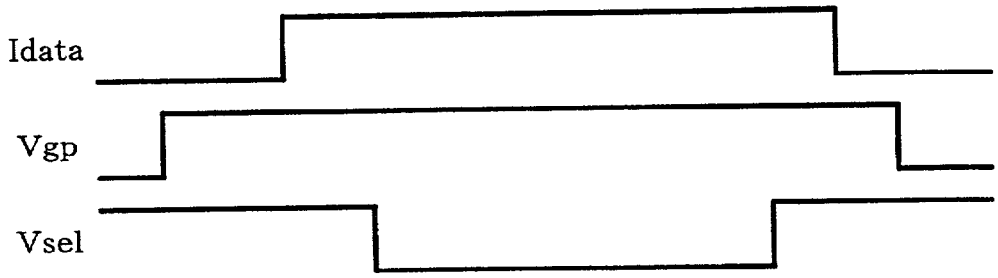
FIG. 45B is a timing chart showing one example of the display control timings of the four-transistor type pixel circuit.

FIG. 45A shows one example of a four-transistor type pixel circuit in the organic EL panel, the display of which is controlled by the signal driver and the scan driver thus far described. FIG. 45B shows one example of the display control timings of the pixel circuit.

In this case, too, the organic EL panel is provided with a drive TFT $\mathbf{900}_{nm}$, a switch TFT $\mathbf{910}_{nm}$, a hold capacitor $\mathbf{920}_{nm}$ and an organic LED $\mathbf{930}_{nm}$.

The points different from the two-transistor pixel element shown in FIG. 44 reside in that the pixel is supplied with a constant current Idata in place of the constant voltage from a constant current source $\mathbf{950}_{nm}$ through a p-type TFT $\mathbf{940}_{nm}$ acting as the switch element, and in that the hold capacitor $\mathbf{920}_{nm}$ and the drive TFT $\mathbf{900}_{nm}$ are connected with the power line through a p-type TFT $\mathbf{960}_{nm}$ acting as the switch element.

In this organic EL element, the p-type TFT $\mathbf{960}_{nm}$ is turned OFF at first with a gate voltage Vgp to cut the power line, and the p-type TFT $\mathbf{940}_{nm}$ and the switch TFT $\mathbf{910}_{nm}$ are turned ON with a gate voltage Vsel thereby to supply the constant current Idata from the constant current source 950 nm to the drive TFT $\mathbf{900}_{nm}$.

Till the current to flow through the drive TFT $\mathbf{900}_{nm}$ is stabilized, a voltage according to the constant current Idata is held in the hold capacitor $\mathbf{920}_{nm}$.

Subsequently, the p-type TFT $\mathbf{940}_{nm}$ and the switch TFT $\mathbf{910}_{nm}$ are turned OFF with the gate voltage Vsel, and the p-type TFT $\mathbf{960}_{nm}$ is turned ON with the gate voltage Vgp thereby to connect the power line electrically with the drive TFT $\mathbf{900}_{nm}$ and the organic LED $\mathbf{930}_{nm}$. At this time, the current substantially equal to or according to the constant current Idata is supplied to the organic LED $\mathbf{930}_{nm}$ with the voltage held in the hold capacitor $\mathbf{920}_{nm}$.

This organic EL element can be constructed by exemplifying the scan line by the gate electrode Vsel and the signal line by the data line.

The organic LED should not be limited in its element structure but may be constructed such that a luminescent layer is formed over a transparent anode (ITO) and provided thereover with a metal cathode or such that aluminescent layer, an optically transparent cathode and a transparent seal are formed over a metal anode.

The present invention is not limited to the above-described embodiments, and various modifications can be made within the scope of the invention. For example, the present invention can be applied to a plasma display device.

What is claimed is:

1. A display control circuit which controls display of an electro-optical device having pixels specified by 1st to N-th scan lines (N is a natural number) and 1st to M-th signal lines (M is a natural number) intersecting each other, the display control circuit comprising:

an area-block-display control data storing section which stores area-block-display control data used to set a display area or a non-display area in units of area blocks each of which includes a plurality of the signal lines and a plurality of the scan lines;

a controller which:

sets the display area or the non-display area in units of the area blocks on the basis of the area-block-display control data, for a scan drive circuit which sequentially performs scan-driving of at least part of the 1st to N-th scan lines corresponding to the display area;

and which sets the display area or the non-display area in units of the area blocks on the basis of the area-block-display control data, for a signal drive circuit which drives at least part of the 1st to M-th signal lines corresponding to the display area;

a band-partial-display control data holding section which holds band-partial-display control data used to set the display area or the non-display area in units of line blocks each of which includes a plurality of the scan lines; and a mode switching section which performs switching between a first mode and a second mode;

wherein the display area or the non-display area is specified in units of the area blocks for the scan drive circuit and the signal drive circuit on the basis of the area-block-display control data, in the first mode; and wherein the display area or the non-display area is specified in units of the line blocks for only the scan drive circuit of the scan drive circuit and the signal drive circuit on the basis of the band-partial-display control data, in the second mode.

2. An electro-optical device comprising:

pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 1.

3. The electro-optical device as defined in claim 2, wherein the signal drive circuit includes:

a block output select data holding section which holds block output select data used to instruct whether or not signal-driving is performed in units of line blocks each of which includes a plurality of the signal lines;

a partial display data holding section which holds partial display data used to set a display area or a non-display area in units of line blocks each of which includes a plurality of the signal lines; and a signal line drive section which makes an output to a signal line in a line block instructed not to perform signal-driving by the block output select data into the high impedance state, performs one of signal-driving based on image data and provision of a given non-display level voltage, on the basis of the partial display data, for a signal line in a line block instructed to perform signal-driving by the block output select data, and wherein the display control circuit includes:

a block output select data setting section which sets the block output select data in the block output select data holding section of the signal drive circuit;

a partial display data conversion section which converts first partial display data which sets the display area or the non-display area in units of the line blocks, into second partial display data which is obtained by shifting data in a P-th block (P is a natural number) of the first partial display data to data in a (P+1)-th block, when the P-th block set as the display area is instructed not to perform signal-driving by the block output select data; and a partial display data setting section which sets the second partial display data in the partial display data holding section of the signal drive circuit.

4. The electro-optical device as defined in claim 3, further comprising:

an image data generation section which generates second image data obtained by shifting image data in the P-th block of first image data supplied to the signal drive circuit as image data in (P+1)-th block, when the P-th block set as the display area by the first partial display data which sets the display area or the non-display area in units of line blocks each of which includes a plurality of the signal lines; and an image data providing section which provides the second image data to the signal drive circuit.

5. A display device comprising:

an electro-optical device having pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 1.

6. A display control circuit which controls display of an electro-optical device having pixels specified by 1st to N-th scan lines (N is a natural number) and 1st to M-th signal lines (M is a natural number) intersecting each other, the display control circuit comprising:

an area-block-display control data storing section which stores area-block-display control data used to set a display area or a non-display area in units of area blocks each of which includes a plurality of the signal lines and a plurality of the scan lines;

a controller which:

sets the display area or the non-display area in units of the area blocks on the basis of the area-block-display control data, for a scan drive circuit which sequentially performs scan-driving of at least part of the 1st to N-th scan lines corresponding to the display area; and which sets the display area or the non-display area in units of the area blocks on the basis of the area-block-display control data, for a signal drive circuit which drives at least part of the 1st to M-th signal lines corresponding to the display area;

wherein the scan drive circuit is controlled such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a given reference frame.

7. The display control circuit as defined in claim 6, wherein the reference frame is next to a frame in which a given display control event has occurred.

8. The display control circuit as defined in claim 7, wherein the scan drive circuit is controlled such that scan-driving is performed on the non-display scan line in the frame in which the display control event has occurred, for at least one scan period after the occurrence of the display control event.

9. The display control circuit as defined in claim 8, wherein the display control event occurs on the basis of at least one of the generation, extinguishment, movement and size change of the display area or the non-display area.

10. The display control circuit as defined in claim 7, wherein the display control event occurs on the basis of at least one of the generation, extinguishment, movement and size change of the display area or the non-display area.

11. A display control circuit which controls display of an electro-optical device having pixels specified by 1st to N-th scan lines (N is a natural number) and 1st to M-th signal lines (M is a natural number) intersecting each other, the display control circuit further comprising:

a band-partial-display control data holding section which holds band-partial-display control data used to set a display area or a non-display area in units of area blocks each of which includes a plurality of the scan lines; and a controller which sets the display area or the non-display area in units of the area blocks on the basis of the band-partial-display control data, for a scan drive circuit which performs scan-driving of the 1st to N-th scan lines;

wherein the scan drive circuit is controlled such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a given reference frame.

12. The display control circuit as defined in claim 11, wherein the reference frame is next to a frame in which a given display control event has occurred.

13. The display control circuit as defined in claim 12, wherein the scan drive circuit is controlled such that scan-driving is performed on the non-display scan line in the frame in which the display control event has occurred, for at least one scan period after the occurrence of the display control event.

14. The display control circuit as defined in claim 13, wherein the display control event occurs on the basis of at least one of the generation, extinguishment, movement and size change of the display area or the non-display area.

15. The display control circuit as defined in claim 12, wherein the display control event occurs on the basis of at least one of the generation, extinguishment, movement and size change of the display area or the non-display area.

16. An electro-optical device comprising:

pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 11.

17. The electro-optical device as defined in claim 16, wherein the signal drive circuit includes:

a block output select data holding section which holds block output select data used to instruct whether or not signal-driving is performed in units of line blocks each of which includes a plurality of the signal lines;

a partial display data holding section which holds partial display data used to set a display area or a non-display area in units of line blocks each of which includes a plurality of the signal lines; and a signal line drive section which makes an output to a signal line in a line block instructed not to perform signal-driving by the block output select data into the high impedance state, performs one of signal-driving based on image data and provision of a given non-display level voltage, on the basis of the partial display data, for a signal line in a line block instructed to perform signal-driving by the block output select data, and wherein the display control circuit includes:

a block output select data setting section which sets the block output select data in the block output select data holding section of the signal drive circuit;

a partial display data conversion section which converts first partial display data which sets the display area or the non-display area in units of the line blocks, into second partial display data which is obtained by shifting data in a P-th block (P is a natural number) of the first partial display data to data in a (P+1)-th block, when the P-th block set as the display area is instructed not to perform signal-driving by the block output select data; and a partial display data setting section which sets the second partial display data in the partial display data holding section of the signal drive circuit.

18. The electro-optical device as defined in claim 17, further comprising:

an image data generation section which generates second image data obtained by shifting image data in the P-th block of first image data supplied to the signal drive circuit as image data in (P+1)-th block, when the P-th block set as the display area by the first partial display data which sets the display area or the non-display area in units of line blocks each of which includes a plurality of the signal lines; and an image data providing section which provides the second image data to the signal drive circuit.

19. A display device comprising:

an electro-optical device having pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 11.

20. A display control circuit which controls display of an electro-optical device having pixels specified by 1st to N-th scan lines (N is a natural number) and 1st to M-th signal lines (M is a natural number) intersecting each other, the display control circuit comprising:

a controller which:

sets a display area or a non-display area for a scan drive circuit which performs scan-driving of the 1st to N-th scan lines; and which controls the scan drive circuit such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a given reference frame.

21. The display control circuit as defined in claim 20, wherein the reference frame is next to a frame in which a given display control event has occurred.

22. The display control circuit as defined in claim 21, wherein the scan drive circuit is controlled such that scan-driving is performed on the non-display scan line in the frame in which the display control event has occurred, for at least one scan period after the occurrence of the display control event.

23. The display control circuit as defined in claim 22, wherein the display control event occurs on the basis of at least one of the generation, extinguishment, movement and size change of the display area or the non-display area.

24. The display control circuit as defined in claim 21, wherein the display control event occurs on the basis of at least one of the generation, extinguishment, movement and size change of the display area or the non-display area.

25. An electro-optical device comprising:

pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 20.

26. The electro-optical device as defined in claim 25, wherein the signal drive circuit includes:

a block output select data holding section which holds block output select data used to instruct whether or not signal-driving is performed in units of line blocks each of which includes a plurality of the signal lines;

a partial display data holding section which holds partial display data used to set a display area or a non-display area in units of line blocks each of which includes a plurality of the signal lines; and a signal line drive section which makes an output to a signal line in a line block instructed not to perform signal-driving by the block output select data into the high impedance state, performs one of signal-driving based on image data and provision of a given non-display level voltage, on the basis of the partial display data, for a signal line in a line block instructed to perform signal-driving by the block output select data, and wherein the display control circuit includes:

a block output select data setting section which sets the block output select data in the block output select data holding section of the signal drive circuit;

a partial display data conversion section which converts first partial display data which sets the display area or the non-display area in units of the line blocks, into second partial display data which is obtained by shifting data in a P-th block (P is a natural number) of the first partial display data to data in a (P+1)-th block, when the P-th block set as the display area is instructed not to perform signal-driving by the block output select data; and a partial display data setting section which sets the second partial display data in the partial display data holding section of the signal drive circuit.

27. The electro-optical device as defined in claim 26, further comprising:

an image data generation section which generates second image data obtained by shifting image data in the P-th block of first image data supplied to the signal drive circuit as image data in (P+1)-th block, when the P-th block set as the display area by the first partial display data which sets the display area or the non-display area in units of line blocks each of which includes a plurality of the signal lines; and an image data providing section which provides the second image data to the signal drive circuit.

28. A display device comprising:

an electro-optical device having pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 20.

29. A display control circuit which controls display of an electro-optical device having pixels specified by 1st to N-th scan lines (N is a natural number) and 1st to M-th signal lines (M is a natural number) intersecting each other, the display control circuit comprising:

a band-partial-display control data holding section which holds band-partial-display control data used to set a display area or a non-display area in units of area blocks each of which includes a plurality of the scan lines; and a controller which sets the display area or the non-display area in units of the area blocks on the basis of the band-partial-display control data, for a scan drive circuit which performs scan-driving of the 1st to N-th scan lines;

wherein the scan drive circuit is controlled such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a frame which is next to another frame in which a given display control event has occurred;

wherein the scan drive circuit is controlled such that scan-driving is performed on the non-display scan line in the frame in which the display control event has occurred, for at least one scan period after the occurrence of the display control event; and wherein the display control event occurs on the basis of at least one of the generation, extinguishment, movement and size change of the display area or the non-display area.

30. An electro-optical device comprising:

pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 29.

31. A display device comprising:

an electro-optical device having pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 29.

32. A display control circuit which controls display of an electro-optical device having pixels specified by 1st to N-th scan lines (N is a natural number) and 1st to M-th signal lines (M is a natural number) intersecting each other, the display control circuit comprising:

a controller which:

sets a display area or a non-display area for a scan drive circuit which performs scan-driving of the 1st to N-th scan lines; and which controls the scan drive circuit such that scan-driving is performed on a display scan line which is at least part of the 1st to N-th scan lines corresponding to the display area, for every frame period, and that scan-driving is also performed on a non-display scan line which is at least part of the 1st to N-th scan lines except the display scan line, for every three or more odd frame periods from a given reference frame, wherein the reference frame is next to another frame in which a given display control event has occurred;

wherein the scan drive circuit is controlled such that scan-driving is performed on the non-display scan line in the frame in which the display control event has occurred, for at least one scan period after the occurrence of the display control event; and wherein the display control event occurs on the basis of at least one of the generation, extinguishment, movement and size change of the display area or the non-display area.

33. An electro-optical device comprising:

pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 32.

34. A display device comprising:

an electro-optical device having pixels specified by 1st to N-th scan lines (N is a natural number) and 1st to M-th signal lines (M is a natural number) intersecting each other;

a scan drive circuit which performs scan-driving of the 1st to N-th scan lines;

a signal drive circuit which drives the 1st to M-th signal lines on the basis of image data; and the display control circuit as defined in claim 32.

35. A display control method of controlling display of an electro-optical device having pixels specified by 1st to N-th scan lines (N is a natural number) and 1st to M-th signal lines (M is a natural number) intersecting each other, the method comprising:

specifying a display area or a non-display area for a signal drive circuit in units of line blocks each of which includes a plurality of the signal lines and for a scan drive circuit in units of line blocks each of which includes a plurality of the scan lines, the signal drive circuit driving 1st to M-th signal lines, and the scan drive circuit performing scan-driving on 1st to N-th scan lines; and providing image data corresponding to the display area to the signal circuit;

wherein scan-driving is performed on the basis of the image data;

wherein a given non-display level voltage is applied to a signal line in a line block set as the non-display area, and signal-driving is performed on a signal line in a line block set as the display area with a drive voltage corresponding to the image data; and wherein scan-driving is performed on a scan line in a line block set as the display area for every frame period, and also scan-driving is performed on a scan lines in a line block set as the non-display area for every three or more odd frame periods from a given reference frame.

36. The display control method as defined in claim 35, wherein the reference frame is next to a frame in which a given display control event has occurred.

37. The display control method as defined in claim 36, wherein scan-driving is performed on the non-display scan line in the frame in which the display control event has occurred, for at least one scan period after the occurrence of the display control event.

38. The display control method as defined in claim 36, wherein the display control event occurs on the basis of at least one of the generation, extinguishment, movement and size change of the display area or the non-display area.

39. A display control method of controlling display of an electro-optical device having pixels specified by 1st to N-th scan lines (N is a natural number) and 1st to M-th signal lines (M is a natural number) intersecting each other, wherein a display area or a non-display area is set an area of the pixels; and wherein scan-driving is performed on a display scan line which is at least part of the 1st to N-th scan lines corresponding to the display area, for every frame period, and scan-driving is also performed on a non-display scan line which is at least part of the 1st to N-th scan lines except the display scan line, for every three or more odd frame periods from a given reference frame.

40. The display control method as defined in claim 39, wherein the reference frame is next to a frame in which a given display control event has occurred.

41. A display control method of controlling display of an electro-optical device having pixels specified by 1st to N-th scan lines (N is a natural number) and 1st to M-th signal lines (M is a natural number) intersecting each other, wherein a display area or a non-display area is set an area of the pixels; and wherein scan-driving is performed on a non-display scan line which is at least part of the 1st to N-th scan lines except the display scan line, for every three or more odd frame periods from a frame which is next to another frame in which a given display control event has occurred;

wherein scan-driving is performed on the non-display scan line in the frame in which the display control event has occurred, for at least one scan period after the occurrence of the display control event; and wherein the display control event occurs on the basis of at least one of the generation, extinguishment, movement and size change of the display area or the non-display area.

* * * * *